US010563482B2

(12) United States Patent
Campbell et al.

(10) Patent No.: US 10,563,482 B2
(45) Date of Patent: Feb. 18, 2020

(54) PROFILE-SELECTIVE SLEEVES FOR SUBSURFACE MULTI-STAGE VALVE ACTUATION

(71) Applicant: SC ASSET CORPORATION, Calgary (CA)

(72) Inventors: Sean P. Campbell, Airdrie (CA); Daniel Rojas, Cypress, TX (US)

(73) Assignee: SC ASSET CORPORATION, Calgary, AB (CA)

( * ) Notice: Subject to any disclaimer, the term of this patent is extended or adjusted under 35 U.S.C. 154(b) by 119 days.

(21) Appl. No.: 15/820,257

(22) Filed: Nov. 21, 2017

(65) Prior Publication Data

US 2019/0153813 A1 May 23, 2019

(51) Int. Cl.

| | |
|---|---|
| ***E21B 34/14*** | (2006.01) |
| ***E21B 23/02*** | (2006.01) |
| ***E21B 34/00*** | (2006.01) |
| ***E21B 34/10*** | (2006.01) |

(52) U.S. Cl.

CPC ..... *E21B 34/14* (2013.01); *E21B 23/02* (2013.01); *E21B 34/103* (2013.01); *E21B 2034/007* (2013.01)

(58) Field of Classification Search

CPC ..... E21B 34/14; E21B 23/02

See application file for complete search history.

(56) References Cited

U.S. PATENT DOCUMENTS 2,862,564 A * 12/1958 Bostock ..... E21B 23/02 166/125
3,115,188 A * 12/1963 Cochran ..... E21B 34/14 166/332.4
3,856,081 A * 12/1974 Canalizo ..... E21B 23/02 166/123

(Continued)

FOREIGN PATENT DOCUMENTS

CA 2412072 A1 5/2003
WO 2013048810 A1 4/2013

(Continued)

OTHER PUBLICATIONS

Canadian Intelectual Property Office—Office Action dated Feb. 12, 2018—CA2,986,346.

(Continued)

*Primary Examiner* — Blake E Michener
(74) *Attorney, Agent, or Firm* — D. Doak Horne

(57) ABSTRACT

A sliding valve has a valve body, a sliding sleeve received in a longitudinal bore of the valve body, and a collet receivable in a longitudinal bore of the sliding sleeve. The valve body has one or more fluid ports on an uphole portion of the sidewall thereof. The sliding sleeve is movable between an uphole closed position closing the one or more fluid ports and a downhole open position opening the one or more fluid ports.

The sliding sleeve has a sleeve-profile formed at least by one or more sleeve-grooves and one or more sleeve-ridges longitudinally distributed on an inner surface thereof. The (Continued)

collet has a flexible collet-profile formed by at least one or more collet-grooves and one or more collet-ridges respectively corresponding to the sleeve-grooves and sleeve-ridges. The length of each sleeve-ridge or collet-ridge is smaller than that of corresponding sleeve-groove or collet-groove.

32 Claims, 28 Drawing Sheets

(56) References Cited

U.S. PATENT DOCUMENTS

| | | | | |
|---|---|---|---|---|
| 4,043,392 | A | 8/1977 | Gazda | |
| 4,167,970 | A * | 9/1979 | Cowan | E21B 43/10 166/208 |
| 4,436,152 | A | 3/1984 | Fisher, Jr. et al. | |
| 4,896,721 | A * | 1/1990 | Welch | E21B 23/02 166/214 |
| 5,305,833 | A | 4/1994 | Collins | |
| 5,309,988 | A | 5/1994 | Shy et al. | |
| 5,579,829 | A * | 12/1996 | Comeau | E21B 23/02 166/117.6 |
| 5,641,023 | A | 6/1997 | Ross et al. | |
| 5,730,224 | A | 3/1998 | Williamson et al. | |
| 6,199,632 | B1 * | 3/2001 | Shy | E21B 23/04 166/212 |
| 6,202,746 | B1 * | 3/2001 | Vandenberg | E21B 7/061 166/117.6 |
| 6,631,768 | B2 * | 10/2003 | Patel | E21B 17/1021 166/237 |
| 7,325,617 | B2 | 2/2008 | Murray | |
| 7,552,779 | B2 | 6/2009 | Murray | |
| 8,393,402 | B2 * | 3/2013 | Saurer | E21B 7/061 166/117.6 |
| 8,678,097 | B1 * | 3/2014 | Telfer | E21B 23/02 166/117.6 |
| 9,127,520 | B2 * | 9/2015 | Steele | E21B 23/03 |
| 9,534,471 | B2 * | 1/2017 | Etzel | E21B 34/14 |
| 9,574,439 | B2 * | 2/2017 | Joseph | E21B 23/02 |
| 9,611,727 | B2 | 4/2017 | Campbell et al. | |
| 9,739,117 | B2 * | 8/2017 | Campbell | E21B 34/14 |
| 9,938,788 | B2 * | 4/2018 | Barbato | E21B 23/03 |
| 10,001,001 | B2 * | 6/2018 | Jani | E21B 34/14 |
| 2002/0166667 | A1 * | 11/2002 | Patel | E21B 17/1021 166/373 |
| 2003/0173089 | A1 | 9/2003 | Westgard | |
| 2004/0149452 | A1 | 8/2004 | Pendleton | |
| 2007/0221373 | A1 | 9/2007 | Murray | |
| 2007/0221384 | A1 | 9/2007 | Murray | |
| 2010/0212911 | A1 * | 8/2010 | Chen | E21B 23/04 166/373 |
| 2014/0209306 | A1 | 7/2014 | Hughes et al. | |
| 2015/0060076 | A1 * | 3/2015 | Campbell | E21B 34/14 166/308.1 |
| 2015/0218916 | A1 | 8/2015 | Richards et al. | |
| 2015/0226034 | A1 | 8/2015 | Jani | |
| 2016/0265294 | A1 * | 9/2016 | Robertson | E21B 29/00 |
| 2017/0198543 | A1 * | 7/2017 | Nordheimer | E21B 33/12 |
| 2017/0350215 | A1 * | 12/2017 | Campbell | E21B 34/14 |
| 2018/0003005 | A1 * | 1/2018 | Dorban | E21B 34/14 |
| 2018/0258701 | A1 * | 9/2018 | Saurer | E21B 7/061 |
| 2018/0274316 | A1 * | 9/2018 | Dancer | E21B 23/01 |

FOREIGN PATENT DOCUMENTS

| | | | |
|---|---|---|---|
| WO | 2015160342 | A1 | 10/2015 |
| WO | 2016178004 | A1 | 11/2016 |

OTHER PUBLICATIONS

Canadian Intellectual Property Office—Office Action dated Jul. 4, 2018—CA2,986,346.

ISA/CA—Canadian Intellectual Property Office—PCT International Search Report and Written Opinion dated Jun. 11, 2018—PCT/CA2017/051394.

* cited by examiner

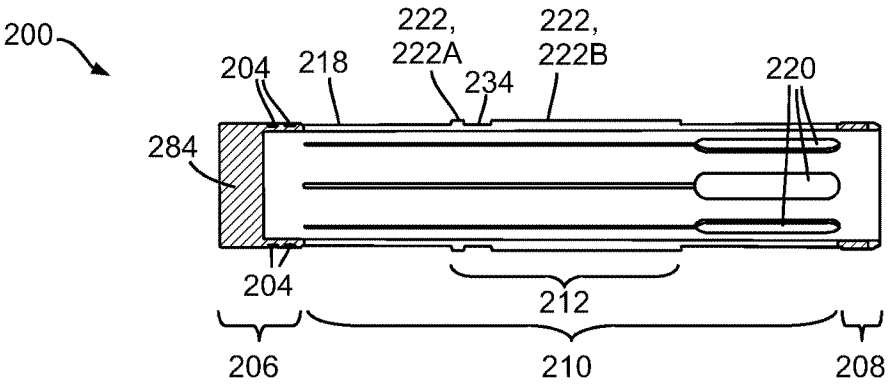
FIG. 19
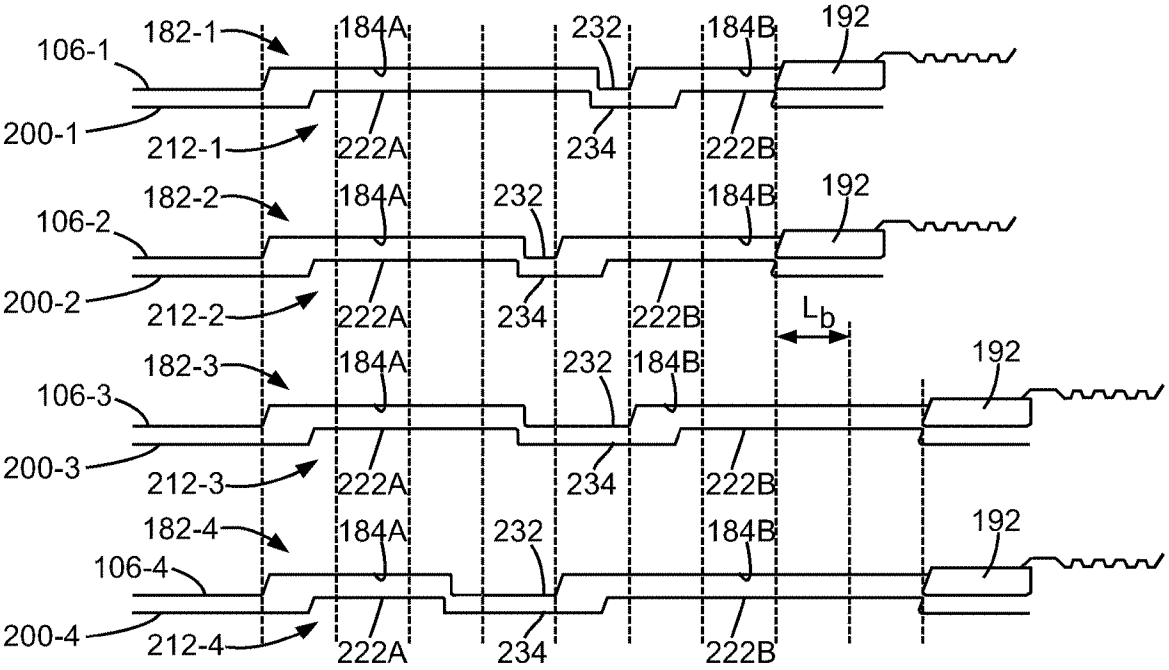
FIG. 20A
FIG. 20B
FIG. 20C
FIG. 20D

A2
B2
C2
D2

PROFILE-SELECTIVE SLEEVES FOR SUBSURFACE MULTI-STAGE VALVE ACTUATION

FIELD OF THE DISCLOSURE

The present disclosure relates generally to downhole tools and methods, and in particular to downhole tools having profile-selective sleeves for subsurface multi-stage valve actuation.

BACKGROUND

Downhole tools have been widely used in oil and gas industries. Many downhole tools comprise pressure-actuatable valves. For example, a prior-art ball-actuated sliding valve comprises a tubular valve housing having a bore and receiving in the bore a sliding sleeve. The sliding sleeve comprises a ball seat at an uphole end thereof, and is initially configured to an uphole closed position blocking one or more fluid ports on the sidewall of the valve housing. To actuate the sliding valve, a ball is dropped and seats against the ball seat of the sliding sleeve. Then, a fluid pressure is applied to the ball to actuate the sliding sleeve downhole to an open position to open the fluid ports on the valve housing.

One or more ball-actuated sliding valves may be used in a fracking process for fracking a subterranean formation. However, an issue in cascading a plurality of ball-actuated sliding valves for fracking is that the bore of a downhole sliding valve has to be smaller than that of the sliding valves uphole thereof to allow a smaller-size ball to pass through those uphole sliding valves to reach the target downhole sliding valve. In other words, the bores of the cascaded sliding valves have to reduce from uphole to downhole to ensure successful operation, thereby causing reduced flow rate at the downhole end.

U.S. Pat. No. 4,043,392 to Gazda teaches a well system for selectively locking well tools along a flow conductor in a well bore and a tool string for use in the flow conductor including a locking mandrel, a sleeve shifting device, and a well safety valve. The selective locking system has a landing and locking recess profile including both upwardly and downwardly facing stop shoulders. One form of the locking system is in a sliding sleeve valve including a cam release shoulder to free a selector and locking key when the sleeve valve is moved between spaced longitudinal locations. Another form of the locking system may be along a landing nipple and require that the well tool locked therein be disabled for release of the selector and locking tools. The sleeve shifting device has means for opening and closing the sliding sleeve valve including keys having upwardly and downwardly facing stop shoulders and recess profiles which are compatible with the landing and locking recess profile of the sleeve valve or of a landing nipple. The sleeve shifting device may be used also as a locking mandrel. Selectivity is provided by variation in the landing and locking profiles and the key profiles.

In U.S. Pat. No. 4,043,392, the spring-biased key profiles are mutually exclusive. A key profile will only engage a slidable sleeve with a mating internal profile.

U.S. Pat. No. 4,436,152 to Fisher, et al. teaches an improved shifting tool connectable in a well tool string and useful to engage and position a slidable sleeve in a sliding sleeve device in a well flow conductor. The selectively profiled shifting tool keys provide better fit with and more contact area between keys and slidable sleeves. When the engaged slidable sleeve cannot be moved up and the shifting tool is not automatically disengaged, emergency disengagement means may be utilized by applying upward force to the shifting tool sufficient to shear pins and cause all keys to be cammed inwardly at both ends to completely disengage for removal of the shifting tool from the sliding sleeve device.

U.S. Pat. No. 5,305,833 to Collins teaches a shifting tool for sliding sleeve valves for use in oil and gas wells which has locating dogs that are used for selectively locating and engaging a shoulder inside the valve. Primary keys engage and selectively shift the sliding sleeve to an equalized position as well as prevent premature shifting to a fully open position. Also included is apparatus for selectively overriding the shifting prevention following equalization. Secondary keys lead the primary keys in the shifting direction and engage the sleeve and move it to the fully open detent position. There is also selective disengagement of the shifting tool from the sleeve valve to allow withdrawal of the shifting tool form the well. Furthermore, a method for selectively and sequentially shifting the sliding sleeve for a sliding sleeve valve from the closed to equalizing position, and then from the equalizing to fully open position is disclosed.

In particular, U.S. Pat. No. 5,305,833 teaches two separate spring biased keys, wherein a first of the two keys can fit in the profile of a second of the two keys. However, the second key cannot fit in the profile of the first key.

U.S. Pat. No. 5,309,988 to Shy, et al. teaches a subsurface well flow control system including a series of movable sleeve type flow control devices installed in a well flow conductor at various fluid-containing fracture zones, and a shifter tool movable through the conductor and operable to selectively shift any selected number of the sleeve portions of the flow control devices, in either direction between their open and closed positions, without removing the tool from the conductor. Radially retractable anchor and shifter key sets are carried in sidewall openings of the tool body, and are respectively configured to be lockingly engaged with interior side surface groove sets on the body and movable sleeve portions of any of the flow control devices. The key sets are spring-biased radially outwardly toward extended positions, and an electromechanical drive system disposed within the tool body is operative to radially retract the key sets, and to axially drive the shifter key set toward or away from the anchor key set. This permits the tool to be moved into and through any of the flow control devices in either axial direction, locked to the device, operated to shift its sleeve portion fully or partially in either direction, and then disengaged from the flow control device and moved to any other one of the flow control devices to shift its sleeve portion. Interengaged V-threads on the body and sleeve portions of each flow control device facilitate the releasable retention of the sleeve portion in a partially shifted position.

U.S. Pat. No. 5,309,988 also teaches two mutually exclusive key profiles.

U.S. Pat. No. 5,730,224 to Williamson, et al. teaches a subterranean structure for controlling tool access to a lateral wellbore extending from a wellbore. The subterranean structure comprises a bushing that is located in the wellbore and proximate an opening to the lateral wellbore and that has an access window therethrough for allowing access by a tool to the lateral well through the opening. The bushing further has a slidable access control device coaxially coupled thereto. Also included is a shifter that is engageable with the slidable access control device to cause the slidable access control device to slide between an open position wherein a tool is allowed to pass through the window and the opening and into the lateral wellbore and a closed position wherein the tool is prevented from passing through the window and the opening and into the lateral wellbore. Such patent further teaches a method of controlling tool access to a lateral wellbore extending from a wellbore. The preferred method comprises the steps of: 1) locating a bushing in the wellbore proximate an opening to the lateral wellbore, the bushing having an access window therethrough for allowing access by a tool to the lateral wellbore through the opening, the bushing further having a slidable access control device coaxially coupled thereto; 2) engaging the slidable access control device with a shifter to slide the slidable access control device with respect to the bushing; and 3) sliding the slidable access control device between an open position wherein a tool is allowed to pass through the window and the opening and into the lateral wellbore and a closed position wherein the tool is prevented from passing through the window and the opening mad into the lateral wellbore.

U.S. Pat. No. 5,730,224 teaches two key profiles with one is a reverse of the other.

U.S. Pat. Nos. 7,325,617 and 7,552,779 to Murray teach a system allowing for sequential treatment of sections of a zone. Access to each portion can be with a sliding sleeve that has a specific internal profile. Pump down plugs can be used that have a specific profile that will make a plug latch to a specific sleeve. Pressure on the plug when latched allows a sequential opening of sleeves while zones already affected that are below are isolated. The pump down plugs have a passage that is initially obstructed by a material that eventually disappears under anticipated well conditions. As a result, when all portions of a zone are handled a flow path is reestablished through the various latched plugs. The plugs can also be blown clear of a sliding sleeve after operating it and can feature a key that subsequently prevents rotation of the plug on its axis in the event is later needs milling out.

U.S. Pat. No. 9,611,727 to Campbell, et al. teaches an apparatus and method for fracturing a well in a hydrocarbon bearing formation. The apparatus includes a valve subassembly assembled with sections of casing pipe to form a well casing for the well. The valve subassembly includes a sliding piston that is pinned in place to seal off ports that provide communication between the interior of the well casing and a production zone of the formation. A dart having a cup seal can be inserted into the well casing and propelled by pressurized fracturing fluid until the dart reaches the valve subassembly to plug off the well casing below the valve subassembly. The force of the fracturing fluid against the dart and cup seal thereof forces the piston downwards to shear off the pins and open the ports. The fracturing fluid can then exit the ports to fracture the production zone of the formation.

U.S. Pat. No. 9,739,117 to Campbell, et al. teaches a method and apparatus for selectively actuating a downhole tool in a tubular conduit. An actuator tool has an actuator mandrel having an actuator bore through and a bypass and a profile key to selectively engage the downhole tool. The downhole tool has one or more profile receivers adapted to actuate the downhole tool. The actuator tool is conveyed into the tubular conduit and the actuator tool and the downhole tool are engaged if the profile key and the profile receiver match, and the actuator tool and the downhole tool are non-engaged if the profile key and the profile receiver do not match. Fluid may be circulated through the actuator bore to flush or wash ahead of the actuator tool.

US Patent Publication No. 2003/0173089 to Westgard teaches a full bore selective location and orientation system including a nipple installable in a tubular string and having internal location and orientation features of known configuration and a locating device runnable within the tubular string and having location and orientation features engageable with said internal features of said nipple. A method of locating and orientating a downhole tool including installing a tubular nipple having a particular inside dimensions configuration in a tubular string running a locating device having a complementary outside dimensions configuration to engage with said inside dimensions configuration and rotating said locating device to a position where a biased member extends from said locating device into a recess in said tubular member.

US Patent Publication No. 2015/0226034 to Jani teaches an apparatus and related methods for selectively actuating sliding sleeves in sub members which are placed downhole in a wellbore, to open ports in such sub members to allow fracking of the wellbore, or to detonate explosive charges thereon for perforating a wellbore, or both. A simplified dart and sleeve is used which reduces machining operations on each. The dart is preferably provided with coupling means to permit a retrieval tool to be coupled thereto, which upon the retrieval tool being so coupled allows a bypass valve to operate to assist in withdrawing the dart from within the valve subs. Upward movement of the retrieval tool allows a wedge-shaped member to disengage the dart member from a corresponding sleeve to allow the dart to be withdrawn.

US Patent Publication No. 2014/0209306 to Hughes, et al. teaches a wellbore treatment tool for setting against a constraining wall in which the wellbore treatment tool is positionable. The wellbore treatment tool includes a tool body including a first end formed for connection to a tubular string and an opposite end; a no-go key assembly including a tubular housing and a no-go key, the tubular housing defining an inner bore extending along the length of the tubular housing and an outer facing surface carrying the no-go key, the no-go key configured for locking the no-go key and tubular housing in a fixed position relative to the constraining wall, the tubular housing sleeved over the tool body with the tool body installed in the inner bore of the tubular housing; and a sealing element encircling the tool body and positioned between a first compression ring on the tool body and a second compression ring on the tubular housing, the sealing element being expandable to form an annular seal about the tool body by compression between the first compression ring and the second compression ring.

US Patent Publication No. 2015/0218916 to Richards, et al. teaches circulating sleeves that can be opened and closed and permanently closed. A completion system includes a completion string having a circulating sleeve movably arranged therein, the circulating sleeve having a locking profile defined on an outer radial surface thereof and a shifting profile defined on an inner radial surface thereof, a service tool configured to be arranged at least partially within the completion string and including a shifting tool having one or more shifting keys configured to mate with the shifting profile. When the shifting keys locate and mate with the shifting profile, an axial load applied on the service tool axially moves the circulating sleeve, and a release shoulder assembly arranged within the completion string and comprising a release shoulder that defines a channel configured to receive a locking mechanism occluded within the channel until the release shoulder is moved axially.

Canadian Patent No. 2,412,072 to Fehr, et al. teaches a tubing string assembly for fluid treatment of a wellbore. The tubing string can be used for staged wellbore fluid treatment where a selected segment of the wellbore is treated, while other segments are sealed off. The tubing string can also be used where a ported tubing string is required to be run in in a pressure tight condition and later is needed to be in an open-port condition.

Alternative and/or improved designs which allow for consistent and reliable engagement and actuation of subsurface valves, as well as improved sealing, are always of extreme interest to the fracking industry.

SUMMARY

According to one aspect of this disclosure, there is provided a plurality of sliding valves. Each of the sliding valve comprises:

a valve body having a longitudinal bore therethrough and one or more fluid ports on an uphole portion of the sidewall thereof; and a sliding sleeve received in the longitudinal bore of the valve body and movable between an uphole closed position closing the one or more fluid ports and a downhole open position opening the one or more fluid ports, the sliding sleeve comprising a longitudinal bore;

wherein the sliding sleeve comprises a sleeve-profile formed at least by a first and a second sleeve-grooves and a sleeve-ridge therebetween, the first and second sleeve-grooves and the sleeve-ridge longitudinally distributed on an inner surface of the sliding sleeve; and wherein the longitudinal lengths $S_{g1}$, $S_{g2}$ and $S_r$ of the first and second sleeve-grooves and the sleeve-ridge, respectively, are determined by:

$$S_r=\delta L_a+nL_b,$$

$$S_{g1}=m_1L_b+(1-\delta)L_a,$$

$$S_{g2}=m_2L_b,$$

$$m_1+m_2=K,$$

where $L_a$, $L_b$ and $\delta$ are predetermined parameters with $L_a>0$, $L_b>0$ and $1\geq\delta\geq0$, n is an integer with $n\geq0$, K is a positive integer with $K>2$, $m_1$ and $m_2$ are integers with $m_1\geq1$, and $m_2>1$; and wherein the longitudinal length $L_s$ of the sleeve-profile is at least:

$$L_s=L_a+(n+K)L_b.$$

In some embodiments, the sliding valve further comprises a stop shoulder.

In some embodiments, the stop shoulder is downhole to the sleeve-profile.

In some embodiments, the stop shoulder is in the sleeve-profile.

In some embodiments, the stop shoulder is uphole to the sleeve-profile.

In some embodiments, $L_a=L_b$.

In some embodiments, $t_1=t_2=t$.

In some embodiments, $1>t>0$.

In some embodiments, t is about 0.5.

In some embodiments, $0.9>t\geq0.1$.

In some embodiments, $0.8>t\geq0.2$.

In some embodiments, $0.7>t\geq0.3$.

In some embodiments, $0.6>t\geq0.4$.

In some embodiments, $t=0$.

In some embodiments, $t=1$.

According to one aspect of this disclosure, there is provided a plurality of collets, each collet being movable through the bore of one or more first sliding sleeves and being receivable in a second sliding sleeve. Each collet comprises:

a resiliently flexible collet-profile formed by at least a first and a second collet-ridges and a collet-groove therebetween, the first and second collet-ridges and the collet-groove respectively corresponding to the first and second sleeve-grooves and the sleeve-ridge;

wherein the lengths $C_{r1}$, $C_{r2}$, and $C_g$ of the first and second collet-ridges and the collet-groove, respectively, are determined by:

$$C_{r1}=(m_1-t_1)L_b+(1-\delta)L_a-\varepsilon_2,$$

$$C_{r2}=(m_2-t_2)L_b,$$

$$C_g=\delta L_a+(n+t_2)L_b+\varepsilon_2,$$

$$m_1+m_2=K,$$

where $L_a$, $L_b$ and $\delta$ are predetermined parameters with $L_a>0$, $L_b>0$ and $1\geq\delta\geq0$, n is an integer with $n\geq0$, K is a positive integer with $K>2$, $m_1$ and $m_2$ are integers with $m_1\geq1$, and $m_2>1$, $t_1$, $t_2$, and $\varepsilon_2$ are predetermined parameters with $1\geq t_1\geq0$, $1\geq t_2\geq0$, and $\varepsilon_2\geq0$; and wherein the longitudinal length $L_c$ of the collet-profile is at least:

$$L_c=L_a+(n+K-t_2)L_b.$$

In some embodiments, at least one of the at least one collet-ridge is downhole to the stop shoulder, and has an obtuse angle formed between an upper edge of the on the downhole side thereof.

According to one aspect of this disclosure, there is provided a tubular string comprising a plurality of the above-described sliding valves with $1>t>0$;

wherein the sliding valves are arranged in the tubular string according to:

(a) for any two of the plurality of the sliding valves, at least one of the n, K, and $m_1$ thereof is different;

(b) the sliding valves with smaller (n+K) are uphole to those with larger (n+K);

(c) for sliding valves with a same (n+K), those with larger n are uphole to those with smaller n; and (d) sliding valves with a same n and a same K, but with different $m_1$ are arranged in any order.

According to one aspect of this disclosure, there is provided a tubular string comprising: a plurality of the above-described sliding valves with $t=1$;

wherein the sliding valves are arranged in the tubular string according to:

(a) for any two of the plurality of the sliding valves, at least one of the n, K, and $m_1$ thereof is different;

(b) for any two of the plurality of the sliding valves with a same n and a same K, the difference between the $m_1$ thereof is greater than 1;

(c) the sliding valves with smaller (n+K) are uphole to those with larger (n+K);

(d) for sliding valves with a same (n+K), those with larger n are uphole to those with smaller n; and (e) sliding valves with a same n and a same K but with different $m_1$ are arranged in any order.

In some embodiments, the tubular string is a casing string.

In some embodiments, the tubular string is a tubing string for receiving in a cased or uncased wellbore.

According to one aspect of this disclosure, there is provided a downhole system comprising: an above-described tubular string comprising a plurality of the above-described sliding valves with $1>t>0$; and one or more above-described collets.

BRIEF DESCRIPTION OF THE DRAWINGS

Further advantages and other embodiments of the invention will now appear from the above along with the following detailed description of the various particular embodiments of the invention, taken together with the accompanying drawings each of which are intended to be non-limiting, in which:

FIGS. 9 to 12A are cross-sectional views of a collet shown in FIG. 8 and a matching sliding valve shown in FIG. 1, illustrating a process of the collet entering the matching sliding valve and being lockingly engaged therewith;

FIG. 19 is a cross-sectional view of a collet, according to some alternative embodiments;

FIGS. 20A to 20D are schematic diagrams showing a plurality of sleeve-profiles and their corresponding collet-profiles, according to some alternative embodiments;

DETAILED DESCRIPTION

Figure 1:
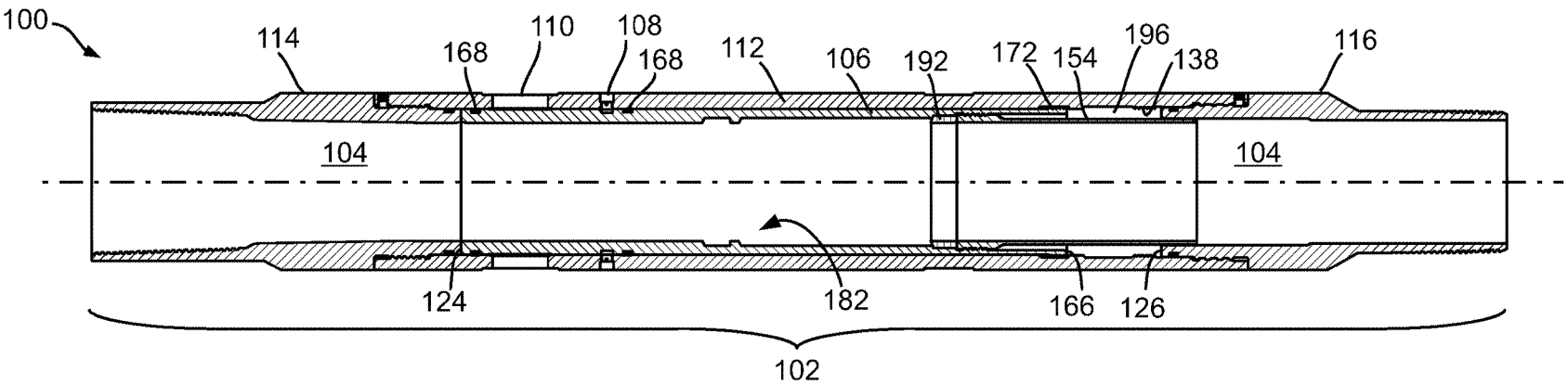
FIG. 1 is a cross-sectional view of a downhole tool in the form of a sliding valve comprising a valve body and a sliding sleeve movable therein, according to some embodiments of this disclosure, wherein the sliding sleeve is configured at a closed position, further showing a protective sleeve being employed.

Embodiments herein disclose a pressure-actuatable sliding valve. In the following description, the term "downhole" refers to a direction along a wellbore towards the end of the wellbore, and may (e.g., in a vertical wellbore) or may not (e.g., in a horizontal wellbore) coincide with a "downward" direction. The term "uphole" refers to a direction along a wellbore towards surface, and may (e.g., in a vertical wellbore) or may not (e.g., in a horizontal wellbore) coincide with an "upward" direction.

In some embodiments, the sliding valve comprises a valve body having a longitudinal bore and one or more fluid ports on the sidewall thereof. A sliding sleeve is received in the bore and is movable between an uphole closed position blocking the fluid ports and a downhole open position opening the fluid ports.

The sliding sleeve comprises a profiled area on the inner surface thereof comprising by circumferential grooves and ridges, forming a sleeve-profile. The profile area comprises a stop shoulder at a downhole end thereof for locking a collet member (also denoted as "a collet" for ease of description) having a matching collet-profile on the outer surface thereof. Herein, the term "matching" refers to the condition that the collet-profile of a collet matches the sleeve-profile of a sliding sleeve such that the profiled area of the collet can be received in the profiled area of the sliding sleeve for locking the collet in the sliding sleeve of the sliding valve.

In some embodiments, the uphole surface of the stop ring is sloped radially inwardly from downhole to uphole forming a stop shoulder 194 having an acute angle $\alpha$ with respect to a longitudinal axis of the stop ring.

In some embodiments, the stop shoulder is formed by a stop ring adjacent the profiled area of the sliding sleeve.

In some embodiments, the stop ring is made of a high-strength material such as tungsten carbide, cobalt-chromium alloys, and/or the like.

In some embodiments, the collet is in the form of a cage and comprises an uphole portion, a downhole portion, and a plurality of longitudinal splines mounted at their longitudinally opposite ends to the uphole and downhole portions. One or more or all of the longitudinal splines are flexible and are profiled to form the collet-profile.

In some embodiments, the uphole portion of the collet comprises a ball seat for receiving therein a ball from uphole to actuate the sliding valve.

In some embodiments, the collet comprises a metal uphole portion that is radially outwardly expandable such that, when the collet is received in a matching sliding valve and a ball seats on the ball seat of the collet, a fluid pressure applied on the ball may force the expandable uphole portion to radially outwardly expand and press against the inner surface of the sliding sleeve, thereby forming a metal-to-metal seal at the interface between the sliding sleeve and the collet.

In some embodiments, the ball seat of the collet comprises a sloped surface.

In some embodiments, the slope angle $\theta$ of the sloped ball seat surface is about 55° with respect to a longitudinal reference line. In some embodiments, the slope angle $\theta$ is about 35°. In some alternative embodiments, the slope angle $\theta$ is between about 50° and about 60°. In some alternative embodiments, the slope angle $\theta$ is between about 40° and about 70°. In some alternative embodiments, the slope angle $\theta$ is between about 30° and about 80°.

Turning to FIG. 1, a downhole tool is shown and is generally identified using reference numeral 100. In these embodiments, the downhole tool 100 is in the form of a downhole sliding valve and comprises a tubular valve body 102 having a longitudinal bore 104 and a sliding sleeve 106 received in the bore 104. The sliding sleeve 106 is locked by one or more shear pins 108 at an uphole, closed position for closing one or more fluid ports 110 on the tubular body 102, and comprises a longitudinal bore for receiving a matching collet (described later) therein. With a downhole-direction fluid pressure, the collet can actuate the sliding sleeve 106 from the closed position to a downhole, open position for opening the one or more fluid ports 110 for subterranean-formation fracking (described later).

Figure 2:
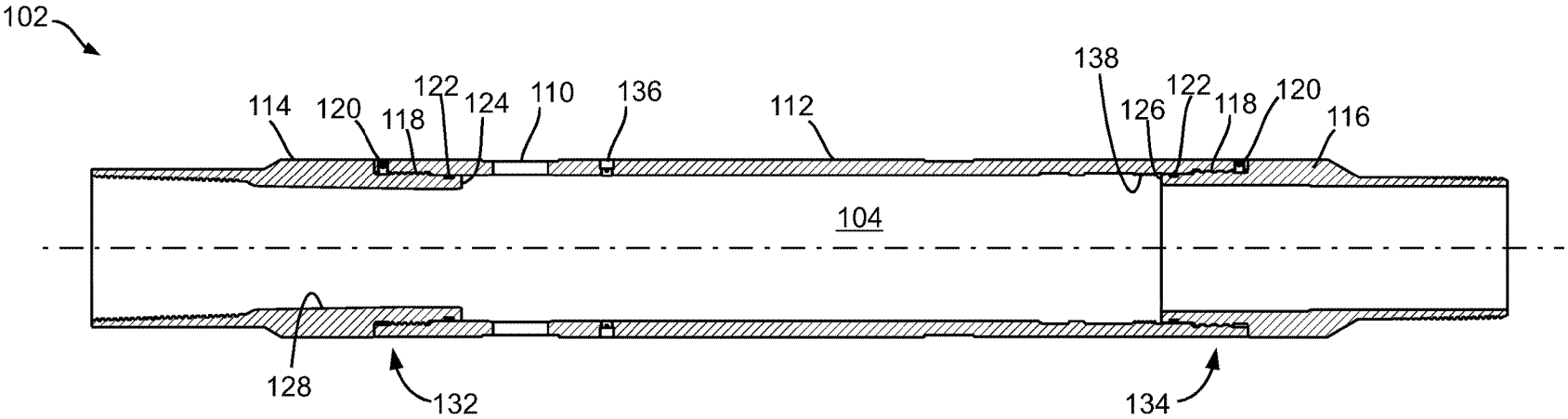
FIG. 2 is a cross-sectional view of a valve body of the downhole tool shown in FIG. 1, without the protective sleeve.

As shown in FIG. 2, the tubular body 102 comprises a tubular valve housing 112 releasably coupled to a top sub 114 and a bottom sub 116 uphole and downhole thereto, respectively, via threads 118 and a locking screw 120, and with a sealing ring 122 for sealing the coupling thereof. In these embodiments, the downhole end of the top sub 114 and the uphole end of the bottom sub 116 form uphole and downhole stoppers 124 and 126 for delimiting the sliding sleeve 106 movable therebetween.

In these embodiments, the top sub 114 comprises a tapered inner surface 128 tapering from an uphole end towards a downhole end thereof such that the inner diameter (ID) of the top sub 114 gradually reduces from the uphole end toward the downhole end thereof to facilitate the entrance of a collet into the sliding valve 100 (described later).

The valve housing 112 comprises one or more fluid ports 110 on the side wall thereof near an uphole end 132 for discharging high-pressure fracking fluid into a subterranean formation when the sliding sleeve 106 is shifted from the closed position to the opening position under an actuation pressure. The valve housing 112 also comprises one or more pinholes 136 for extending one or more shear pins 108 (see FIG. 1) therethrough for locking the sliding sleeve 106 at the closed position for closing the ports 110. The valve housing 112 further comprises one or more ratchet threads 138 on the inner surface near a downhole end 136 thereof.

Figure 3:
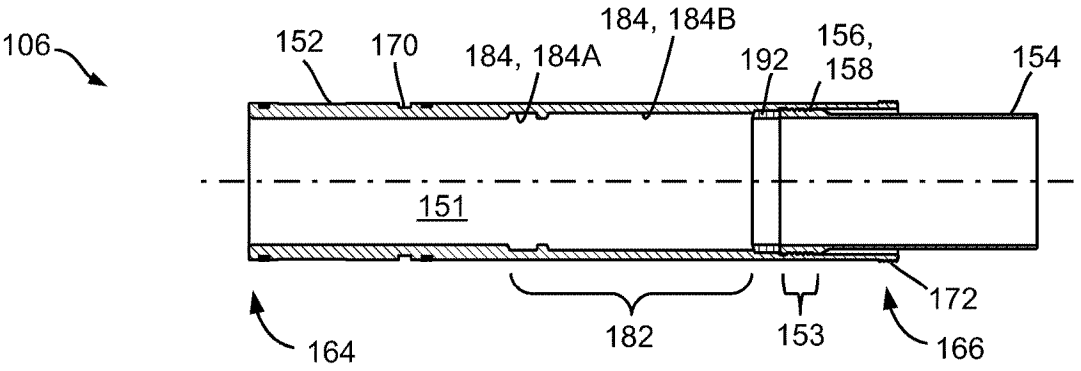
FIG. 3 is a cross-sectional view of a sliding sleeve of the downhole tool shown in FIG. 1, including depicting the additional protective sleeve.

FIG. 3 shows a cross-sectional view of the sliding sleeve 106 and sleeve body 152, having a bore 151. Sliding sleeve 106 has an outer diameter (OD) equal to or slightly smaller than the ID of the valve housing 112 for allowing the sliding sleeve 106 to be movable in the valve housing 112. In these embodiments, the sliding sleeve 106 comprises a sleeve body 152 receiving therein at least a coupling portion 153 of a protection sleeve 154 downhole thereof via threads 156 on the inner surface of the sleeve body 152 (see FIG. 4) and corresponding threads 158 on the outer surface of the protection sleeve 154 (see FIG. 5) for releasably coupling to the protection sleeve 154.

Figure 4:
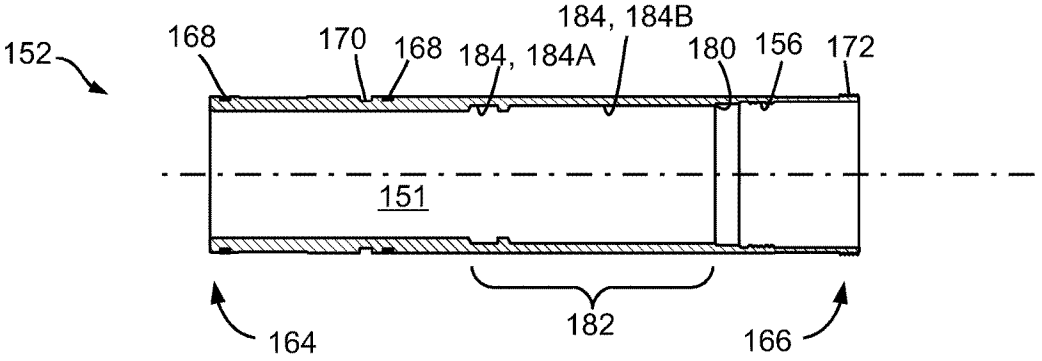
FIG. 4 is a cross-sectional view of a sleeve body of the sliding sleeve shown in FIG. 3.
Figure 5:
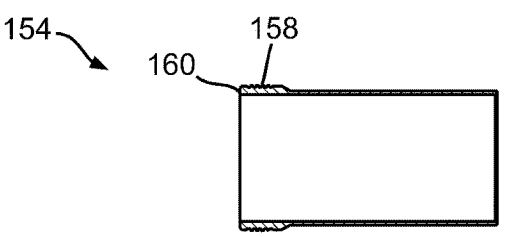
FIG. 5 is a cross-sectional view of a protection sleeve of the sliding sleeve shown in FIG. 3.

As shown in FIG. 4, the sleeve body 152 may comprise on the outer surface thereof, one or more circumferential sealing rings 168 at suitable locations as needed such as near an upper end 164 of the sleeve body 152 for sealing the interface between the valve housing 112 and the sliding sleeve 106 (see FIG. 1).

The sleeve body 152 also comprises one or more pinholes or recesses 170 at locations corresponding to those of the pinholes 136 of the valve housing 112 for receiving the shear pins 108 when the sliding sleeve 106 is installed in the bore 104 of the valve housing 112 at the closed position, and one or more ratchet rings 172 about a downhole end 166 thereof for engaging the ratchet threads 138 on the inner surface of the valve housing 112 when the sliding sleeve 106 is at the open position.

On its inner surface, the sleeve body 152 is made of a suitable material such as steel and comprises a downhole-facing stop-ring seat 180 uphole of the threads 156 and accessible from the downhole end 166 of the sleeve body 152 for receiving and supporting a high-strength stop ring 192, and a profiled area 182 uphole of and adjacent the stop-ring seat 180 (correspondingly, other inner-surface area of the sliding sleeve 106 is denoted as a non-profiled area).

The profiled area 182 on sleeve body 152 comprises one and preferably two or more circumferential grooves 184 such as grooves 184A and 184B forming a unique locking profile (also denoted as "a sleeve-profile"). Each groove 184 comprises an uphole wall sloped radially inwardly from downhole to uphole having an obtuse angle with respect to a longitudinal axis of the sleeve body 152. Each groove 184 also comprises a right-angle or acute-angle downhole wall. That is, the downhole wall of each groove 184 is either perpendicular to the longitudinal axis of the sleeve body 152, or sloped radially inwardly from downhole to uphole and forming an acute angle with respect to a longitudinal axis of sleeve body 152. With grooves 184, profiled area 182 can receive a collet 200 with a matched outer-surface profile 212 (herein "matched collet") and allow collets 200 with unmatched outer-surface profiles (herein "unmatched collets") to pass therethrough (described later).

Depending on the number of grooves 184, the ID of the profiled area 182 on sliding sleeve 106 may vary at different longitudinal locations thereof due to grooves 184 therein. However, the minimum ID of profiled area 182 including stop ring 192 is typically the minimum ID of sliding sleeve 106. In other words, minimum ID of sliding sleeve 106 occurs in the region of the profiled area 184 and stop ring 192.

The outer diameter of collet profile 212 on collet 200 is larger than the minimum ID of profiled area 182 on sleeve body 152 to allow initial minimum engagement, in the case of a matched collet, of collet profile 212 on such matched collet 200 with profiled area 182 on sleeve body 152, but under applied fluidic pressure applied to collet 200 the OD of profiled area 212 may then substantially exceed the minimum ID of profiled area 182 on sleeve body 152, to allow maximum engagement of profiled area 212 on collet 200 with profiled area 182, in the manner more fully described below.

Notably, the OD of collet 200 in the region of ball seat 214 thereon is initially less than the ID of both bore 151 and profiled area 184 on sleeve body 152. However, collet 200 is radially outwardly expandable in the region of ball seat 214 upon application of uphole fluidic pressure acting on a ball 242 when seated in ball seat 214 in the manner more fully described below to cause radial expansion thereof (i.e., an increase in the OD of collet 200 in the region of ball seat 214) to become very close to or equal to the inner diameter of bore 151 in sleeve body 152, to thereby provide the benefits and advantages more fully explained below.

The stop ring 192 is made of a material having a hardness greater than that of the material of the sliding sleeve 106. For example, the stop ring 192 is made of a high-strength material such as tungsten carbide, cobalt-chromium alloys (e.g., Stellite alloys), nitrided steels, and/or other suitable high-strength alloys, or a combination thereof, for providing enhanced pressure resistance and wear resistance.

In some embodiments, at least a stop shoulder 194 of the stop ring 192 (described in more detail later) is hardened to a hardness greater than that of the material of the sliding sleeve 106 or comprises a material having a hardness greater than the hardness of sliding sleeve 106.

Figure 6:
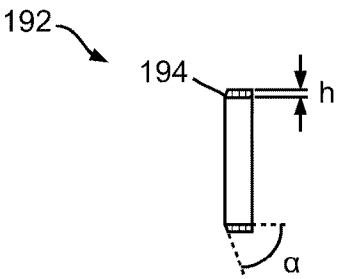
FIG. 6 is a cross-sectional view of a stop ring of the sliding sleeve shown in FIG. 3.

FIG. 6 shows a cross-sectional view of a high-strength stop ring 192. The stop ring 192 has an OD suitable for seating against the stop-ring seat 180 of the sleeve body 152 and has a cross-sectional height 'h' sufficient for extending radially inwardly beyond the inner edge of the stop-ring seat 180. In these embodiments, the uphole surface of the stop ring 192 is sloped radially inwardly from downhole to uphole forming, on an uphole side edge thereof, a stop shoulder 194 having an acute angle $\alpha$ with respect to a longitudinal axis of the sliding valve 100. As will be described in more detail later, the stop shoulder 194 of the stop ring 192 is adapted to abut a portion of the collet-profile and engage a corresponding shoulder of a collet when the collet-profile engages the sleeve-profile 182 and prevents downhole motion of the collet member 200 relative to the sliding sleeve. Therefore, the stop ring 192 may also be called a "locking ring" for downwardly locking the collet.

Figure 7:
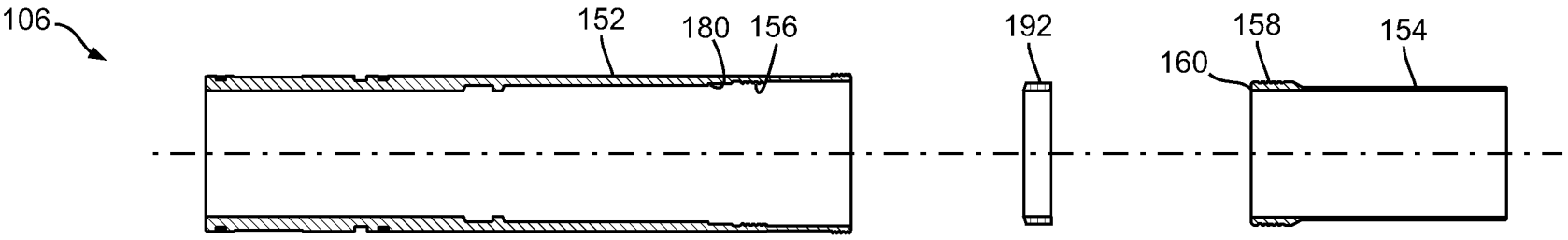
FIG. 7 is an exploded cross-sectional view of the sliding sleeve shown in FIG. 3, illustrating a process for assembling the sliding sleeve.

As shown in FIG. 7, the sliding sleeve 106 may be assembled by inserting the stop ring 192 into the sleeve body 152 to seat against the stop-ring seat 180. Then, the protection sleeve 154 is "screwed" to the downhole end of the sleeve body 152 by engaging the threads 158 of the protection sleeve 154 with the threads 156 of the sleeve body 152. The uphole end 160 of the protection sleeve 154 presses the stop ring 192 against the stop-ring seat 180 to firmly sandwich the stop ring 192 in position. The assembled sliding sleeve 106 is shown in FIG. 3.

Then, the sliding valve 100 may be assembled by inserting the sliding sleeve 106 into the bore 104 of a valve housing 112 from either end thereof to the closed position, locking the sliding sleeve 106 in position by extending a shear pin or shear screw 108 through the pinhole 136 of the valve housing 112 into the pinhole 170 of the sleeve housing 152, and then coupling the valve housing 112 with the top sub 114 and the bottom sub 116. The assembled sliding valve 100 is shown in FIG. 1.

As shown in FIG. 1, the sliding sleeve 106 has a longitudinal length longer than the distance between the stoppers 124 and 126 of the valve housing 112 such that, when the sliding sleeve 106 is at the closed position, the protection sleeve 154 is in contact with the inner surface of the bottom sub 116 to isolate the annulus 196, which is radially between the valve housing 112 and sliding sleeve 106 and longitudinally between the downhole end 166 of the sliding sleeve 106 and the stop shoulder 126, from the bore 104 for preventing cement from entering the annulus 196 and interfering with valve operation.

As described above, the sliding valve 100 comprises a profiled inner surface area 182 having a unique locking profile that can receive and lock a matched collet and allow an unmatched collet to pass therethrough.

Figure 8:
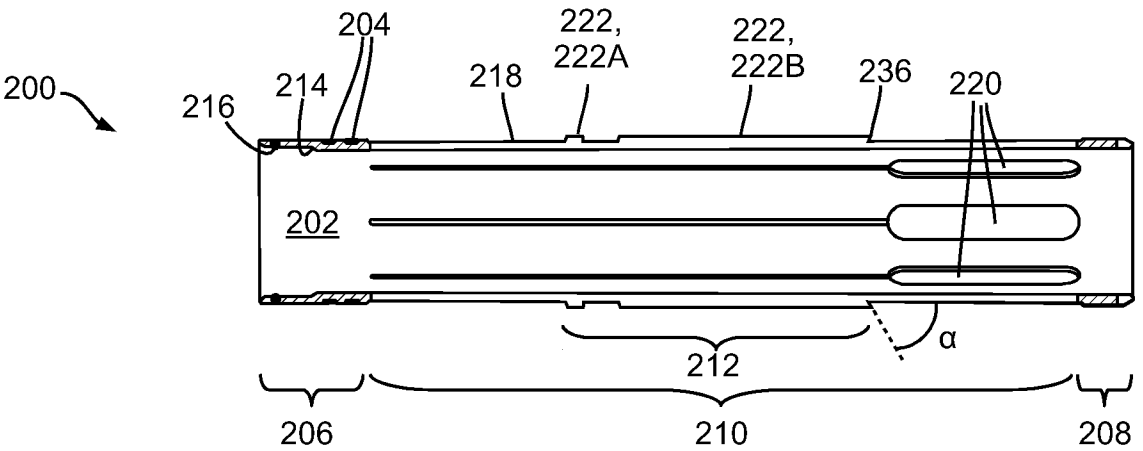
FIG. 8 is a cross-sectional view of a collet for actuating a matching sliding valve shown in FIG. 1.

FIG. 8 is a cross-sectional view of a collet 200 which in these embodiments is in the form of a cylindrical cage having a longitudinal bore 202. The collet 200 generally has an OD (except at the protrusions 222, described later) slightly smaller than the minimum ID of the sliding sleeve 106, and comprises one or more circumferential sealing rings 204 on the outer surface thereof at necessary locations as needed for sealing the interface between the collet 200 and the sliding sleeve 106 when the collet 200 is locked in the sliding sleeve 106.

As shown, the collet 200 comprises a cylindrical uphole portion 206, a cylindrical downhole portion 208, and a middle portion 210 comprising a profiled area 212 having a unique locking profile.

In these embodiments, the uphole portion 206 comprises a ball seat 214 on an inner surface thereof for receiving a ball dropped from uphole. The uphole portion 206 also comprises a sealing ring 216 on its inner surface for sealing the interface between the ball and the uphole portion 206 of the collet 200.

The middle portion 210 comprises a plurality of circumferentially-distributed longitudinal splines 218 coupled to the uphole and downhole portions 206 and 208. In these embodiments, the collet 200 is made from a metal tubular by cutting, punching or otherwise forming a plurality of longitudinal slots 220 in the middle portion 210 to form the splines 218.

One or more or all of the longitudinal splines 218 are made of a resiliently flexible material with sufficient elasticity and are profiled to each comprise one or more protrusions 222 such as the protrusions 222A and 222B in the profiled area 212 extending radially outwardly from the outer surface thereof, forming a radially flexible locking profile (also denoted as "a collet-profile"). The positions and sizes of the protrusions 216 are selected such that the maximum OD of the collet 200 is greater than the minimum ID of the sliding sleeve 106, and the collet-profile thereof matches the sleeve-profile of a matched sliding sleeve 106. Therefore, when the collet 200 enters a sliding valve 100 having a matched sliding sleeve 106 (such as sliding valve 100 also denoted as "a matched sliding valve 100"), the collet 200 may be locked in the matched sliding sleeve 106. The downhole-most protrusion 222B comprises a shoulder 236 at a downhole side thereof having the same acute angle $\alpha$ with respect to a longitudinal axis of the sliding valve 100 as that of the stop shoulder 194.

Figure 9:
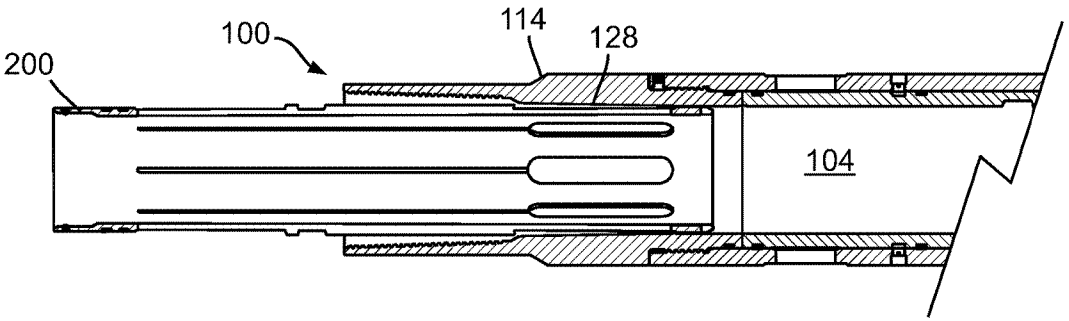

FIGS. 9 to 12 show an example of actuating a collet 200 into a matched sliding valve 100 from uphole thereof. As shown in FIG. 9, when the collet 200 enters the sliding valve 100, the tapered inner surface 128 of the top sub 114 guides the collet 200 to enter the bore 104.

Figure 10:
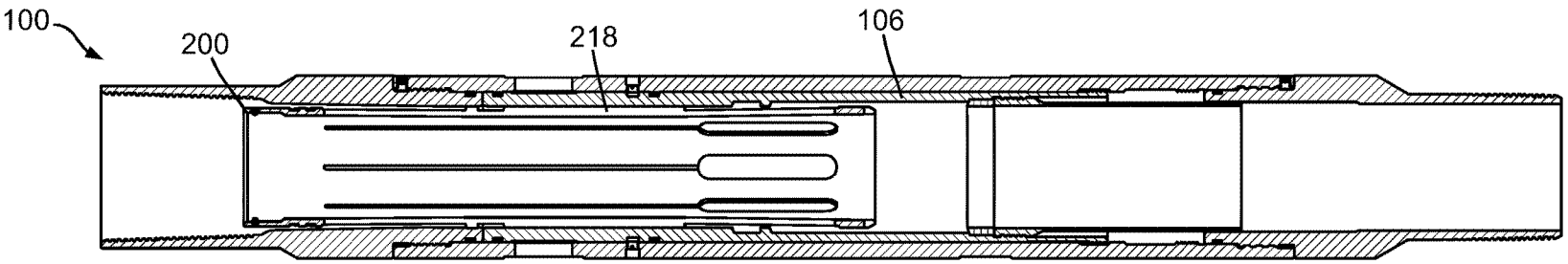

As shown in FIG. 10, when the profiled area of the collet 200 enters the bore 104, and as the maximum OD of the collet 200 is greater than the minimum ID of the sliding sleeve 106, the profiled splines 218 are biased inwardly and the collet 200 continues to move downhole.

Figure 11:
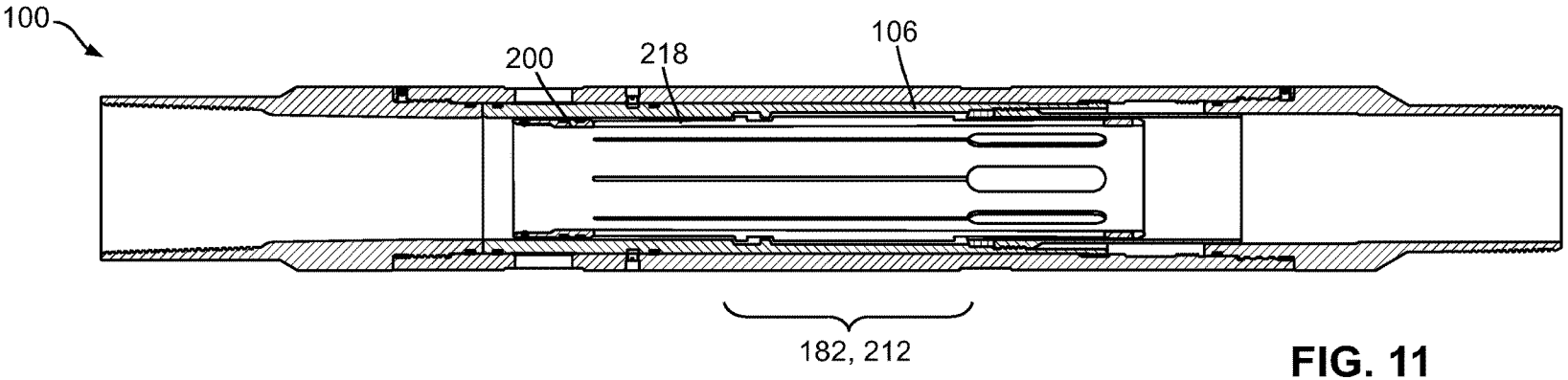
Figure 12A:
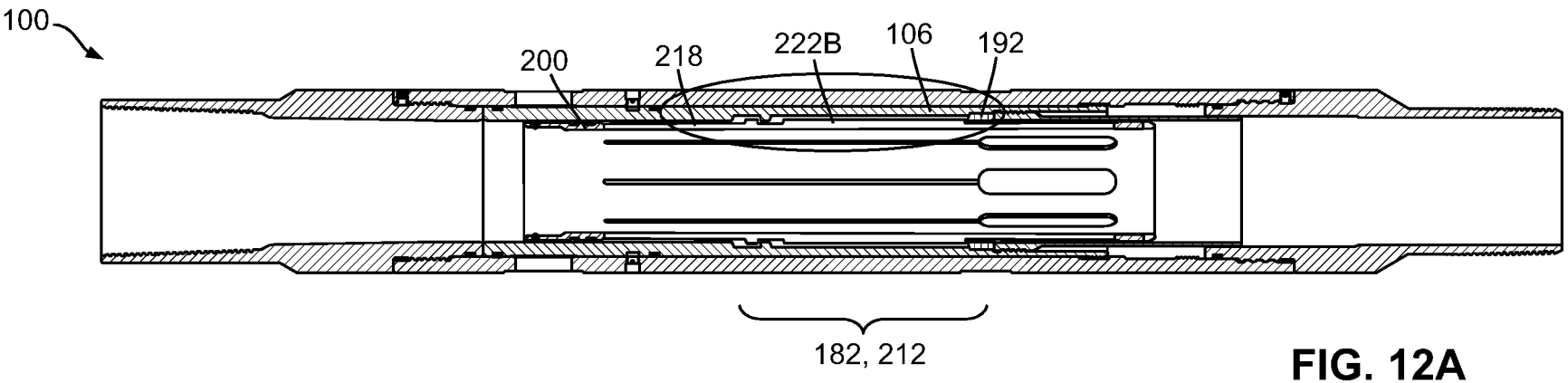
Figure 12B:
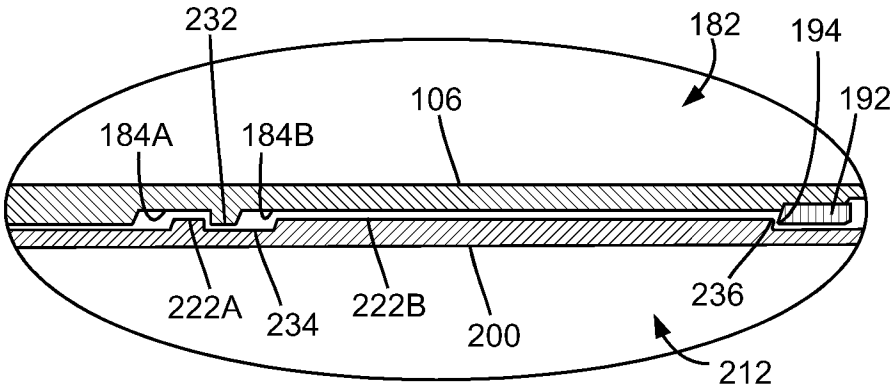
FIG. 12B is an enlarged cross-sectional view of a portion of FIG. 12A, showing the profiled areas of the collet and the matching sliding valve when the collet is lockingly engaged in the matching sliding sleeve.

As shown in FIG. 11, when the profiled area 212 of the collet 200 fully overlaps the matched profile area 182 of the sliding sleeve 106, the profiled splines 218 are then unbiased due to their elasticity. The collet 200 is thus downwardly received in the sliding sleeve 106. As shown in FIGS. 12A and 12B, the collet 200 may further move downhole until the shoulder 236 of the downhole-most protrusion 222B engages the stop shoulder 194 of the high-strength stop ring 192.

FIG. 12B shows an enlarged view of the profiled areas 182 and 212 of the sliding sleeve 106 and the collet 200. As shown, the profile of each profiled area 182, 212 comprises interleaved grooves and ridges (or protrusions). In the example shown in FIG. 12B, the profile of the profiled area 182 comprises two grooves 184A and 184B, and a ridge 232 therebetween. The profile of the profiled area 212 comprises two ridges/protrusions 222A and 222B, and a groove 234 therebetween. To ensure the profiled areas 182 and 212 match each other, the width of a groove on either of the two profiled areas 182 and 212 needs to be equal to or larger than that of the corresponding ridge on the other of the two profiled areas 182 and 212 for receiving the corresponding ridge therein. In the example shown in FIG. 12B, the width of a groove (e.g., groove 184A, 184B, or 234) is sufficiently larger than that of the corresponding ridge (e.g., ridge 222A, 232, or 222B) such that, after the collet 200 is downwardly locked in the sliding sleeve 106, the collet 200 may further move towards downhole until the downhole-most protrusion 222B engages the high-strength stop ring 192.

As shown in FIG. 12B, a high-strength stop ring 192 is used for engaging the downhole-most protrusion/ridge 222B for enhancing the downhole-locking between the sliding sleeve 106 and the collet 200 under high pressure. Moreover, the stop ring 192 is shaped to have an uphole stop shoulder 194 having an acute angle with respect to a longitudinal axis of the sliding valve 100, and the downhole side of the downhole-most protrusion 222B also form a shoulder 236 with a matching acute angle such that the engagement of the shoulders 194 and 236 provides enhanced strength against downhole pressure applied to the collet 200. In these embodiments, when the shoulders 194 and 236 are engaged with each other, other corresponding ridges of the collet 200 and sliding sleeve 106 such as ridges 222A and 232 are also engaged for further enhancing the strength against downhole pressure applied to the collet 200.

Figure 13:
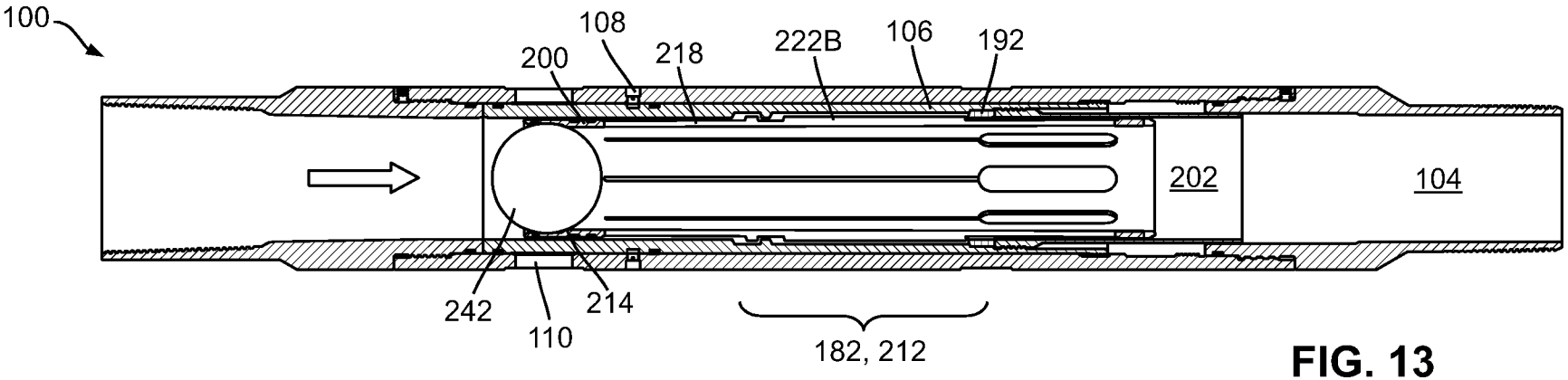
FIG. 13 is a schematic cross-sectional view showing a collet shown in FIG. 8 locked in a matching sliding valve shown in FIG. 1, and a ball dropped into the sliding valve for actuating the sliding valve to an open position.

As shown in FIG. 13, after the collet 200 is locked in the sliding sleeve 106, a ball 242 may be dropped from surface and enters the sliding valve 100. The ball 242 is made of a rigid material such as ceramic or metal, and has a size suitable for seating on the ball seat 214 of the collet 200.

Figure 14:
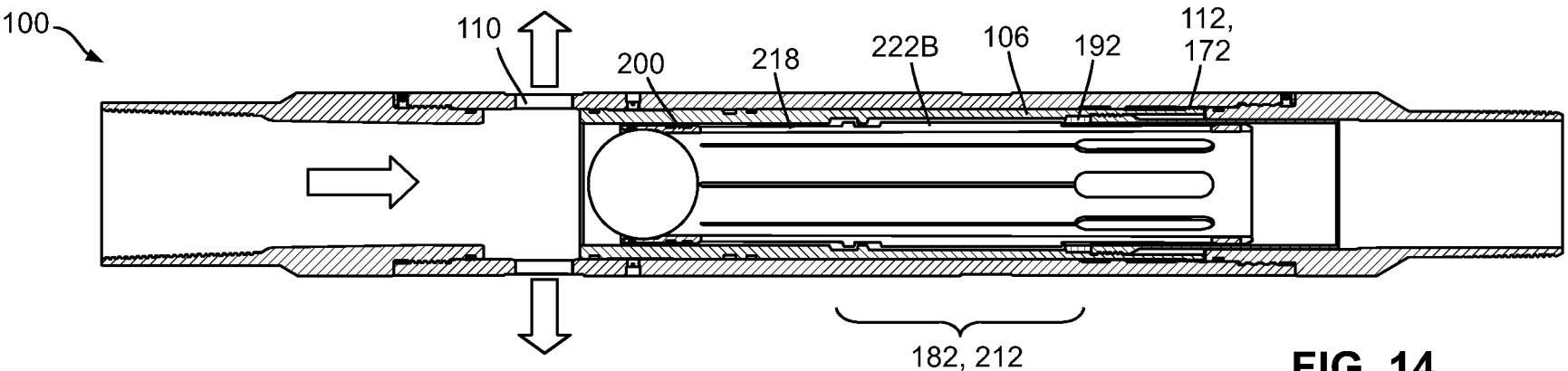
FIG. 14 is a schematic cross-sectional view showing the sliding sleeve of the sliding valve shown in FIG. 13 being pressure-actuated by the ball and the collet to the open position to open fluid ports for fracking.

After the ball 242 engages the ball seat 214 and sealably blocks the bore 202 of the collet 200, a fluid pressure is applied from uphole to the ball 214 and the collet 200. As the collet 200 is downwardly locked to the sliding sleeve 106, the sliding sleeve 106 is then actuated to shear the shear pin 108 and move downhole to the open position to open the fluid ports 110. As shown in FIG. 14, the ratchet rings 172 on the on sliding sleeve 106 engage the ratchet threads 138 on the valve housing 112 for preventing the sliding sleeve 106 from moving uphole. Then, high-pressure fracking fluid may be pumped downhole and jet out from the fluid ports 110 for fracking the formation.

The fracking fluid is generally of high pressure, and any failure in the sliding valve 100 may cause the fracking process to fail. For example, if the engagement between the collet 200 and the sliding sleeve 106 fails, the high-pressure fracking fluid may actuate the collet 200 further downhole, thereby causing the fracking process to fail.

As those skilled in the art will appreciate, the sliding valve 100 in above embodiments comprises a high-strength stop ring 192 for reinforcing the engagement between the collet 200 and the sliding sleeve 106, thereby significantly reducing the risk of failure.

Figure 15A:
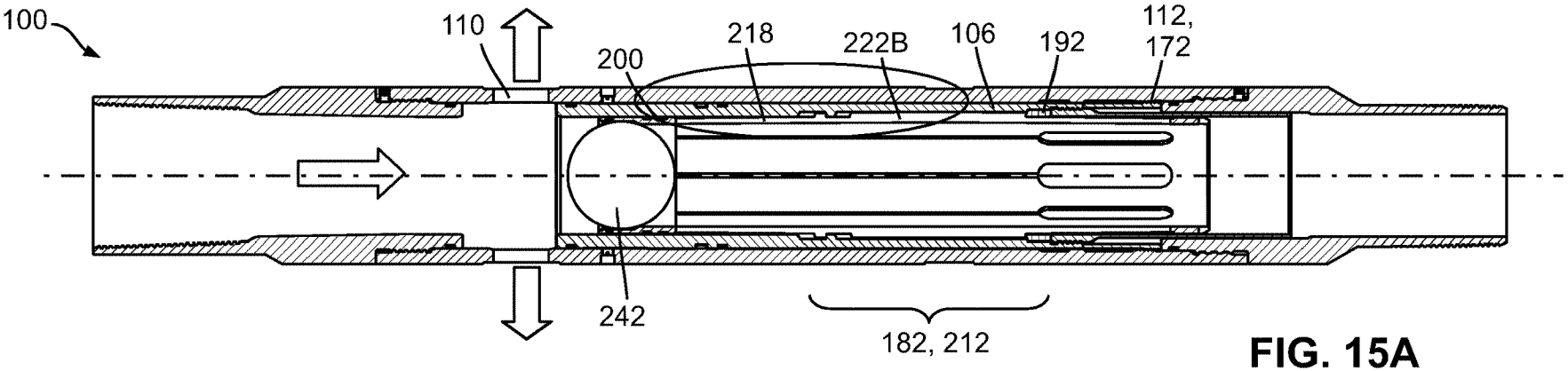
FIG. 15A is a schematic cross-sectional view showing the sliding sleeve of the sliding valve being pressure-actuated by the ball and the collet to the open position to open fluid ports for fracking, according to an alternative embodiment, wherein the splines of the collet are capable of being pressure-actuated to radially outwardly expand when uphole fluidic pressure is applied and a compression of the collet results causing the splines to radially expand outwardly so as to further engage the sliding sleeve for enhanced engagement and thus further pressure resistance.
Figure 15B:
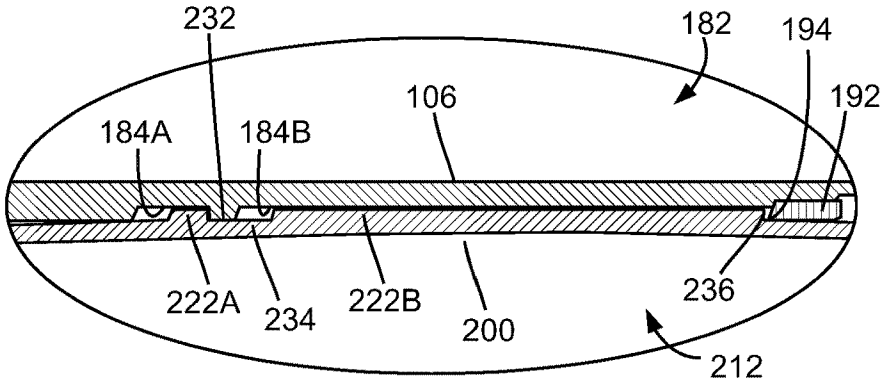
FIG. 15B is an enlarged cross-sectional view of a portion of FIG. 15A, showing the radially outwardly expanded collet engaging the sliding sleeve.

In some embodiments, the OD of the collet 200 at the protrusions 222A and 222B thereof is smaller than the ID of the sliding sleeve 106 at the grooves 184A and 184B thereof. As shown in FIGS. 15A and 15B, in these embodiments, after the high-pressure fracking fluid is pumped downhole and actuates the sliding sleeve 106 to the open position, the high-pressure fracking fluid further actuates the collet 200 slightly downhole such that the splines 218 are forced to radially outwardly expand such that the protrusions 222A and 222B of the collet 200 further engage the grooves 184A and 184B of the sliding sleeve 106, thereby providing enhanced pressure resistance.

Figure 16:
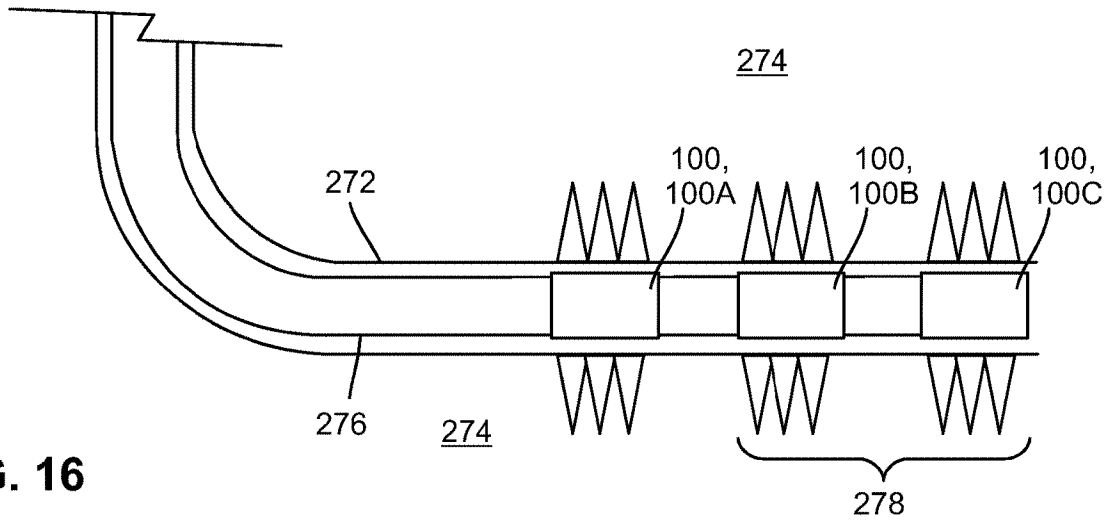
FIG. 16 is a schematic diagram showing a casing string having a plurality of sliding valves shown in FIG. 1 extended into a wellbore for fracking a subterranean formation, according to some embodiments of this disclosure.

In some embodiments, a downhole fracking system comprising a plurality of sliding valves 100 may be used for subterranean formation fracking. FIG. 16 illustrates an example of fracking a subterranean formation using the sliding valve 100. In this example, a horizontal well is drilled which comprises a horizontal wellbore portion 272 in the subterranean formation 274. A casing string 276 comprising a plurality of sliding valves 100 is then extended into the wellbore portion 272. Each sliding sleeve 100 comprises a unique sleeve-profile. The sliding valves 100 may be spaced by other subs as needed.

After the casing string 276 is in place, cementing may be conducted by pumping cement fluid downhole through the casing string 276. As described above and referring to FIG. 1, in each sliding valve 100, the protection sleeve 154 prevents cement from entering the annulus 196 and interfering with valve operation. After cementing, cleaning fluid may be pumped downhole for cleaning the subs including the sliding valves 100. Wiper darts may also be used for cleaning as needed.

In this example, the formation 274 about a wellbore section 278 is to be fractured and the sliding valves 100B and 100C need to open. Therefore, a first collet (not shown) matching the sliding valve 100C is pumped downhole through the casing string 276. As the first collet does not match the sliding valves 100A and 100B (i.e., the collet-profile of the first collet does not match and cannot be received in the sleeve-profile of the sliding valves 100A and 100B), the first collet passes through sliding sleeves 100A and 100B, and is locked in the sliding valve 100C.

To open the fluid ports of the sliding valve 100C, a ball is dropped and engages the ball seat of the first collet and blocks the bore of the first collet. Then, a fluid pressure is applied to actuate the engaged ball, first collet and sliding sleeve to shear the shear pin of the sliding valve 100C and move the sliding sleeve downhole to the open position to open the fluid portions of sliding sleeve 100C.

After the sliding valve 100C is open, a second collet matching the sliding valve 100B is pumped downhole to lock to the sliding valve 100B. Then, a ball is dropped to engage the second collet, and a fluid pressure is applied to open the sliding valve 100B.

After all sliding valves 100B and 100C in the wellbore section 278 are opened, the balls in these sliding valves, except that in the downhole-most sliding valve, are removed by for example, drilling, dissolving, retrieving to the surface, and/or the like. In the example shown in FIG. 16, the ball in sliding valve 100C is maintained and the ball in sliding valve 100B is removed. Then, high-pressure fracking fluid is pumped into the casing string 276 and jets out from the fluid ports of the sliding valves 100B and 100C for fracking the formation 274.

In above example, wellbore isolation devices such as packers may be used for isolating the wellbore section to be fractured, which is known in the art and is therefore omitted herein.

As can be seen from above examples, a fracking process can use a plurality of sliding sleeves 100 having generally same size bores 104, thereby ensuring uniform fluid flow throughput. The collet 200 and the balls 242 may also have a same size, thereby simplifies the logistics and reduces the cost of well completion.

In above embodiments as shown in FIGS. 3 to 7, the protection sleeve 154 is releasably coupled to the sleeve body 152 via engaging threads 158 and 156. In some alternative embodiments, the protection sleeve 154 may be coupled to the sleeve body 152 via other suitable means. For example, in one embodiments, the protection sleeve 154 may be permanently coupled to the sleeve body 152 via welding.

In above embodiments, the collet 200 is in the form of a cylindrical cage having a plurality of splines mounted on a cylindrical uphole portion 206 and a cylindrical downhole portion 208, thereby omitting the use of external means such as springs to radially actuate or morph the collet 200 to engage the sliding sleeve and lock therein. In a particular further embodiment, the mounting of the flexible splines at the longitudinally opposite ends thereof to the uphole and downhole portions 206 and 208, and further configuring the collet so that said splines upon initial engagement within an interior profile 184 in sliding sleeve 106, upon the application of fluidic pressure uphole to a ball situated in ball seat 214 of collet 200, advantageously allows further radial bowing of the splines on collet 200 which thereby causes further and more extensive engagement of the splines having collet profile 212 within profile 184 of sliding sleeve 184, thereby reducing the risk of non-engagement of collet 200 with selected sleeve or alternatively reduced the risk of possible disengagement of mating profile on collet 200 with mating profile 184 on sliding sleeve 106 upon fracking pressure being applied uphole, which in the instance of failure would prevent the well from having frac fluid injected under high pressure at the opened port 110.

In some alternative embodiments, a downhole fracking system comprising a tubing string having one or more sliding valves 100 may be used for fracking a wellbore section. The wellbore may be a cased wellbore or uncased wellbore.

Although in the example shown in FIG. 16, the sliding valves 100 are used for fracking a horizontal wellbore section, those skilled in the art will appreciate that, in some alternative embodiments, the sliding valves 100 may be used for fracking a vertical wellbore section.

In above embodiments, the collet 200 may comprise one or more sealing rings 204 on the outer surface thereof for sealing the interface between the collet 200 and the sliding sleeve 106 when the collet 200 enters the sliding valve 100. However, such sealing rings 204 typically during the course of the collet downhole may be worn out and become ineffective when the collet 200 moves in the sliding sleeve 106, thereby causing the sliding valve 100 to fail. Moreover, when pumping a collet through unmatched sliding sleeves, a large fluid pressure is usually required to overcome the friction caused by the sealing rings 204 moving along the inner surface of the sliding sleeve 106.

In some alternative embodiments, the collet 200 need not comprise any sealing rings 204 on its outer surface. In these embodiments, the sliding valve 100 is the same as that shown in FIG. 1, and the non-profiled area of the collet 200 has an OD slightly smaller than the minimum ID of the sliding sleeve 106, thereby avoiding the friction otherwise caused by the sealing rings 204 and thus allowing the collet 200 to pass through unmatched sliding valve 100 under a smaller fluid pressure.

Figure 17B:
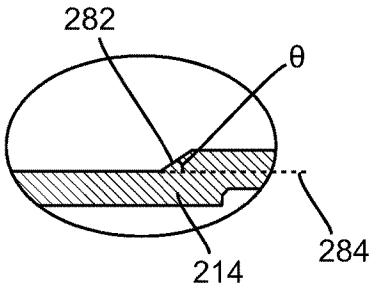
FIG. 17B is an enlarged cross-sectional view of a portion of FIG. 17A, showing the ball seat of the collet.
Figure 17A:
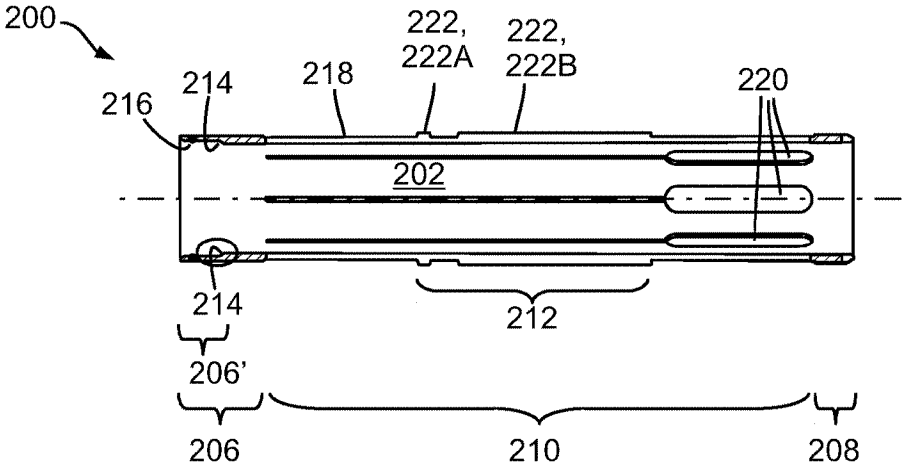
FIG. 17A is a cross-sectional view of a collet, according to some alternative embodiments.

In these embodiments, the sliding sleeve is made of a suitable metal such as steel. As shown in FIGS. 17A and 17B, the uphole portion 206 of the collet 200 is configured so as to have a radially outwardly expandable metal portion 206', and the ball seat 214 comprises a ball-seat surface 282 radially inwardly sloped from uphole to downhole at an acute slope angle with respect to a longitudinal axis 284 of the collet 200.

After the collet 200 is locked in a sliding valve 100, a ball 242 of a suitable size is urged by a downhole fluid pressure onto the ball seat 214. The ball 242, when fluid downhole pressure is applied to the uphole side of the ball 242, then presses against sloped surface 282 of the ball seat 214 to transfer the downhole fluid pressure into a radially outward pressure and radially expand the expandable metal portion 206' of the collet 200 to sufficiently reduce the clearance between the collet 200 and the sliding sleeve 106 or even forcing the outer surface of the expandable metal portion 206' to tightly engage the inner surface of the sliding sleeve 106, thereby forming a metal-to-metal seal at the interface between the collet 200 and the sliding sleeve 106.

As shown in FIG. 17B, the surface 282 of the ball seat 214 is sloped at a slope angle θ with respect to a longitudinal reference direction 284. In some embodiments, the slope angle θ is about 55°. A slope angle of about 55° is a satisfactory angle to transmit required radial outward force on collet 200 to achieve sufficient radial expansion of collet 200 to form an adequate metal-metal seal with the sliding sleeve 106, for a metallic collet of a modulus of elasticity of that of American Petroleum Institute (API) Grade N80 steel where the nominal diameter of ball seat 214 on collet 200 is 4.555 inches with a nominal collet thickness of 0.23 inches and a pressure on the ball 242 of nominal diameter of 4.250 inches being approximately 1500 psi, and where collet 200 initially, prior to radial expansion, has a clearance in the range of 0.004 to 0.014 inches with the inner diameter of sliding sleeve 106 (ref. Example A, below and FIG. 18).

In other embodiments where the collet 200 may be of a stronger or less elastic material (i.e., having a higher modulus of elasticity), and/or of a greater thickness, and/or where there is an initial clearance between the collet diameter 200 and the sliding sleeve diameter 106 of greater than 0.004 to 0.014 inches, and/or where pressure on the ball 242 is less than 1500 psi, the slope angle θ will need to be reduced to about 35° in order for ball seat 214 to then be able to transmit sufficient radial outward force to achieve sufficient radial growth of collet diameter 200 to thereby achieve the desired metal-metal seal with bore.

In some alternative embodiments, the slope angle θ is between about 50° and about 60°. In some alternative embodiments, the slope angle θ is between about 40° and about 70°. In some alternative embodiments, the slope angle θ is between about 30° and about 80°.

Accordingly, therefore, where collet 200 is configured in the manner to permit radial growth, such advantageously permits collet 200 to be reduced in overall outer diameter. Such reduced diameter, not only in the region of the ball seat 214 but also in the collet profile region 212, thereby permits collet 200 and profile-region 212 to more easily pass with less interference with, profile regions 184 of various uphole sliding sleeves 106 which are not desired to be actuated, thereby reducing frictional wear on such profiled area 212 of collet 200 but nevertheless still maintaining the ability of collet 200 to ultimately in the region of ball seat 214 to create a seal when collet 200 has reached and further for collet profile region 212 thereon to engage the intended downhole sleeve 106 and corresponding desired mating profile 184 thereon.

Specifically and importantly, by employing such radially expanding capability for the collet 200 reduced wear on collet profiles 212 thereon occurs, thereby maintaining the integrity of collet profiles 212 and ensuring when collet 200 reaches the desired sliding sleeve 106 desired to be actuated that respective profile 212 thereon is then able to sufficiently and reliably engage while simultaneously creating an initial metal-metal seal to allow pressure to build on the uphole side of ball 242. Increased pressure on the uphole side of ball 242 once collet 200 is lockingly engaged with sliding sleeve 106, then in turn causes a "domino" effect whereby such build-up of pressure causes (further) radial expansion of collet 200 which in turn causes increased metal-metal seal which then allows further build-up of pressure which again causes increased radial expansion and thus further metal-metal seal. Uphole pressure will continue to build in such manner to such an extend so as to cause shear pins 108 retaining sliding sleeve 106 in place to shear and then allow sliding sleeve 106 to move downhole in valve 100 to thereby open ports 110.

Figure 18:
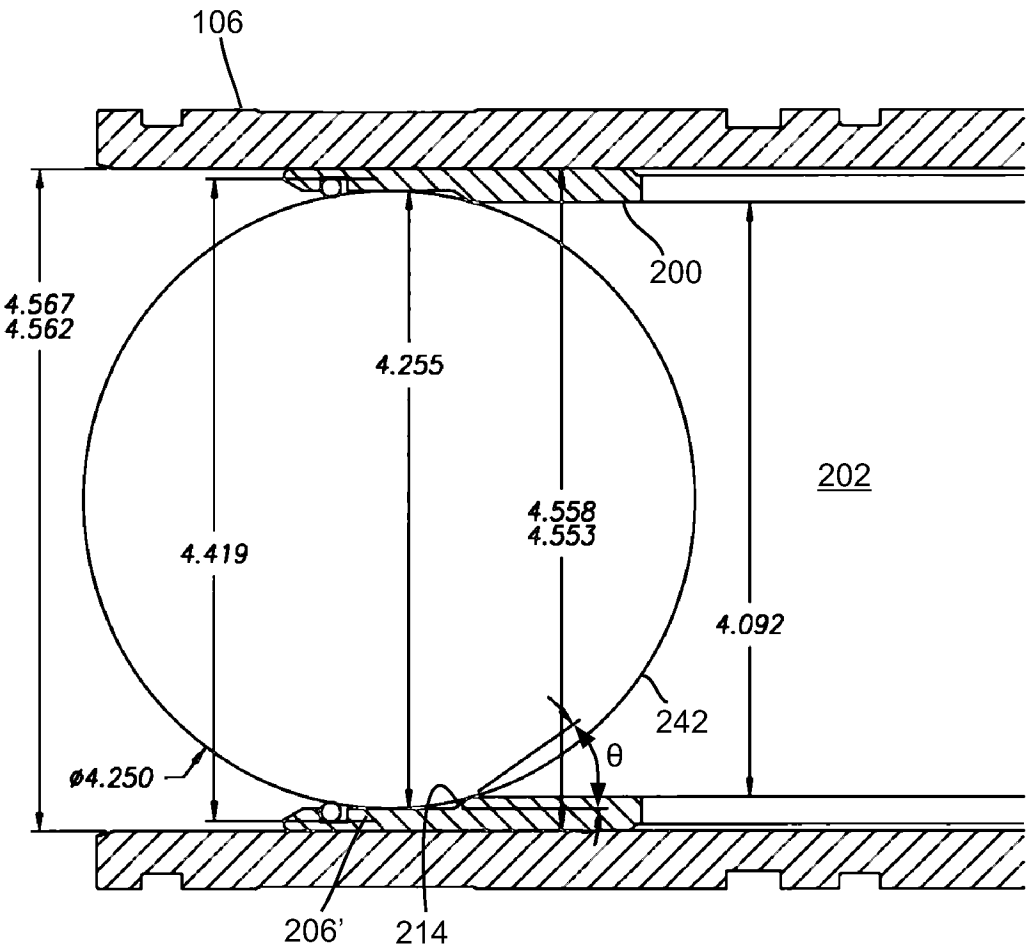
FIG. 18 shows, in cross-section, a particular example of a collet shown in FIG. 17A received in a sliding sleeve shown in FIG. 3, and a ball received in the collet which is configured for radially outward expansion in an expandable metal portion of the collet for forming a metal-to-metal seal between the collet and the sliding sleeve upon a ball being seated on a ball seat of the collet and an uphole fluidic pressure being applied to the ball.

FIG. 18 shows an example of a collet 200 of the present invention slidably received in a sliding sleeve 106, which collet 200 is of the above preferred embodiment. Specifically, in such preferred embodiment collet 200 in the region of ball seat 214 is of a thickness and of a material and of an initial radial clearance with bore 151 of sleeve body 152 such that when ball 242 is seated in ball seat 214 and fluidic pressure of at least 150 psi is applied thereto, radial outward expansion of the outer diameter thereof occurs in of an amount greater than 0.09% to then provide sufficient metal-metal seal between the outer diameter of the collet 200 in the region of ball seat 214 and bore 151 of sleeve body 152. Specifically, the outer diameter of collet 200 in the region of the ball seat 214 is capable of radially expanding outwardly upon application of fluidic pressure to ball 242 seated therein, preferably to an amount of at least 0.09% radial expansion, and preferably to an amount at least 0.2% radial expansion, and more preferably to an amount at least 0.3% radial expansion, upon application of fluid pressure uphole of at least 150 psi, to thereby allow better initial clearance of profiled area 212 on collet 200 with unmatched profiles but upon engagement with desired profiled area 184 on a selected sliding sleeve 106, allow sufficient sealing between collet 200 in the region of ball seat 214 to allow a "domino" effect to occur and allow further radial expansion of collet 200 to increase metal-metal seal, such that the radial outward expansion and metal-metal seal is sufficient to allow additional pressure to be applied to an amount sufficient to shear the shear pins 108.

In above embodiments, the collet 200 is made from a metal tubular by cutting, punching or otherwise forming a plurality of longitudinal slots 220 in the middle portion 210 to form the splines 218. In some alternative embodiments, the splines 218 may be coupled to the uphole and downhole portions 206 and 208 via other suitable means such as welding, screws, and/or the like.

EXAMPLE 'A'

As noted above, FIG. 18 shows an example of a collet 200 of the present invention slidably received sliding sleeve 106. Collet 200 is configured to possess a radially expandable portion 206" thereof, in the region of ball seat 214.

Specifically, in this example, collet 200, in the region of ball seat 214, is formed of API NP 80 steel, having a modulus of elasticity of 29,000,000 and a Poisson's Ratio of 0.29. The slidable sleeve 106 was also formed of API Grade N80 steel.

In this chosen example, collet 200 was provided with an initial radial clearance at the interface between the outer radial periphery of the collet 200 in the region of the ball seat 214 and the interior bore 151 of sleeve body 152 of 0.002 to 0.007 inches which was determined by applying material tolerances of the collet 200, namely the difference between the maximum and minimum dimensional tolerances between the collet 200 OD and the sliding sleeve 106 interior bore 151 internal diameter [(i.e., (4.567−4.553)/2 and (4.562−4.558)/2)].

The nominal thickness of collet 200 in the region of ball seat 214, namely on the uphole side of ball seat 214 was 0.149 to 0.1515 inches [i.e., (4.553−4.255)/2 to (4.558−4.255)/2], and on the downhole side of ball seat 214 was 0.2305 to 0.233 inches [i.e., (4.553−4.092/2 to (4.558−4.092)/2], The slope angle θ of the ball seat 214 of the collet 200 was 55°. The ball 242 has a nominal diameter of 4.250 inches.

When fluidic pressure of 1500 psi was applied uphole to ball 242 after ball 242 has become seated in ball seat 214, the aforesaid initial radial clearance of 0.002-0.007 inches is sufficient to initially partially prevent fluid flow through such interface. Upon continued injection of fluid under pressure, fluid pressure accordingly due to such partial initial obstruction is caused to build uphole of ball 242.

Radially expandable portion 206' of collet 200, in response to force applied to ball 242 by the applied fluidic pressure produces due to sloped angle θ of ball seat 214 a radially outward force applied to the tubular collet 200 in the region of the ball seat 214. Such applied radial outward force causes radial outward expansion of metal portion 206', thereby ultimately eliminating or substantially reducing the aforesaid radial clearance of 0.002 to 0.007 inches and create a metal-metal seal at the interface between the collet 200 and sliding sleeve 106.

Specifically, radially outwardly expandable metal portion 206' radially expands by at least 0.09% (in the instance where the outer diameter of radially outwardly expandable metal portion 206' is a maximum 4.558 inches and the bore ID of the sliding sleeve a minimum of 4.558 inches, namely (4.562–4.558/4.558), and nominally radially expands 0.02% (in the instance where the outer diameter of radially outwardly expandable metal portion 206' is a nominal 4.555 inches and the bore ID of the sliding sleeve a nominal 4.565 inches, namely (4.565–4.555/4.555), and radially expands by at least 0.03% (in the instance where the outer diameter of radially outwardly expandable metal portion 206' is a minimum 4.553 inches and the bore ID of the sliding sleeve a maximum 4.567 inches, namely (4.567–4.553/4.553), which in all cases thereby results in reduction of the radial clearance to forming a metal-to-metal seal between the collet 200 and the sliding sleeve 106.

Clearly, it will now be apparent to persons of skill in the art that variations may be made in certain of the above parameters to accomplish the desired result of providing a radially expandable collet that advantageously thereby is able to reduce contact with uphole sliding sleeves when passing through them to the desired sliding sleeve 106 and thus maintaining the dimensional tolerances of collet 200, in particular in its profile regions 212 and outer OD in the region of ball seat 214, and further more easily flowing downhole because of the reduced diameters, but upon locking engagement with the desired selected sleeve and application of fluidic pressure, be able to "grow" to maintain an effective seal and allow pressure to build sufficient to shear the shear screws 108.

By way of illustration, in this example, the sliding sleeve 106 and the collet 200 comprised API Grade N80 steel. Those skilled in the art will appreciate that, in various alternative embodiments, the sliding sleeve 106 and the collet 200 may be made of other suitable material such as API Grade P110 steel, having a similar modulus of elasticity to thereby achieve similar radial growth for an applied pressure of 1500 psi.

Alternatively, however, to reduce the magnitude of the pumping pressure but nevertheless achieve a similar amount of radial growth (i.e., nominally 0.02% radial growth) collet 200 may consist of material having a modulus of elasticity an order of magnitude less than API NP 80 steel (i.e., 1/10th that of API NP 80 steel). Such would then result in an applied pressure that need likewise only be 1/10th that of the applied pressure, namely 150 psi, to thereby still achieve the desired nominal radial growth of 0.02%.

Similarly, by reducing or increasing the slope angle θ of ball seat 214 of the collet 200 as seen in FIG. 18, the effective radially outward force applied by ball 242 on the periphery of collet 200 in the region of ball seat 214 may be effectively varied, thereby increasing or decreasing respectively the amount of applied radial force to collet 200.

Thus for example, with a consistent fluidic pressure of 1500 psi, reduction of slope angle θ from 55° to 30° would increase the applied force and a reduction of needed fluidic pressure from 1500 psi or use of a material having a proportionally-reduced modulus of elasticity (i.e., using a less stiff material with a greater radial deflection per unit of applied force) would then allow a similar magnitude of radial expansion growth (nominally 0.02%) to be achieved.

Additional permutation and combinations of aforesaid variables to achieve the aforementioned radial growths will now further occur to a person of skill in the art.

For example, if the slope angle θ was increased from 55° to 80° thereby reducing the effective radially outward force applied normally to collet 200, to achieve similar radial expansion of collet 200 (nominally 0.02%) such would require one or more of:

(i) a modification to the material of collet 200 to a material having a lower decrease in modulus of elasticity (i.e., lesser stiffness);

(ii) an increase in the applied fluidic pressure of 1500 psi exerted on ball 242 to achieve the same tangential force as formerly applied using a slope angle θ of 55°; or (iii) an decrease in the thickness of the collet 200 in the region of the ball seat 214 (provided the applied pressure and resultant radial force does not exceed the yield stress of the collet 200 in the region of the ball seat 214);

Further Description

FIG. 19 shows a collet 200 in some alternative embodiments. In these embodiments, the sliding valve 100 is the same as that shown in FIG. 1.

As show in FIG. 19, the collet 200 in these embodiments comprises a closed uphole end 284. Other parts of the collet 200 is the same as that shown in FIG. 8.

In these embodiments, the sliding valve 100 does not need ball 242 to actuate. Rather, to actuate a sliding valve 100, a matching collet 200 is pumped downhole and is locked in the sliding valve 100. A fluid pressure is applied to the closed uphole end 284 of the collet 200 and consequently shears the shear pin 108 and actuates the sliding sleeve 106 of the sliding valve 100 to move downhole to the open position. As described above, the high-strength stop ring 192 provides enhanced pressure resistance and wear resistance.

In above embodiments, the sliding sleeve 106 comprises a high-strength stop ring 192 at a downhole end of the profiled area 182 thereof, forming a stop shoulder 194 for locking a matching collet 200. In some alternative embodiments, the stop ring 192 is made of the same material as that of the sliding sleeve 106, but preferably is of a higher strength and/or hardened material and/or nitrided material, such as but not limited to tungsten carbide. In some embodiments, at least the stop shoulder 194 of the stop ring 192 is hardened to, or comprises, a hardness substantively or approximately equal to that of the downhole portion of the collet-profile of the matching collet 200.

In some alternative embodiments, the sliding sleeve 106 does not comprise any stop ring 192. Rather, the uphole end of the protection sleeve 154 forms a stop shoulder 194 for locking a matching collet.

In yet some alternative embodiments, the sleeve body 152 and the protection sleeve 154 are integrated to form a sliding sleeve 106, and comprises a radially inwardly extended circumferential ridge forming the stop shoulder 194. Therefore, the sliding sleeve 106 in these embodiments does not comprise any stop ring 192.

In some alternative embodiments, the sliding sleeve 106 only comprises the sleeve body 152 and does not comprise any protection sleeve 154. In these embodiments, the stop ring 192 is welded, mounted, or otherwise integrated in the sleeve body 152.

In some embodiments, a plurality of sleeve-profiles and collet-profiles may be obtained, and the plurality of sleeve- and collet-profiles may be used on a same tubular string in a downhole fracking system.

For example, FIGS. 20A to 20D show four sleeve profiles 182-1 to 182-4 (collectively denoted using reference numeral 182) on the inner surface of the sliding sleeves 106-1 to 106-4, respectively, and their corresponding collet-profiles 212-1 to 212-4 (collectively denoted using reference numeral 212) on the outer surface of the collets 200-1 to 200-4, respectively.

As shown, each sleeve-profile 106-1 to 106-4 comprises at least two grooves 184A and 184B (also denoted as "sleeve-grooves" hereinafter) and one ridge 232 (also denoted as a "sleeve-ridge" hereinafter) longitudinally between the two grooves 184A and 184B.

Correspondingly, each collet-profile 200-1 to 200-4 comprises at least two ridges 222A and 222B (also denoted as "collet-ridges" hereinafter) and one groove 234 (also denoted as a "collet-groove" hereinafter) between the two ridges 222A and 222B. Moreover, the length of each groove 184A, 184B, 234 is larger than or equal to that of each ridge 222A, 222B, 232 to allow the collet-profile 200-1 to 200-4 to be receivable in the corresponding sleeve-profile 106-1 to 106-4.

By varying the lengths of the grooves 184A and 184B and the ridge 232, a plurality of unique and individual sleeve-profiles (and corresponding unique and individual collet-sleeves) can be obtained. In these embodiments, the length difference between two sleeve-profiles, e.g., the length difference of sleeve-profiles 182-2 and 182-3, is an integer multiplication of a predetermined design parameter $L_b$, where $L_b>0$. Moreover, the length difference between respective corresponding grooves or ridges of two sleeve-profiles, e.g., the length difference of the grooves 184A of the sleeve-profiles 182-1 and 182-2, or the length difference of the grooves 184B of the sleeve-profiles 182-1 and 182-2, is also an integer multiplication of the predetermined design parameter $L_b$, where $L_b>0$.

Figure 21A:
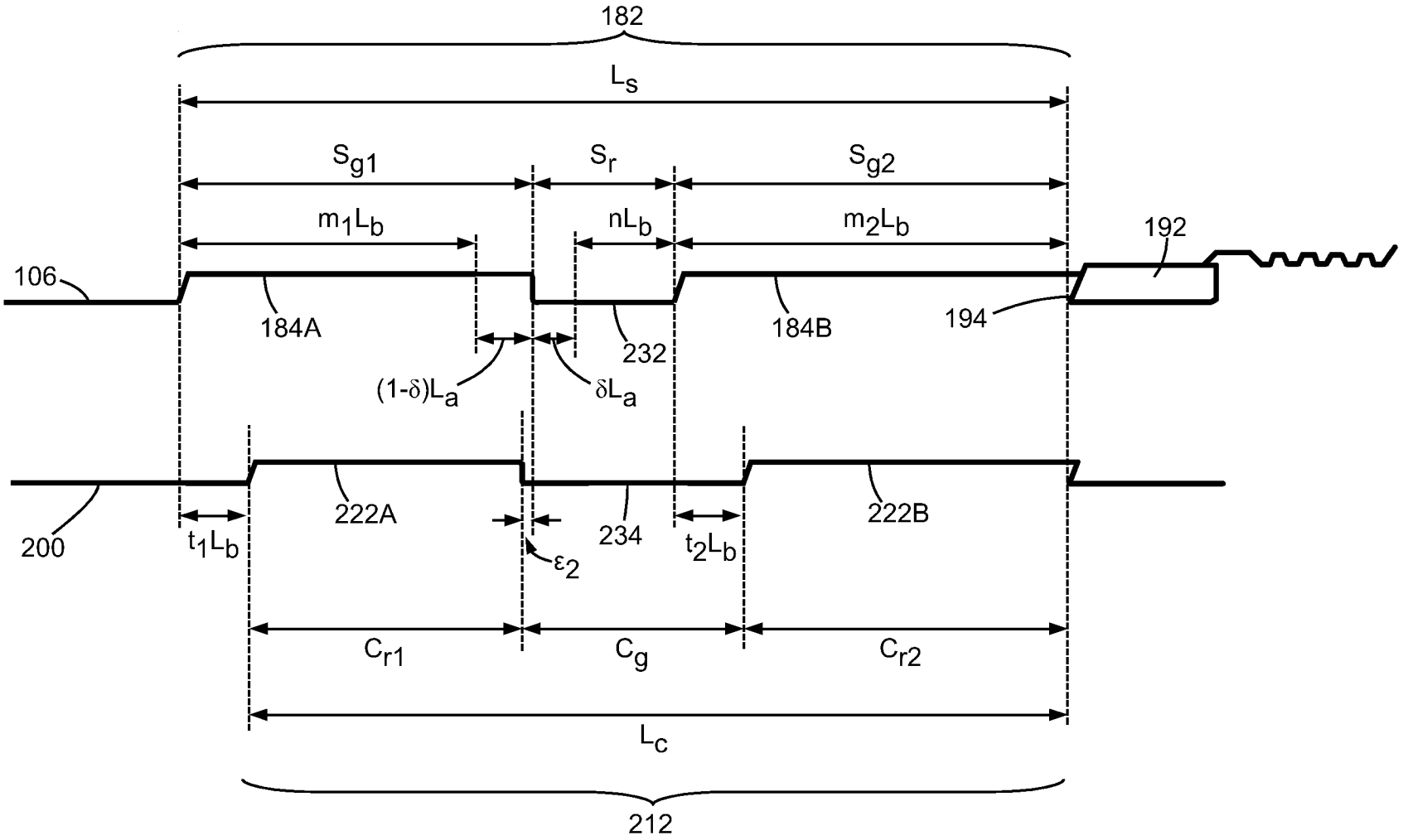
FIG. 21A is a schematic diagram showing a sleeve-profile and a corresponding collet-profile for illustrating parameters related to the design of the profiles.

Referring to FIG. 21A, the following parameters (all greater than zero) are used for the sleeve-profile 182:

$L_s$: the longitudinal length of the sleeve-profile 182;

$S_{g1}$: the longitudinal length of the groove 184A of the sleeve-profile 182;

$S_r$: the longitudinal length of the ridge 232 of the sleeve-profile 182; and $S_{g2}$: the longitudinal length of the groove 184B of the sleeve-profile 182.

The parameters $L_s$, $S_{g1}$, $S_r$, and $S_{g2}$ are measured at the radially innermost points of the sleeve-profile 182.

The following parameters (all greater than zero) are used for the collet-profile 182:

$L_c$: the longitudinal length of the collet-profile 212;

$C_{r1}$: the longitudinal length of the ridge 222A of the collet-profile 212;

$C_g$: the longitudinal length of the groove 234 of the collet-profile 212; and $C_{r2}$: the longitudinal length of the ridge 222B of the collet-profile 212.

The parameters $L_c$, $C_{r1}$, $C_g$, and $C_{r2}$ are also measured at the radially innermost points of the collet-profile 212.

As described above, in a pair of matching collet-profile and sleeve-profile, the lengths of the grooves, including the lengths $S_{g1}$, $S_{g2}$, and $C_g$ of the sleeve-grooves 184A and 184B and the collet-groove 234, must be larger than or equal to those of the corresponding ridges, including the lengths $C_{r1}$, $C_{r2}$, and $S_r$ of the collet-ridges 222A and 222B and the sleeve-ridge 232, i.e., $S_{g1}\geq C_{r1}$, $S_{g2}\geq C_{r2}$, and $C_g\geq S_r$, to allow the collet-profile 212 be receivable in the matching sleeve-profile 182.

In these embodiments, the uphole surfaces of the sleeve-grooves 184A and 184B and the stop ring 192 are sloped such that they extend radially inwardly towards uphole. The uphole surfaces of the collet-ridges 222A and 222B and the downhole surface of the collet-ridge 222B are sloped such that they extend radially outwardly towards downhole. These slopes affects how the sleeve-ridge 232 and the collet-ridges 222A and 222B can be received in the collet-groove 234 and the sleeve-grooves 184A and 184B.

For ease of description, in these embodiments, the angular chamfers of the uphole surfaces of the sleeve-grooves 184A, 184B, the stop ring 192, collet-ridges 222A, 222B and the downhole surface of the collet-ridge 222B are substantively the same.

Figures 21B, 21C:
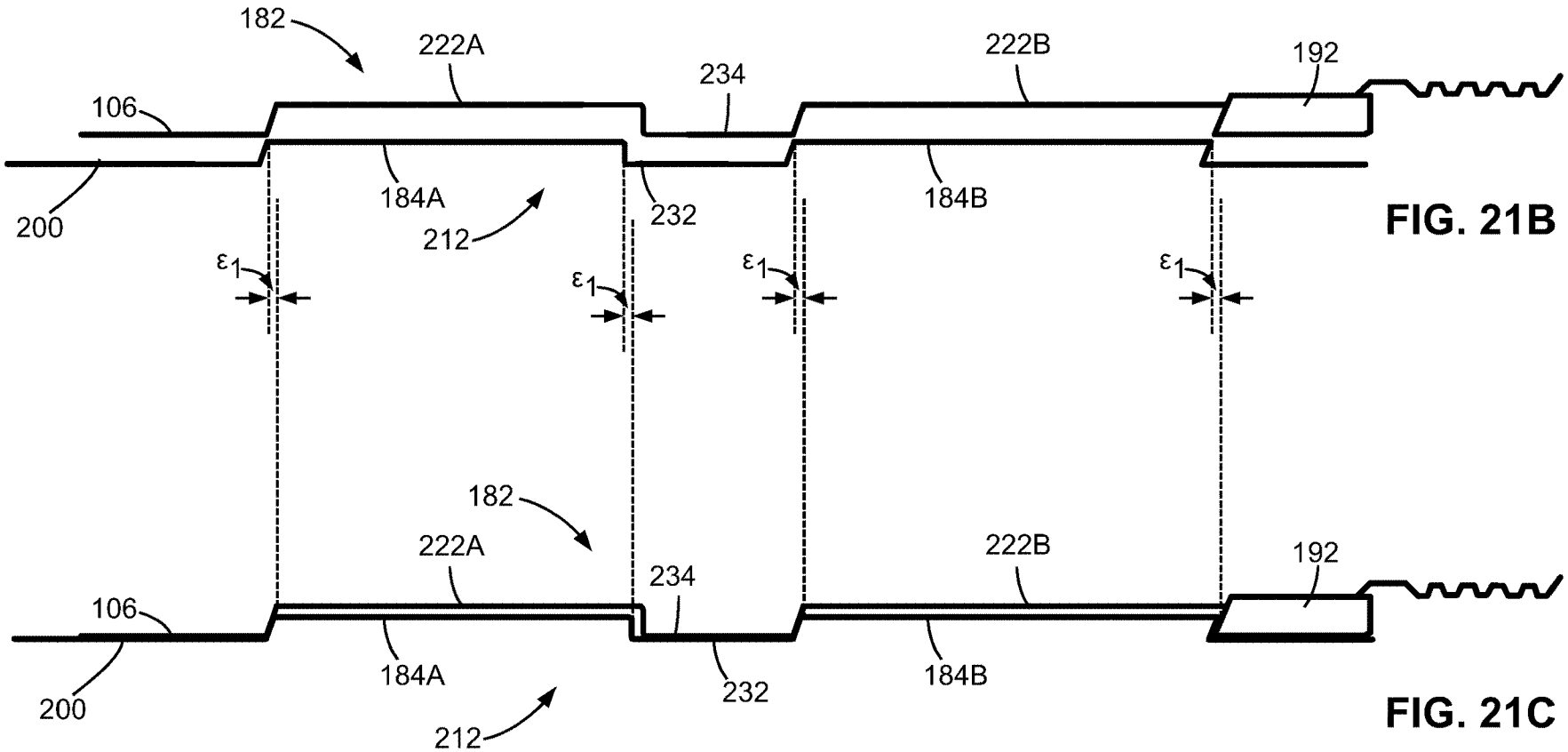
FIG. 21B is a schematic diagram showing a collet-profile fitting to a sleeve-profile.
FIG. 21C is a schematic diagram showing the collet-profile and the sleeve-profile shown in FIG. 21B, wherein the collet-profile is received into the sleeve-profile.

As shown in FIGS. 21B and 21C, due to the above-described angular chamfers, after a collet-profile 212 fits to a matching sleeve-profile 182, the collet 200 may expand radially outwardly and further move downhole for a short distance $\varepsilon_1$, which is a design parameter predetermined by the above-described angular chamfers and the extent of engagement, to be received into the sleeve-profile 182 until the downhole surface of the collet-ridge 222B engages the stop shoulder 194 of the stop ring 192.

Referring again to FIG. 21A, on the sleeve-profile 182, the length $S_r$ of the ridge 232 is defined as:

$$S_r=\delta L_a+nL_b, \tag{1}$$

where $1\geq\delta\geq0$ is a predetermined design parameter, $L_a$ is a predetermined design parameter and $L_a>0$, n is an integer and $n\geq0$, $L_b$ is a predetermined design parameter and $L_b>0$. Therefore, when n=0, the ridge 232 has a minimum length $S_r=\delta L_a$.

The lengths $S_{g1}$ and $S_{g1}$ of the grooves 184A and 184B are defined as:

$$S_{g1}=m_1L_b+(1-\delta)L_a, \tag{2}$$

$$S_{g2}=m_2L_b, \tag{3}$$

where $m_1$ is an integer and $m_1\geq1$, and $m_2$ is an integer and $m_2>1$. Moreover, $$m_1+m_2=K, \tag{4}$$

where K>2 is a positive integer, such that for sleeve-profiles having a same K, increasing $m_1$ will decrease $m_2$, thereby effectively changing the location of the ridge 232 on the sleeve profile.

The length $L_s$ of the sleeve-profile 182 is then:

$$L_s=S_r+S_{g1}+S_{g2}=L_a+(n+K)L_b. \tag{5}$$

As $L_a$ and $L_b$ are predetermined design parameters, a plurality of sleeve-profile 182 with different lengths $L_s$ may be obtained by choosing different n and K.

On the collet-profile 212, the lengths $C_{r1}$, $C_{r2}$, $C_g$ of the ridges 222A and 222B and the collet-groove 234 are defined as:

$$C_{r1}=S_{g1}-t_1L_b-\varepsilon_2=(m_1-t_1)L_b+(1-\delta)L_a-\varepsilon_2, \tag{6}$$

$$C_{r2}=S_{g2}-t_2L_b=(m_2-t_2)L_b, \tag{7}$$

$$C_g=S_r+S_{g2}-C_{r2}+\varepsilon_2=S_r+t_2L_b+\varepsilon_2=\delta L_a+(n+t_2)L_b+\varepsilon_2. \tag{8}$$

where $t_1$, $t_2$ and $\varepsilon_2$ are predetermined design parameters with $1\geq t_1\geq0$, $1\geq t_2\geq0$, and $\varepsilon_2\geq0$. The length $L_c$ of the collet-profile 212 is:

$$L_c=C_{r1}+C_{r2}+C_g=L_s-t_2L_b=L_a+(n+K-t_2)L_b. \tag{9}$$

The parameter $\varepsilon_2$ only determines whether or not the downhole surface of the collet-ridge 222A will engage the downhole surface of the sleeve-groove 184A. In some embodiments, $\varepsilon_2=0$ such that when the collet 200 engages the sleeve 106 under a pressure applied from uphole, the downhole surface of the collet-ridge 222A engages the downhole surface of the sleeve-groove 184A and the downhole surface of the collet-ridge 222B engages the stop shoulder 194, thereby providing enhanced pressure resistance. In some other embodiments, $\varepsilon_2>0$, which, together with other conditions (described later) allows the flexible splines 218 to further radially outwardly expand and bow under fluidic pressure for enhanced engagement between the collet 200 and the sliding sleeve 106.

Referring back to FIG. 21A, in embodiments where $\varepsilon_2=0$, when $t_1=1$, the sleeve-groove 184A and collet-ridge 222A has a maximum length difference of $L_b$; when $t_1=0$, the sleeve-groove 184A and collet-ridge 222A has a same length. Similarly, when $t_2=1$, the sleeve-groove 184B and collet-ridge 222B has a maximum length difference of $L_b$; when $t_2=0$, the sleeve-groove 184B and collet-ridge 222B has a same length.

In some embodiments, the design parameters are predetermined as $L_a=L_b$, $t_1=t_2=t$, and $1\geq t\geq 0$. Then, the parameters of the sleeve-profile 182 become:

$$S_r=(n+\delta)L_b, \tag{10}$$

$$S_{g1}=(m_1+1-\delta)L_b, \tag{11}$$

$$S_{g2}=m_2L_b, \tag{12}$$

$$m_1+m_2=K, \tag{13}$$

$$L_s=(n+K+1)L_b. \tag{14}$$

The parameters of the collet-profile 212 become:

$$C_{r1}=S_{g1}-tL_b-\varepsilon_2, \tag{15}$$

$$C_{r2}=S_{g2}-tL_b, \tag{16}$$

$$C_g=(n+t+\delta)L_b+\varepsilon_2, \tag{17}$$

$$L_c=(n+K+1-t)L_b. \tag{18}$$

Given an $\varepsilon_2$, the parameter t determines the length difference between the grooves and their corresponding ridges. If t=0, the sleeve-profile 182 and the collet-profile 212 have a same length. If t=1, the sleeve-profile 182 and the collet-profile 212 have the maximum length difference of $L_b$. In embodiments where $\varepsilon_2=0$, if t=0, the grooves and their corresponding ridges have a same length. If t=1, the grooves and their corresponding ridges have the maximum length difference of $L_b$.

A variety of sleeve-profiles and collet-profiles may be obtained. For ease of description, the sleeve-profiles and collet-profiles are grouped into profile sets, and the profile sets are grouped into profile categories. Hereinafter, a sleeve-profile is denoted in the form of "S({category letter}{set number}-{profile number})", where "{category letter}" may be A, B, C, . . . , representing the profile category that the sleeve-profile belongs to, "{set number}" may be 1, 2, 3, . . . , representing the profile set that the sleeve-profile belongs to, and "{profile number}" may be 1, 2, 3, . . . , representing the order of the sleeve-profile in the profile set. For example, sleeve-profile "S(A1-1)" represents the first sleeve-profile in set A1.

Similarly, a sleeve-profile is denoted in the form of "C({category letter}{set number}-{profile number})". For example, collet-profile "C(B2-3)" represents the third collet-profile in set B2.

As can be seen, a plurality of sleeve-profiles 182 and collet-profiles 212 are created by varying the values of n, K and $m_1$. Therefore, for ease of description, a sleeve-profile may also be denoted as S[n, K, $m_1$] and a collet-profile may also be denoted as C[n, K, $m_1$].

In these embodiments, for a given $L_b$, the sum of (n+K) determines the sleeve-profile's length $L_s$ and the collet-profile's length $L_c$. In particular, the sleeve-profiles in each profile category (e.g., "A") have a same length $L_s=(n+K+1)L_b$, and the collet-profiles in the same profile category have a same length $L_c=(n+K+1-t)L_b$.

The parameter n determines the length of the sleeve-ridge 232 and the length of the collet-groove 234. Therefore, the sleeve-profiles in each profile set (e.g., "A1") have a same length of the ridge 232 as $S_r=(n+\delta)L_b$, and the collet-profiles in the same profile set have a same length of the groove 234 as $C_g=(n+t+\delta)L_b+\varepsilon_2$.

Each profile set comprises (K−2) sleeve-profiles and (K−2) corresponding collet-profiles with a same n and a same K, in which all (K−2) sleeve-profiles have a same length $L_s=(n+K+1)L_b$, and a same $S_r=(n+\delta)L_b$, and all (K−2) collet-profiles have a same length $L_c=(n+K+1-t)L_b$, and a same $C_g=(n+t+\delta)L_b+\varepsilon_2$.

Those skilled in the art will appreciate that, if t is equal to or close to 0, then the collet-profile fully or nearly coincides with the sleeve-profile, and thus there may exist a risk that a collet-profile cannot fit into a matching sleeve-profile due to for example, a large manufacturing tolerance of the collet-profile and/or the sleeve-profile, and/or the collet 200 entering the sliding sleeve 106 at a high speed such that the biased collet-profile does not have sufficient time to return to the unbiased condition before the collet 200 moves out of the sliding sleeve 106.

On the other hand, if t is equal to or close to 1, the grooves and their corresponding ridges have the maximum length difference of $L_b$, and there may exist a risk that a collet-profile may falsely fit into an unmatched sleeve-profile (described later).

In some embodiments, t may be selected sufficiently larger than zero and sufficiently smaller than one to ensure that:

(i) a collet-profile corresponding to a sleeve-profile in the set can be readily rejected by any other sleeve-profile in the same set; and (ii) the length difference between a groove and its corresponding ridge (e.g., the length difference between the sleeve-groove 184A and the collet-ridge 222A, the length difference between the collet-groove 234 and the sleeve-ridge 232, or the length difference between the sleeve-groove 184B and the collet-ridge 222B) is sufficient for readily receiving the ridge into the groove.

For example, in one embodiment, t may be selected as $0.9\geq t\geq 0.1$. In some alternative embodiments, t may be selected as $0.8\geq t\geq 0.2$. In some alternative embodiments, t may be selected as $0.7\geq t\geq 0.3$. In some alternative embodiments, t may be selected as $0.6\geq t\geq 0.4$. In some alternative embodiments, t may be selected as about 0.5.

Figure 22:
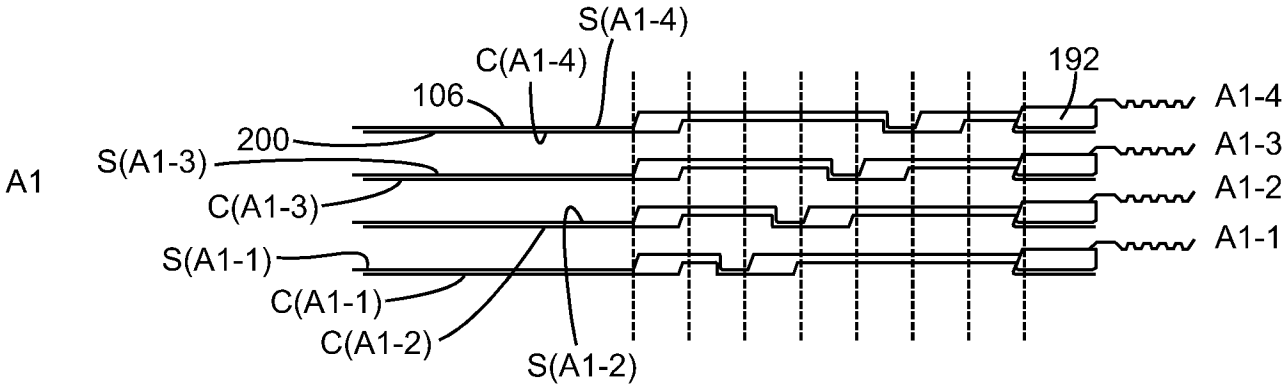
FIGS. 22 to 49 are schematic diagrams showing various designs of the profiled areas of the sliding sleeve and the collet.

FIG. 22 shows a set A1 of four sleeve-profiles and four corresponding collet-profiles when n=0 and K=6, wherein the sleeve-profiles have a same length $L_s=7L_b$.

Figure 23:
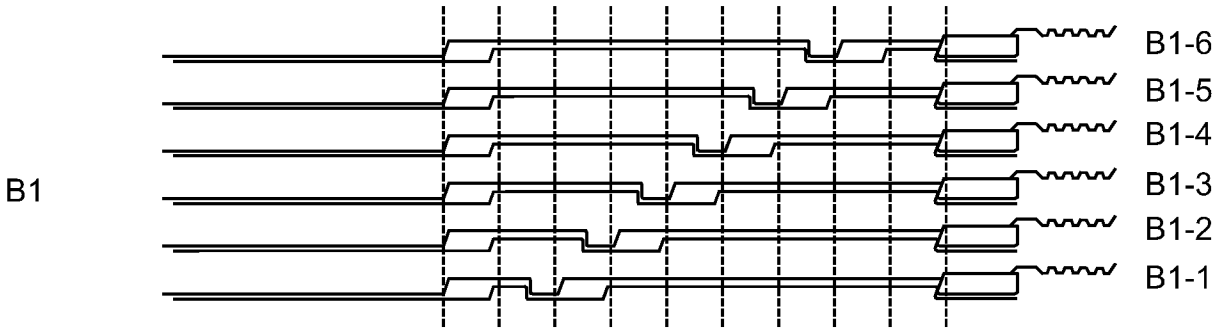

FIG. 23 shows a set B1 of six sleeve-profiles and six corresponding collet-profiles when n=0 and K=8, wherein the sleeve-profiles have a same length $L_s=9L_b$.

Figure 24:
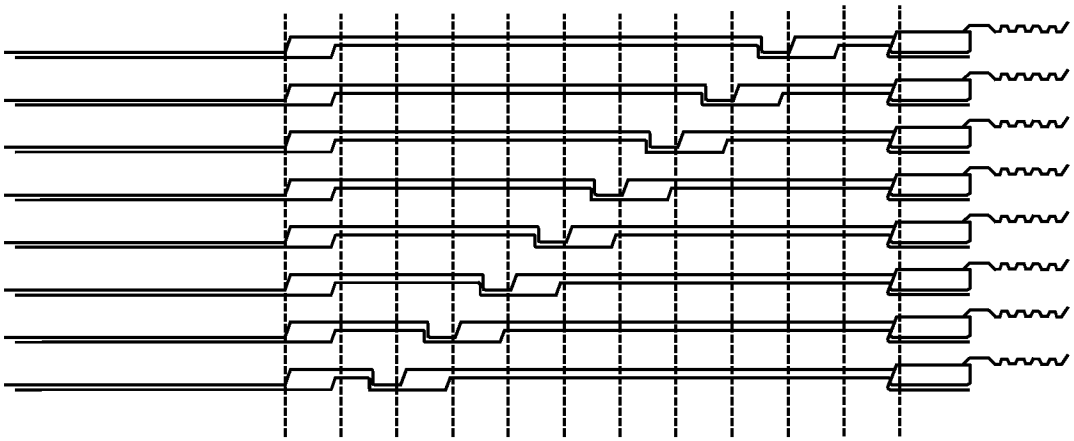

FIG. 24 shows a set C1 of eight sleeve-profiles and eight corresponding collet-profiles when n=0 and K=10, wherein the sleeve-profiles have a same length $L_s=11L_b$.

Figure 25:
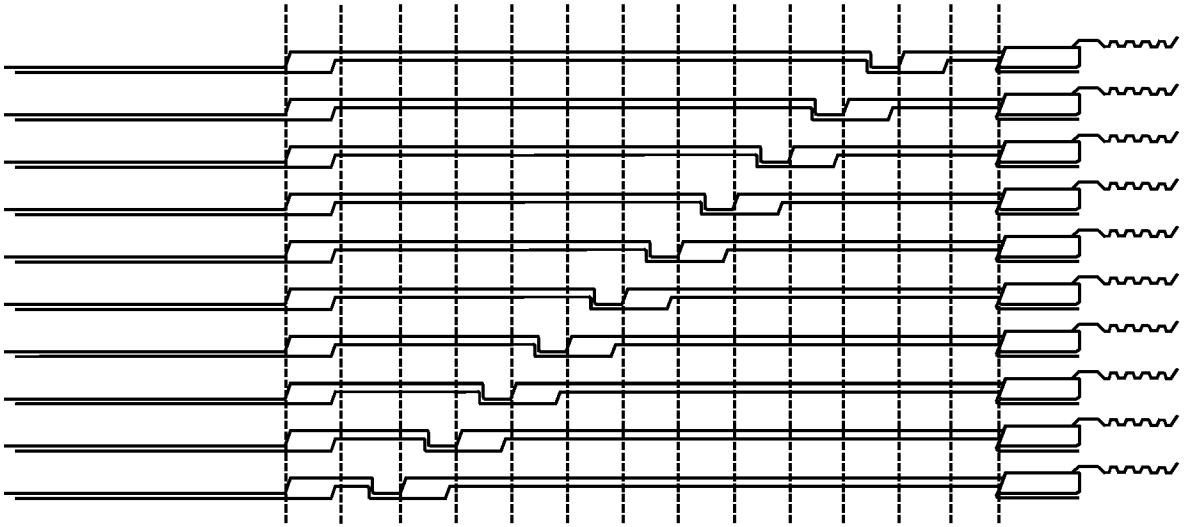

FIG. 25 shows a set D1 of ten sleeve-profiles and ten corresponding collet-profiles when n=0 and K=12, wherein the sleeve-profiles have a same length $L_s=13L_b$.

Figures 26, 27, 28, 29:
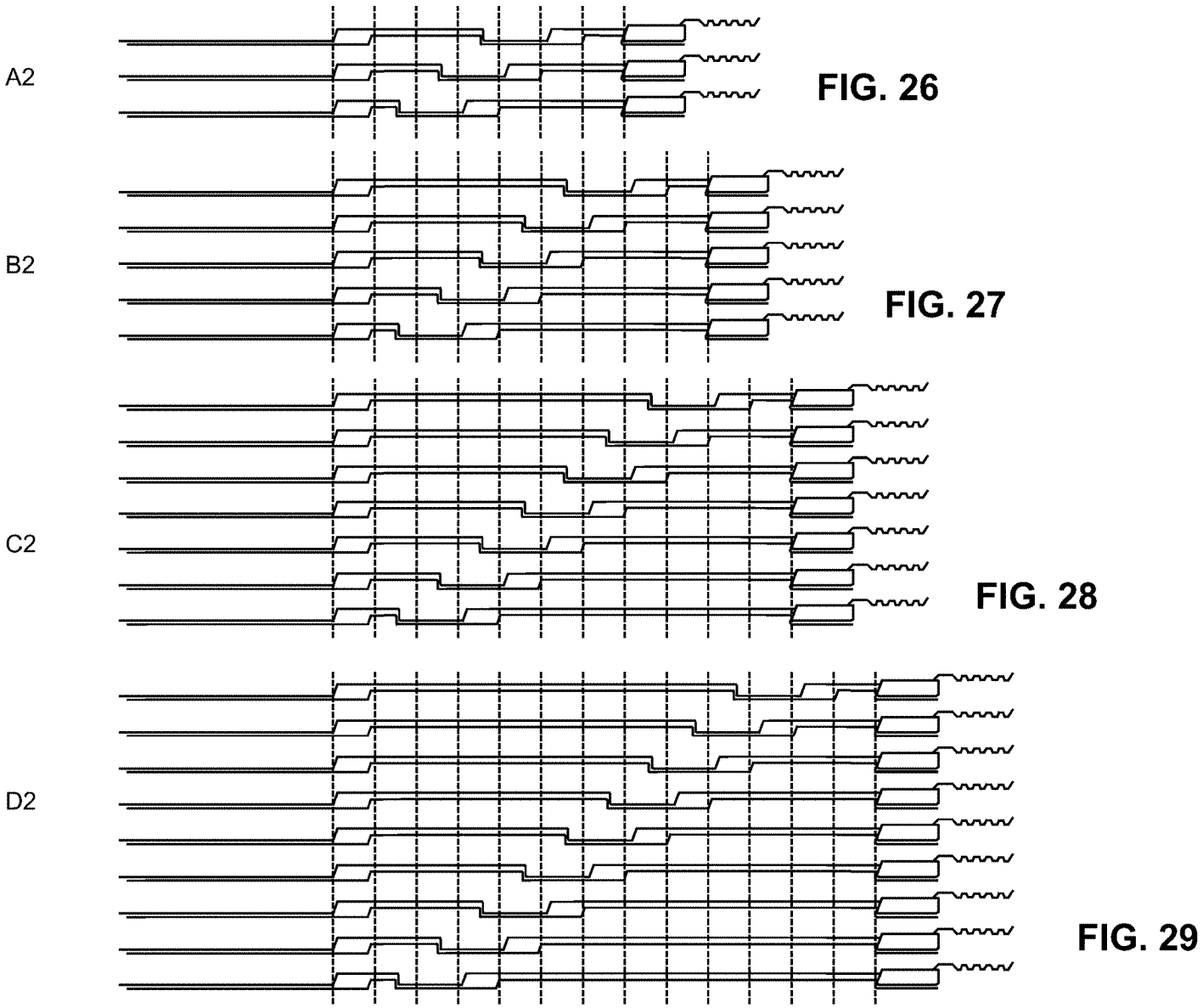

FIG. 26 shows a set A2 of three sleeve-profiles and three corresponding collet-profiles when n=1 and K=5, wherein the sleeve-profiles have a same length $L_s=7L_b$.

FIG. 27 shows a set B2 of five sleeve-profiles and five corresponding collet-profiles when n=1 and K=7, wherein the sleeve-profiles have a same length $L_s=9L_b$.

FIG. 28 shows a set C2 of seven sleeve-profiles and seven corresponding collet-profiles when n=1 and K=9, wherein the sleeve-profiles have a same length $L_s=11L_b$.

FIG. 29 shows a set D2 of nine sleeve-profiles and nine corresponding collet-profiles when n=1 and K=11, wherein the sleeve-profiles have a same length $L_s=13L_b$.

Figure 30:
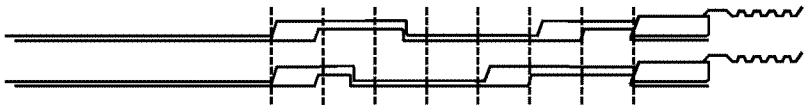

FIG. 30 shows a set A3 of two sleeve-profiles and two corresponding collet-profiles when n=2 and K=4, wherein the sleeve-profiles have a same length $L_s=7L_b$.

Figure 31:
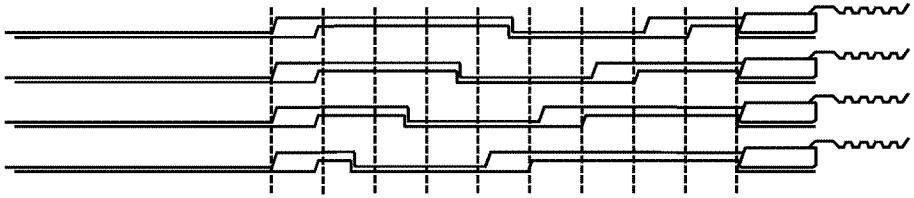

FIG. 31 shows a set B3 of four sleeve-profiles and four corresponding collet-profiles when n=2 and K=6, wherein the sleeve-profiles have a same length $L_s=9L_b$.

Figure 32:
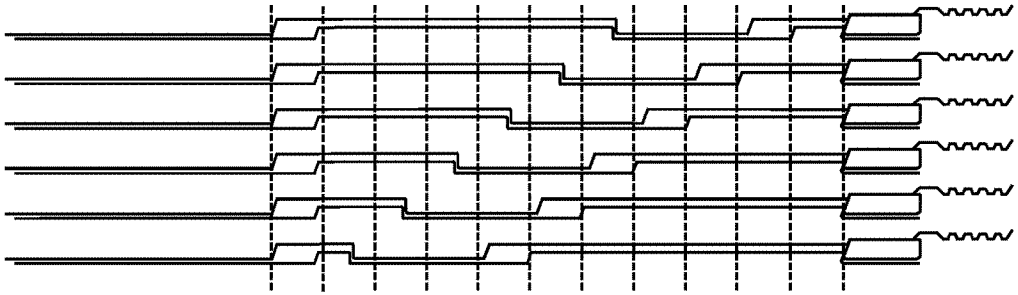

FIG. 32 shows a set C3 of six sleeve-profiles and six corresponding collet-profiles when n=2 and K=8, wherein the sleeve-profiles have a same length $L_s=11L_b$.

Figure 33:
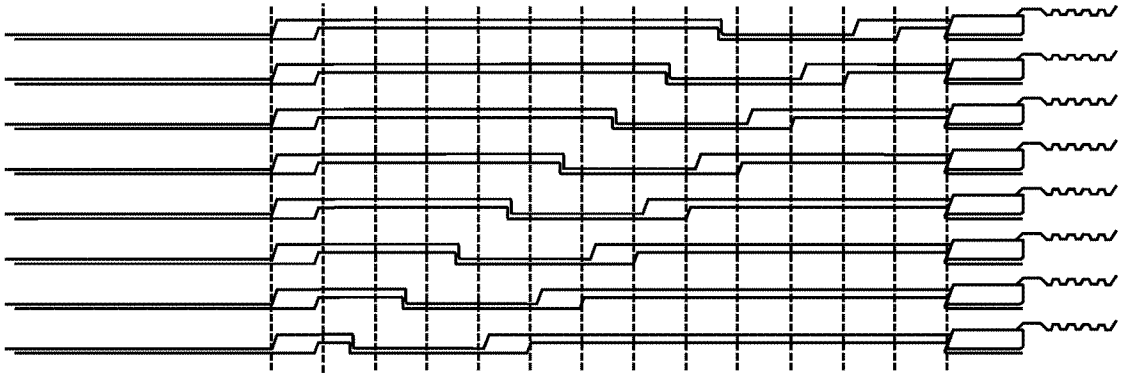

FIG. 33 shows a set D3 of eight sleeve-profiles and eight corresponding collet-profiles when n=2 and K=10, wherein the sleeve-profiles have a same length $L_s=13L_b$.

Figures 34, 35, 36, 37:
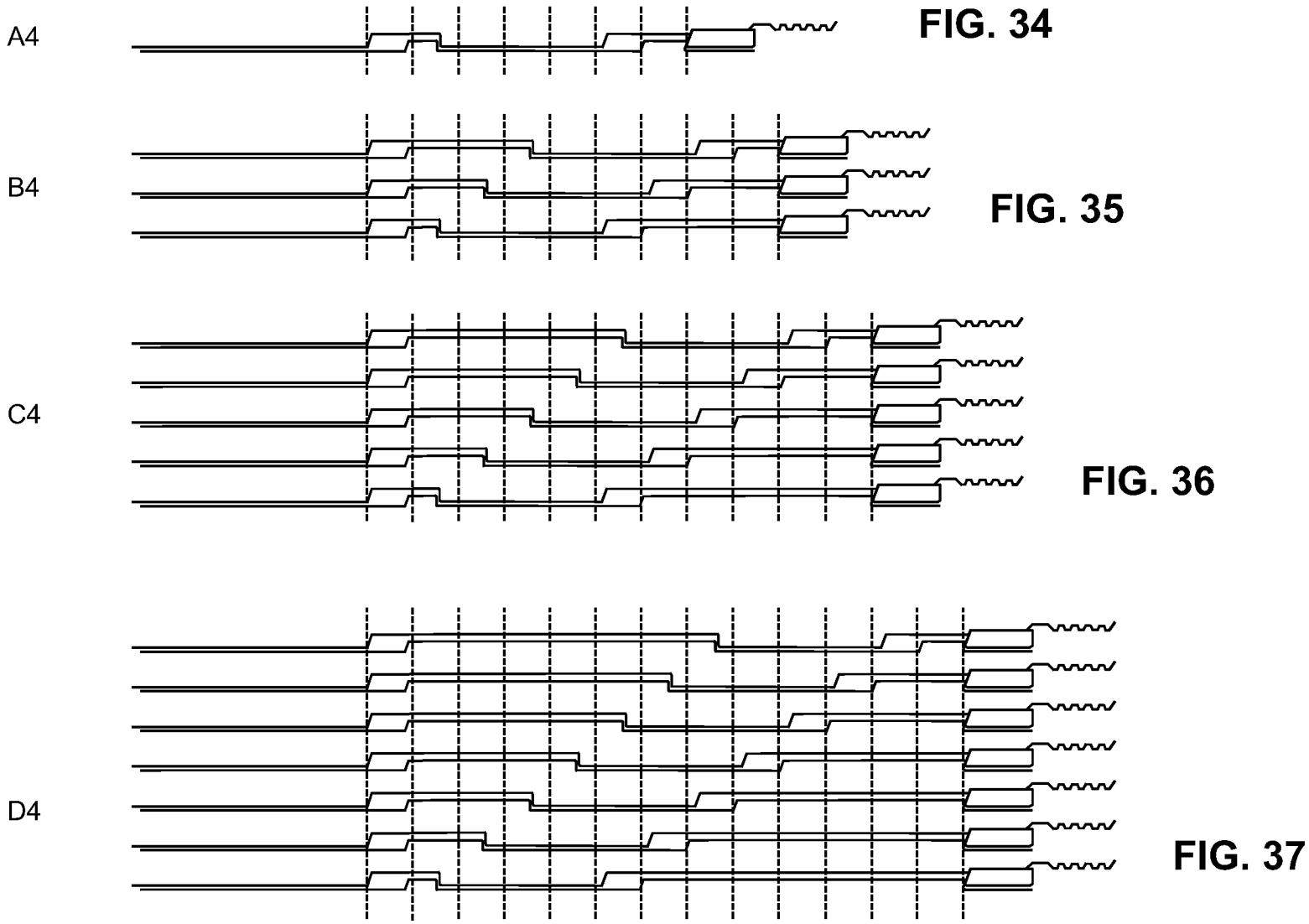

FIG. 34 shows a set A4 of one sleeve-profile and one corresponding collet-profile when n=3 and K=3, wherein the sleeve-profile has a length $L_s=7L_b$.

FIG. 35 shows a set B4 of three sleeve-profiles and three corresponding collet-profiles when n=3 and K=5, wherein the sleeve-profiles have a same length $L_s=9L_b$.

FIG. 36 shows a set C4 of five sleeve-profiles and five corresponding collet-profiles when n=3 and K=7, wherein the sleeve-profiles have a same length $L_s=11L_b$.

FIG. 37 shows a set D4 of seven sleeve-profiles and seven corresponding collet-profiles when n=3 and K=9, wherein the sleeve-profiles have a same length $L_s=13L_b$.

Figure 38:
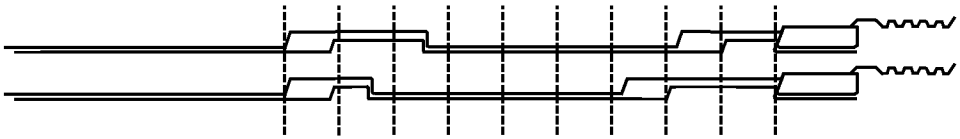

FIG. 38 shows a set B5 of two sleeve-profiles and two corresponding collet-profiles when n=4 and K=4, wherein the sleeve-profiles have a same length $L_s=9L_b$.

Figure 39:
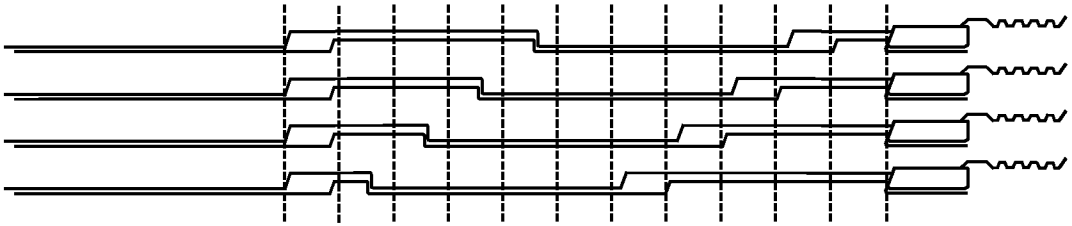

FIG. 39 shows a set C5 of four sleeve-profiles and four corresponding collet-profiles when n=4 and K=6, wherein the sleeve-profiles have a same length $L_s=11L_b$.

Figure 40:
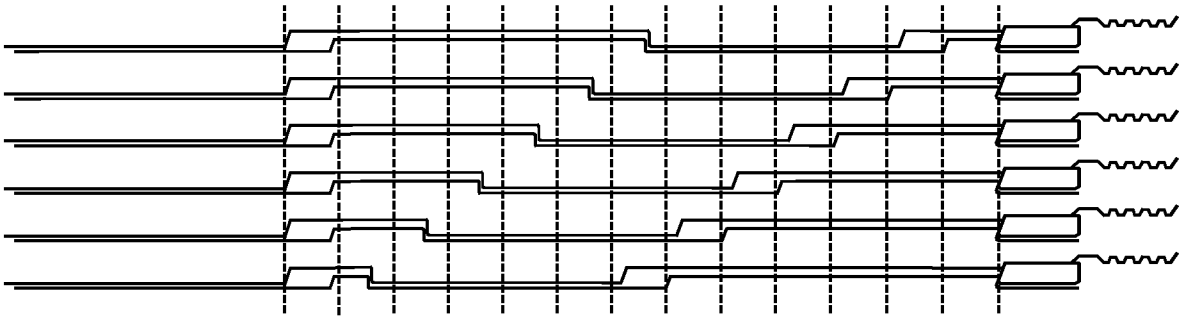

FIG. 40 shows a set D5 of six sleeve-profiles and six corresponding collet-profiles when n=4 and K=8, wherein the sleeve-profiles have a same length $L_s=13L_b$.

Figure 41:
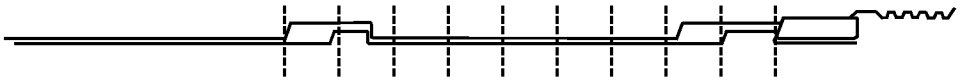

FIG. 41 shows a set B6 of one sleeve-profile and one corresponding collet-profile when n=5 and K=3, wherein the sleeve-profile has a length $L_s=9L_b$.

Figure 42:
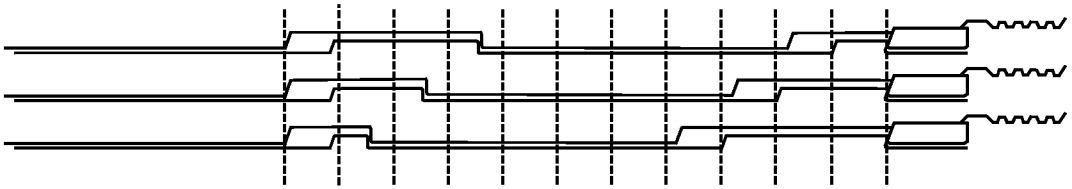

FIG. 42 shows a set C6 of three sleeve-profiles and three corresponding collet-profiles when n=5 and K=5, wherein the sleeve-profiles have a same length $L_s=11L_b$.

Figure 43:
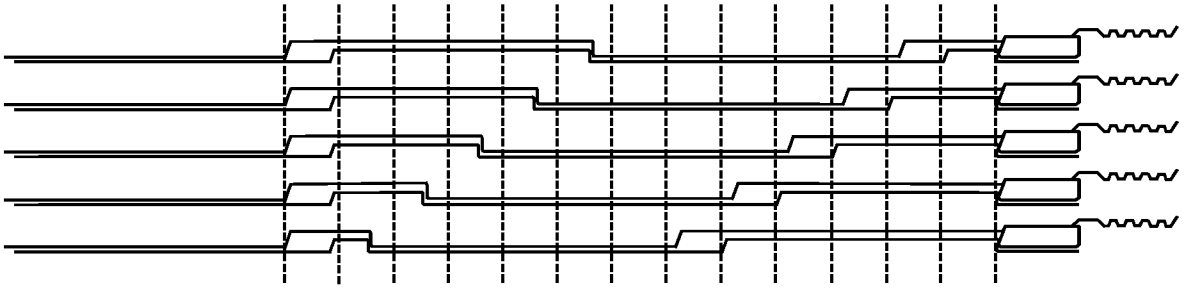

FIG. 43 shows a set D6 of five sleeve-profiles and five corresponding collet-profiles when n=5 and K=7, wherein the sleeve-profiles have a same length $L_s=13L_b$.

Figure 44:
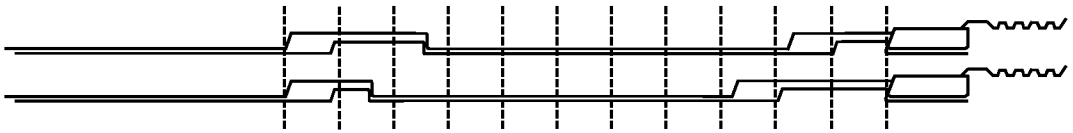

FIG. 44 shows a set C7 of two sleeve-profiles and two corresponding collet-profiles when n=6 and K=4, wherein the sleeve-profiles have a same length $L_s=11L_b$.

Figure 45:
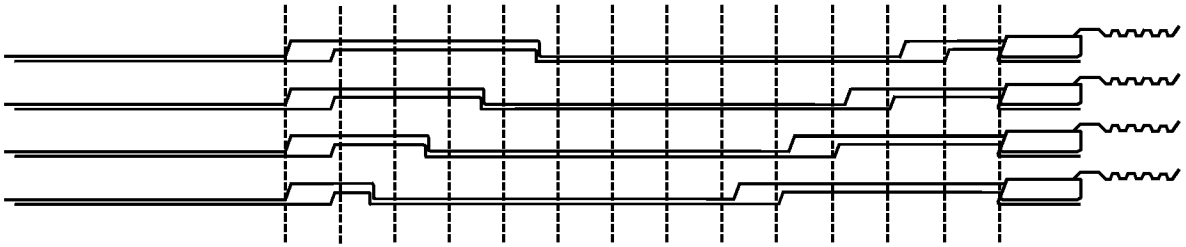

FIG. 45 shows a set D7 of four sleeve-profiles and four corresponding collet-profiles when n=6 and K=6, wherein the sleeve-profiles have a same length $L_s=13L_b$.

Figure 46:
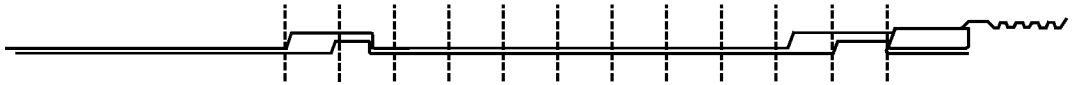

FIG. 46 shows a set C8 of one sleeve-profile and one corresponding collet-profile when n=7 and K=3, wherein the sleeve-profile has a length $L_s=11L_b$.

Figure 47:
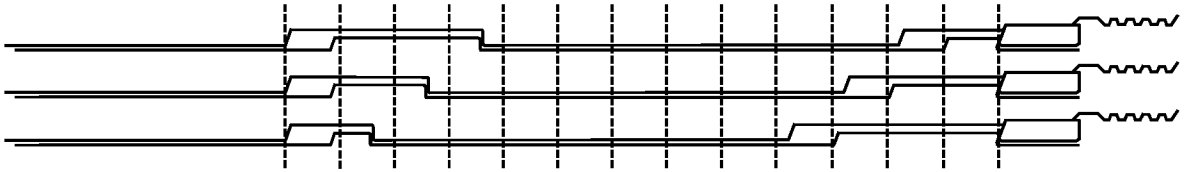

FIG. 47 shows a set D8 of three sleeve-profiles and three corresponding collet-profiles when n=7 and K=5, wherein the sleeve-profiles have a same length $L_s=13L_b$.

Figure 48:
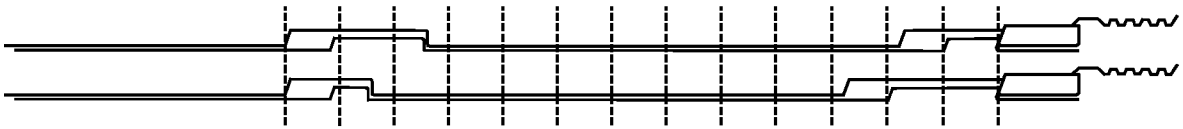

FIG. 48 shows a set D9 of two sleeve-profiles and two corresponding collet-profiles when n=8 and K=4, wherein the sleeve-profiles have a same length $L_s=13L_b$.

Figure 49:
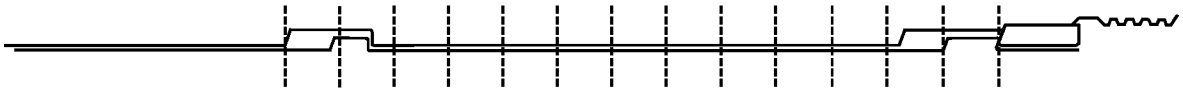

FIG. 49 shows a set D8 of one sleeve-profile and one corresponding collet-profile when n=9 and K=3, wherein the sleeve-profile has a length $L_s=13L_b$.

Table 1 below summarizes the profile sets shown in FIGS. 22 to 49. As can be seen, by limiting the sleeve-profile lengths to be $7L_b$, $9L_b$, $11L_b$, and $13L_b$, a total of 122 sleeve-profiles and 122 corresponding collet-profiles can be obtained and used for downhole fracking.

TABLE 1

| Set Number | n | K | $L_s/L_b$ | Number of sleeve-profiles |
|---|---|---|---|---|
| A1 | 0 | 6 | 7 | 4 |
| B1 | 0 | 8 | 9 | 6 |
| C1 | 0 | 10 | 11 | 8 |
| D1 | 0 | 12 | 13 | 10 |
| A2 | 1 | 5 | 7 | 3 |
| B2 | 1 | 7 | 9 | 5 |
| C2 | 1 | 9 | 11 | 7 |
| D2 | 1 | 11 | 13 | 9 |
| A3 | 2 | 4 | 7 | 2 |
| B3 | 2 | 6 | 9 | 4 |
| C3 | 2 | 8 | 11 | 6 |
| D3 | 2 | 10 | 13 | 8 |
| A4 | 3 | 3 | 7 | 1 |
| B4 | 3 | 5 | 9 | 3 |
| C4 | 3 | 7 | 11 | 5 |
| D4 | 3 | 9 | 13 | 7 |
| B5 | 4 | 4 | 9 | 2 |
| C5 | 4 | 6 | 11 | 4 |
| D5 | 4 | 8 | 13 | 6 |
| B6 | 5 | 3 | 9 | 1 |
| C6 | 5 | 5 | 11 | 3 |
| D6 | 5 | 7 | 13 | 5 |
| C7 | 6 | 4 | 11 | 2 |
| D7 | 6 | 6 | 13 | 4 |
| C8 | 7 | 3 | 11 | 1 |
| D8 | 7 | 5 | 13 | 3 |
| D9 | 8 | 4 | 13 | 2 |
| D10 | 9 | 3 | 13 | 1 |

In embodiments where two or more sliding valves 100 having the above sleeve-profiles are used on a tubular string, the order of the sleeve-profiles needs to be arranged as follows:

(a) the sliding valves shall have different sleeve-profiles; in other words, for any two sliding valves, at least one of the n, K, and $m_1$ thereof is different;

(b) sliding valves with shorter length $L_s$ shall be uphole to those with longer length $L_s$; in other words, the sliding valves with smaller (n+K) are uphole to those with larger (n+K);

(c) for sliding valves with a same length $L_s$, those with larger $S_r$ shall be uphole to those with smaller $S_r$; in other words, for sliding valves with a same (n+K), those with larger n are uphole to those with smaller n and (d) sliding valves of the same profile set, i.e., those having a same n and a same K, but with different $m_1$ can be arranged in any order.

Figure 50:
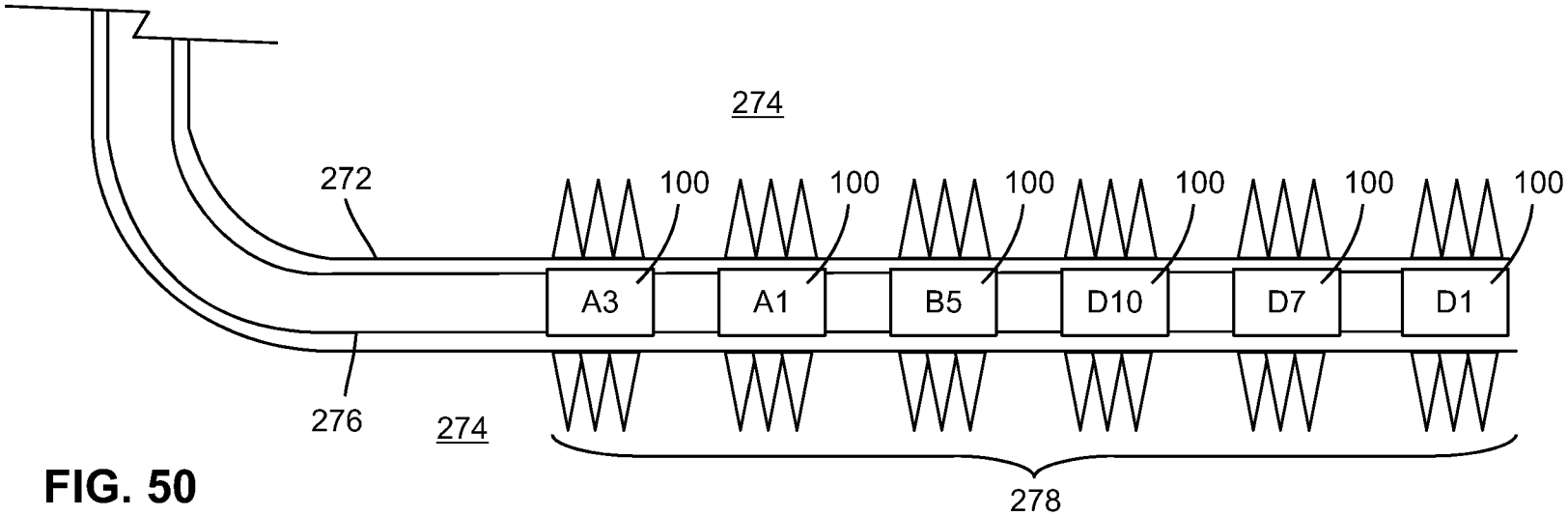
FIG. 50 is a schematic diagram showing an example of a tubular string having a plurality of sliding valves, according to some embodiments of this disclosure.

In other words, sliding valves having a "lower" category letter (e.g., "A"), i.e., sliding valves having shorter sleeve-profile length $L_s$, shall be uphole to those having a "higher"

category letter (e.g., "D"), i.e., those having longer sleeve-profile length $L_s$. For sliding valves having a same category letter, i.e., having a same sleeve-profile length $L_s$, those having a smaller set number (e.g., "A1") shall be downhole to those having a larger set number (e.g., "A3"). FIG. 50 shows an example of a tubular string (such as a casing string or a tubing string) having a plurality of sliding valves 100 with above-described arrangement.

In some alternative embodiments where t is equal to or close to 1, and the grooves and their corresponding ridges have the maximum length difference of $L_b$, and thus two "adjacent" sleeve- and collet-profiles are not mutually exclusive.

That is, a collet-profile may be received not only in the matching sleeve-profile, but also in the sleeve-profile that has the same category letter, the same set number, and an "adjacent" profile number (i.e., greater or smaller by 1). For example, the collet-profile C(A1-2), i.e., C[0, 6, 2], can fit into the previous and the next sleeve-profiles S(A1-1) and S(A1-2), i.e., S[0, 6, 1] and S[0, 6, 3], but cannot fit into other sleeve-profiles in the profile set A1 such as S(A1-4).

In other words, a collet-profile can fit into the previous and the next sleeve-profiles in the same profile set, but cannot fit into other sleeve-profiles in the same profile set. That is, a collet-profile C[n, K, i] can fit into the sleeve-profiles S[n, K, i+1] and S[n, K, i−1], but cannot fit into other sleeve-profiles, i.e., the sleeve profiles S[n, K, j], where $j \neq i$, $j \neq i+1$, and $j \neq i-1$.

Thus, in embodiments where t=1 and two o63r more sliding valves 100 having the sleeve-profiles such as those shown in FIGS. 22 to 49 are used on a tubular string, the order of the sleeve-profiles needs to be arranged as follows:

(a) the sliding valves shall have different sleeve-profiles; in other words, for any two sliding valves, at least one of the n, K, and $m_1$ thereof is different;

(b) in each profile sets, no two sleeve-profiles S[n, K, $j_1$] and S[n, K, $j_2$] shall be used on the same tubular string if $|j_1-j_2| \leq 1$; in other words, for any two sliding valves with a same n and a same K, the difference between the $m_1$ thereof needs to be greater than 1;

(c) sliding valves with shorter length $L_s$ shall be uphole to those with longer length $L_s$; in other words, the sliding valves with smaller (n+K) are uphole to those with larger (n+K);

(d) for sliding valves with a same length $L_s$, those with larger $S_r$ shall be uphole to those with smaller $S_r$; in other words, for sliding valves with a same (n+K), those with larger n are uphole to those with smaller n and (e) sliding valves of the same profile set, i.e., those having a same n and a same K, but with different $m_1$ can be arranged in any order.

Figure 51:
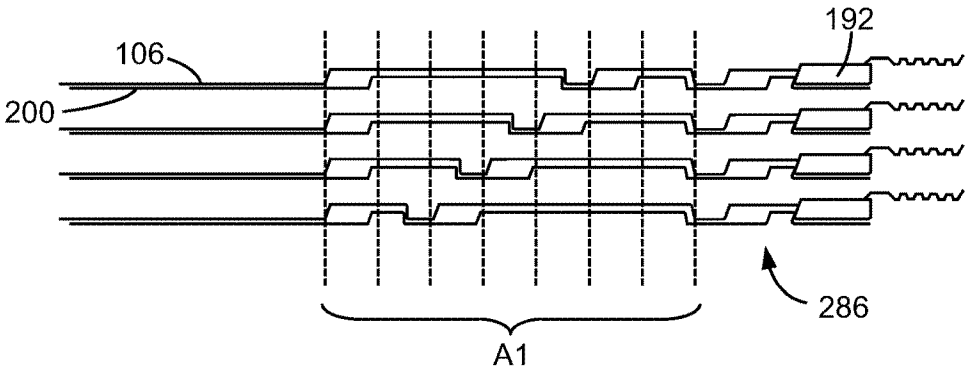
FIG. 51 is a schematic diagram showing a set of extended sleeve- and collet-profiles, according to some alternative embodiments of this disclosure.
Figure 52:
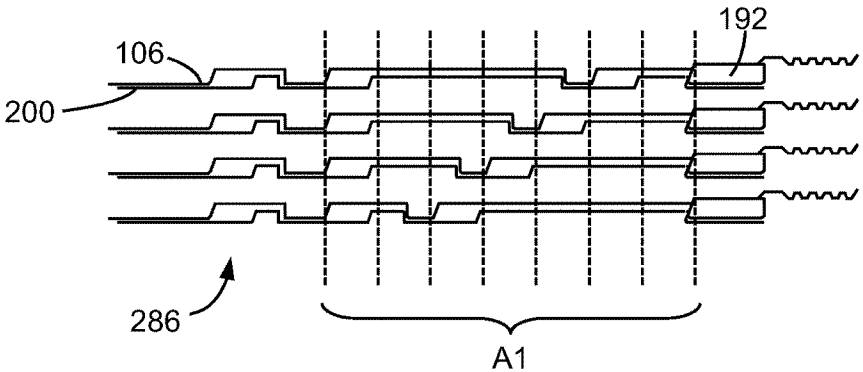
FIG. 52 is a schematic diagram showing a set of extended sleeve- and collet-profiles, according to yet some alternative embodiments of this disclosure.

In some alternative embodiments, the above-described sleeve-profiles and collet-profiles may be concatenated or cascaded with other suitable profiles to obtain extended profiles. For example, FIG. 51 shows a set of extended sleeve- and collet-profiles obtained by concatenating a same profile 286 between the profile in profile set A1 and the stop ring 192. As shown in FIG. 52, in some embodiments, a same profile 286 may be concatenated uphole to the profiles in set A1 to obtain extended profiles.

Figure 53:
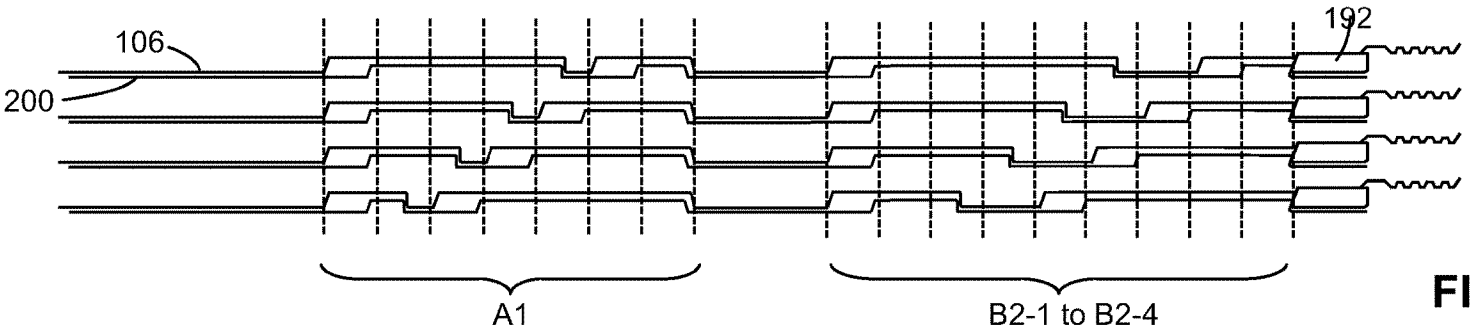
FIG. 53 is a schematic diagram showing a set of extended sleeve- and collet-profiles, according to still some alternative embodiments of this disclosure.

In some embodiments, the profiles in a same set may be concatenated with different profiles to obtain extended profiles. For example, FIG. 53 shows the profiles of set A1 concatenated with the first four profiles in set B2 to obtain extended profiles.

Figure 54:
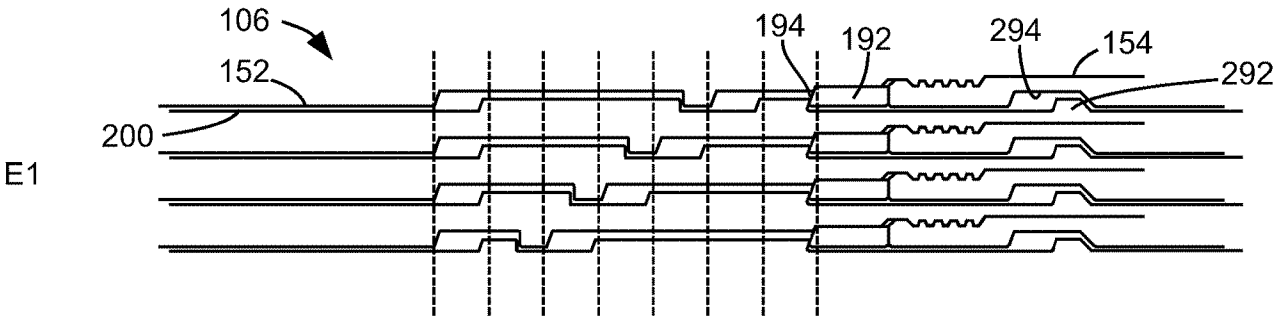
FIGS. 54 to 57 are schematic diagrams showing a set of extended sleeve- and collet-profiles, according to some other embodiments of this disclosure.
Figure 55:
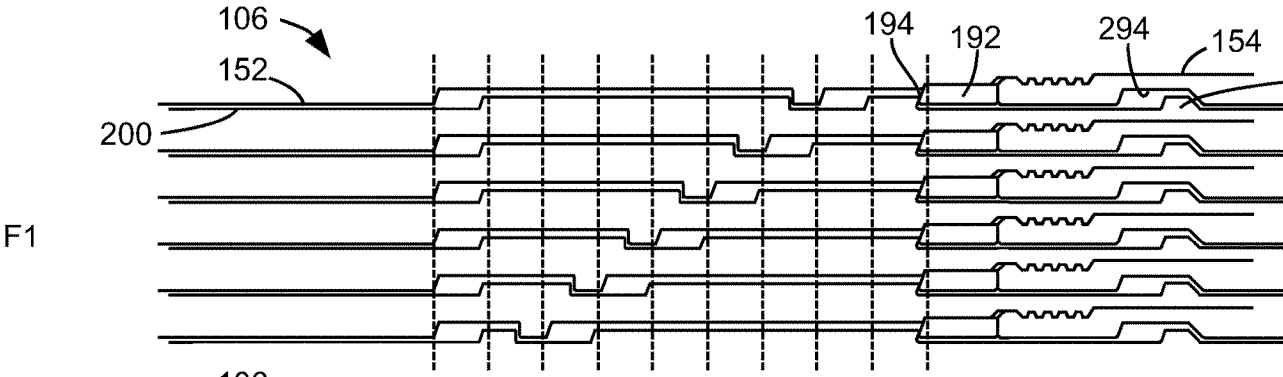
Figure 56:
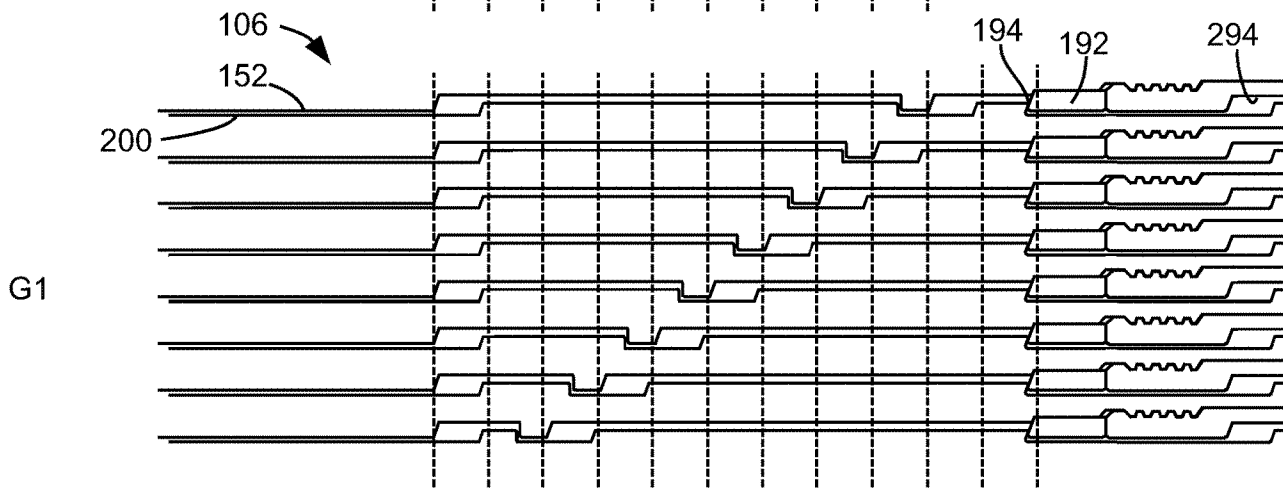
Figure 57:
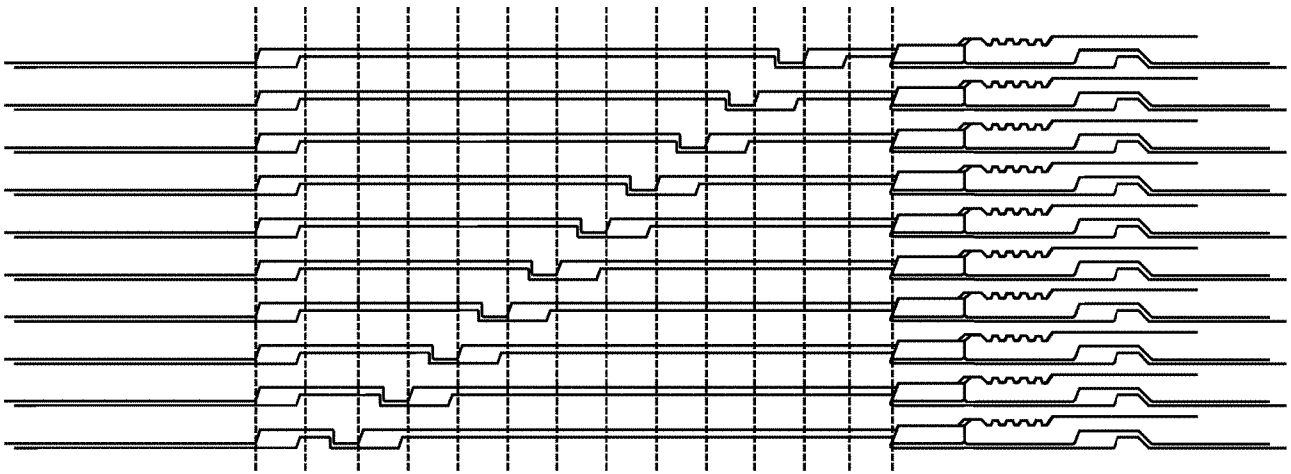
Figure 58:
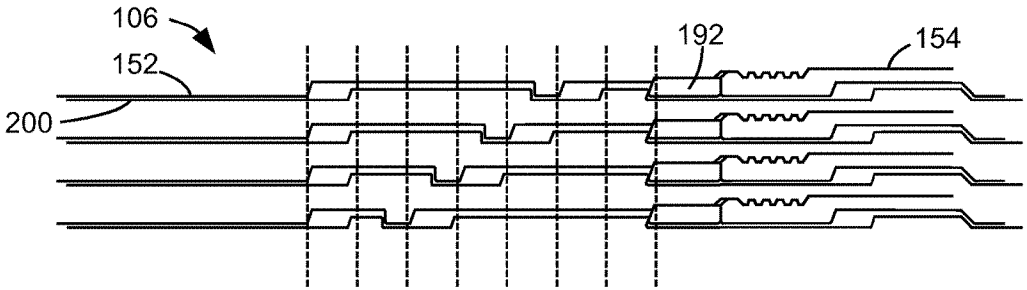
FIGS. 58 to 61 are schematic diagrams showing a set of extended sleeve- and collet-profiles, according to yet some other embodiments of this disclosure.
Figure 59:
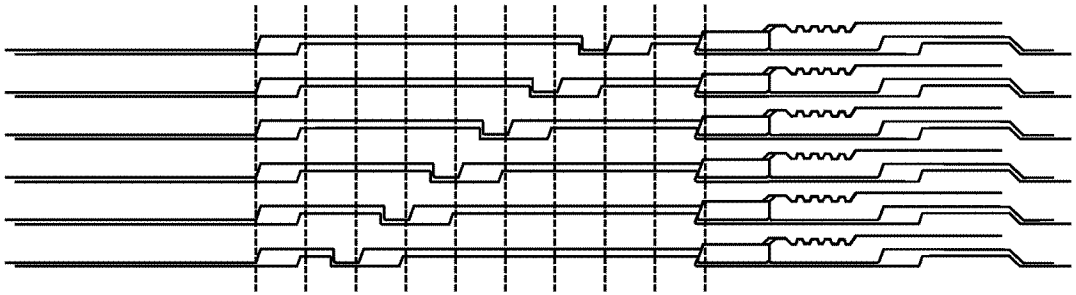
Figure 60:
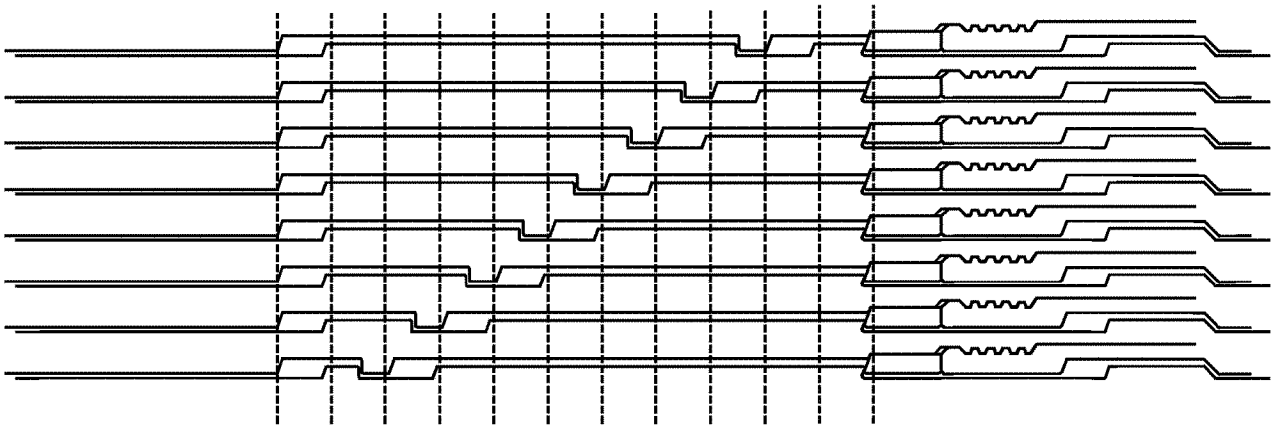
Figure 61:
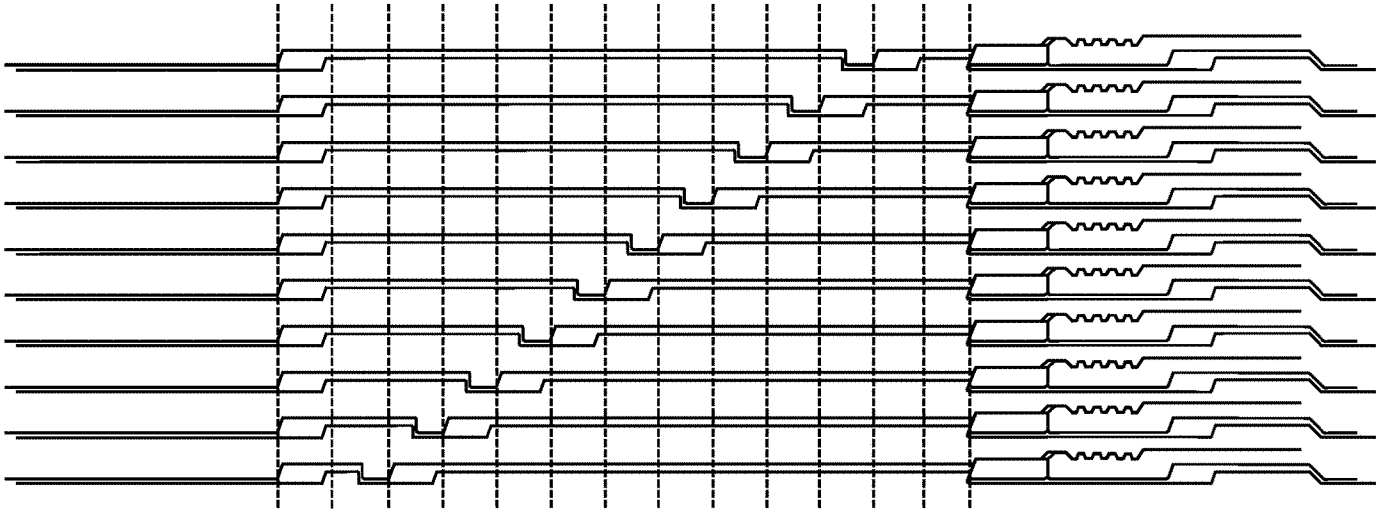

In above embodiments, the sleeve-profile is on the inner surface of the sleeve body 152 such that the stop shoulder 194 of the stop ring 192 is downhole thereto. In some alternative embodiments such as shown in FIGS. 54 to 56, the sleeve-profile comprises a profile portion on the inner surface of the sleeve body 152 as described above and a profile portion on the inner surface of the protection sleeve 154, such that the stop shoulder 194 of the stop ring 192 is in the sleeve-profile.

Correspondingly, the collet 200 may have a collet-profile extended on both the sleeve body 152 and the protection sleeve 154 for matching the sleeve-profile. To ensure the front or downhole portion of the collet 200 to smoothly pass the stop ring 192, each protrusion 292 on collet 200 that matches the profile on protection sleeve 154 has an obtuse angle on its downhole side.

The profile on the protection sleeve 154 may have any suitable shape and may be combined with a sleeve body 152 of any suitable profile such as any of those shown in FIGS. 22 to 49. For example, FIGS. 54 to 57 illustrate the protection sleeve 154 having a groove 294 of a length $2L_b$, and is combined with profile sets A1, B1, C1, and D1 shown in FIGS. 22 to 25, respectively. Correspondingly, the collet-profile of the collet 200 comprises a protrusion or ridge 292 of length $L_b$ for matching the groove 294.

In some embodiments, the groove 294 may have other suitable lengths. For example, FIGS. 58 to 61 illustrate the protection sleeve 154 having a groove 294 of a length $3L_b$, and is combined with profile sets A1, B1, C1, and D1 shown in FIGS. 22 to 25, respectively. Correspondingly, the collet-profile of the collet 200 comprises a protrusion or ridge 292 of length $2L_b$ for matching the groove 294.

In some embodiments, the profile on the protection sleeve 154 may comprise one or more grooves and/or one or more ridges.

In some embodiments, the profile on the protection sleeve 154 may be a profile selected from those shown in FIGS. 22 to 49. For example, a set of extended profiles may be obtained by concatenating those in profile set A1 with the first four profiles in profile set B2 wherein the first four profiles in profile set B2 are downhole to the stop ring 192 or on the protection sleeve 154.

Figure 62:
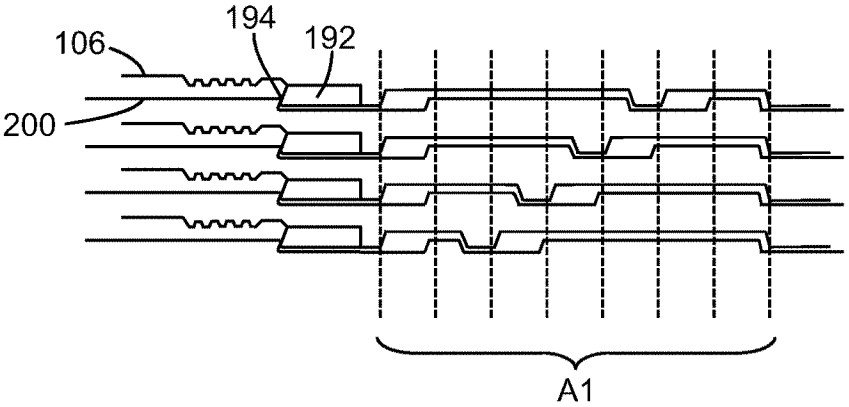
FIG. 62 is a schematic diagram showing a set of extended sleeve- and collet-profiles, according to still some other embodiments of this disclosure.

As shown in FIG. 62, in some alternative embodiments, the sleeve profile (such as a sleeve-profile in profile set A1) may be located downhole to the stop ring 192. Therefore, the stop shoulder 194 is uphole to the sleeve-profile. In these embodiments, each protrusion on the collet 200 has an obtuse angle on its downhole side to ensure the collet 200 to smoothly pass the stop ring 192.

As described above and shown in FIGS. 15A and 15B, the sliding sleeve 126 of the sliding valve 100 may be pressure-actuated by the ball 242 and the collet 200 to the open position to open fluid ports for fracking, wherein the splines 218 of the collet 200 are capable of being pressure-actuated to radially outwardly expand when uphole fluidic pressure is applied and a compression of the collet results when the collet-profile 212 engages the shoulder 194 of the stop ring 192, causing the splines 218 to radially expand outwardly so as to further engage the sliding sleeve 106 for enhanced engagement and thus further pressure resistance. FIGS. 63A to 63F show more detail of the radially outwardly expandable collet-profile 212.

Figure 63A:
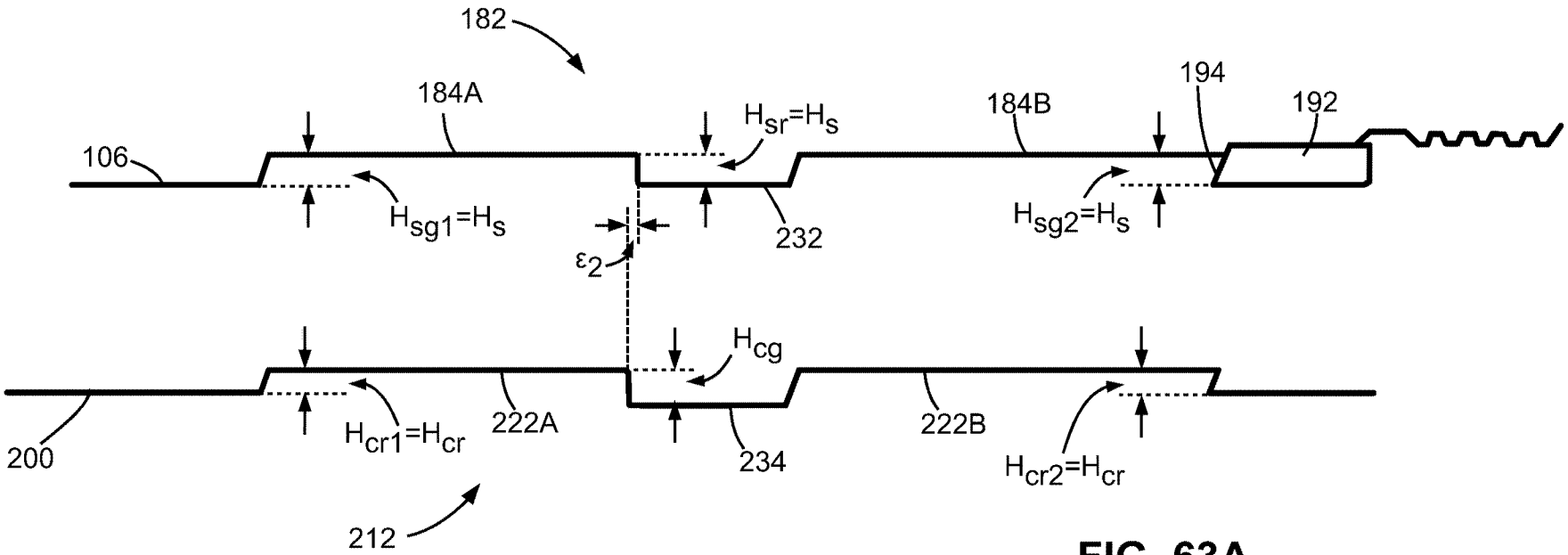
FIGS. 63A to 63F are schematic diagrams showing a collet-profile on a collet and a sleeve-profile on a sliding sleeve; according to some embodiments, wherein the splines of the collet are capable of being pressure-actuated to radially outwardly expand when uphole fluidic pressure is applied and a compression of the collet results causing the splines to radially expand outwardly so as to further engage the sliding sleeve for enhanced engagement and thus further pressure resistance.

Referring to FIG. 63A, for ease of description, the sleeve-grooves 184A and 184B are considered to have a same ID, and the collet-ridges 222A and 222B are considered to have a same OD.

The depth $H_{sg1}$ of the uphole sleeve-groove 184A is measured radially between the outermost surface thereof (i.e., the "bottom" thereof) and the innermost uphole edge thereof (i.e., the uphole "top" edge thereof). The height $H_{sr}$ of sleeve-ridge 232 is measured radially between the innermost surface thereof (i.e., the "top" thereof) and the outermost edge thereof (i.e., the "bottom" edge thereof). The depth $H_{sg2}$ of the downhole sleeve-groove 184B is measured radially between the outermost surface thereof and the innermost downhole edge thereof which is also the innermost edge of the stop shoulder 194.

Similarly, the height $H_{cr1}$ of the uphole collet-ridges 222A is measured radially between the outermost surface thereof (i.e., the "top" thereof) and the innermost uphole edge thereof (i.e., the uphole "bottom" edge thereof). The depth $H_{cg}$ of the collet-groove 234 is measured radially between the innermost surface thereof (i.e., the "bottom" thereof) and the outermost edge thereof (i.e., the "top" edge thereof). The height $H_{cr2}$ of the downhole collet-ridges 222B is measured radially between the outermost surface thereof (i.e., the "top" thereof) and the innermost downhole edge thereof (i.e., the downhole "bottom" edge thereof).

Figure 63B:
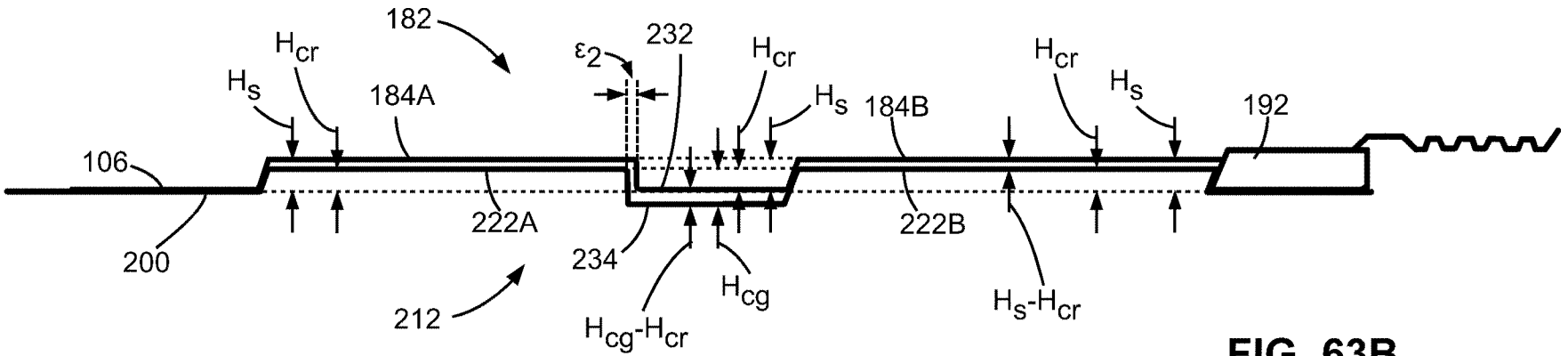
Figure 63C:
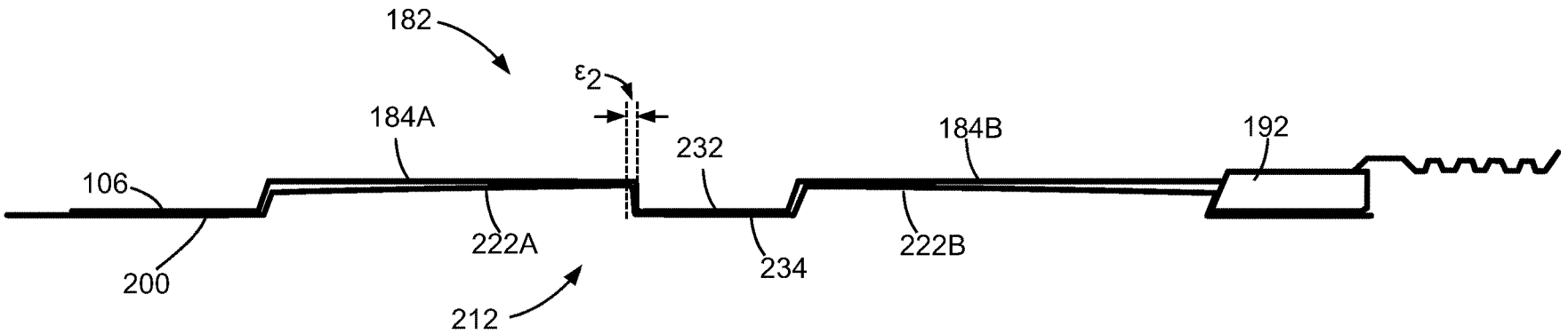

In some embodiments as shown in FIGS. 63A to 63C, $H_{sg1}=H_{sg2}=H_{sr}=H_s$, and $H_{cr1}=H_{cr2}=H_{cr}$. Referring to FIG. 63B, to allow the collet-profile 212 to be radially outwardly expandable when the collet-profile 212 engages the sleeve-profile 182, it is required that a gap is maintained between each of the sleeve-grooves 184A and 184B and the collet-groove 234 and each of the corresponding collet-ridges 222A and 222B and the sleeve-ridge 232. In other words, $H_s-H_{cr}>0$, $H_{cg}-H_{cr}>0$, and $\varepsilon_2>0$. Therefore in these embodiments, $H_s>H_{cr}$, $H_{cg}>H_{cr}$, and $\varepsilon_2>0$.

In some embodiments where $H_{sg1}=H_{sg2}=H_{sr}=H_s$, and $H_{cr1}=H_{cr2}=H_{cr}$, and the collet-groove 234 is at a location about the longitudinal center of the collet profile 212, the collet-groove 234 is the most expanded portion when the splines 218 are radially outwardly expanded or flexed (see FIG. 63C). In these embodiments, it is required that $H_s>H_{cr}$, $H_{cg}>H_{cr}$, and $\varepsilon_2>0$. It is preferable that the gap between the collet-groove 232 and the sleeve-ridge 232 is greater than or equal to the gap between the sleeve-groove 184A/184B and the corresponding collet-ridge 222A/222B. In other words, $H_s-H_{cr}>0$, $H_{cg}-H_{cr}>0$, $H_{cg}-H_{cr}\geq H_s-H_{cr}$, and $\varepsilon_2>0$. Therefore in these embodiments, $H_{cg}\geq H_s>H_{cr}$, and $\varepsilon_2>0$. In some embodiments, it is preferable that $H_{cg}=H_s>H_{cr}$, and $\varepsilon_2>0$ such that when the collet-profile 212 is radially outwardly expanded in the sleeve-profile 182, the collet-ridge 234 can fully engage the sleeve-ridge 232 and eliminate the gap therebetween.

As shown in FIGS. 63B and 63C, after the collet 200 engages the sliding sleeve 106, a further pressure from uphole thereof may actuate collet 200 further downhole, forcing the splines 218 to radially outwardly expand or flex and further and to a greater extent matingly engage sliding sleeve 106.

Figure 63D:
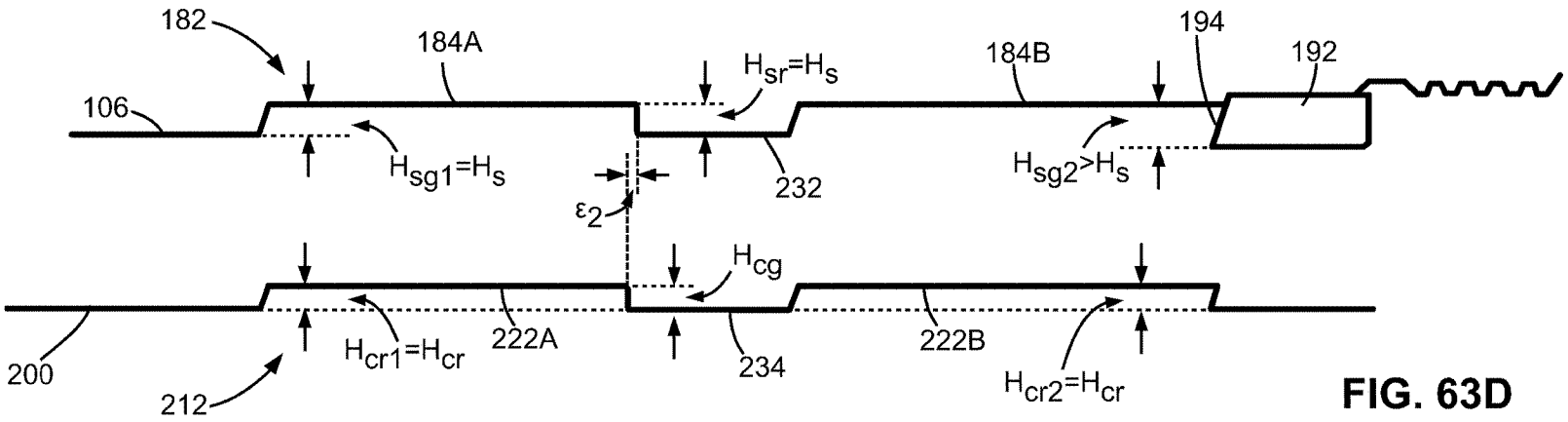
Figure 63E:
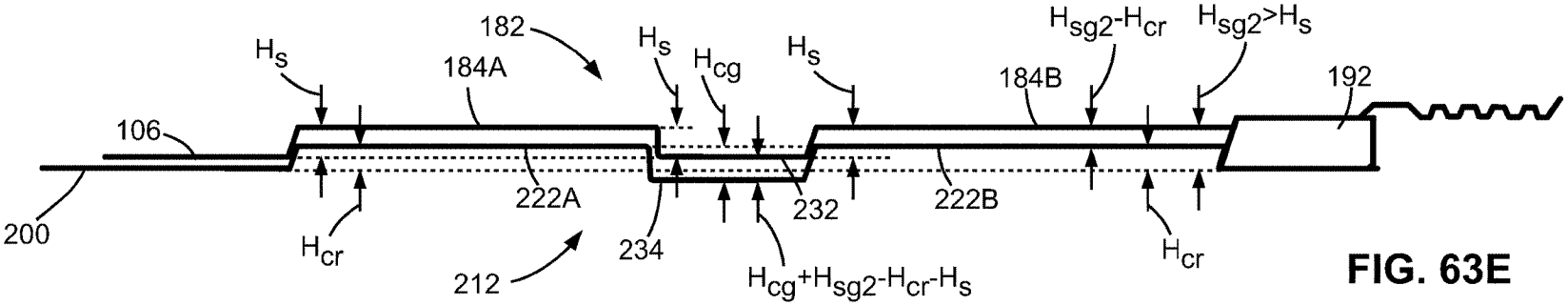
Figure 63F:
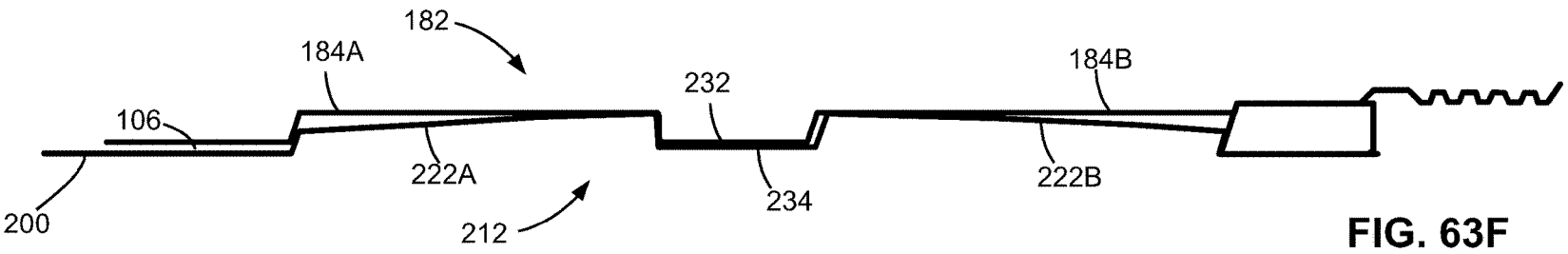

In some embodiments as shown in FIGS. 63D to 63F, the depth of the uphole sleeve-groove 184A is the same as the height of the sleeve-ridge 232. However, the downhole sleeve-groove 184B has a depth larger than that of the uphole sleeve-groove 184A. That is, $H_{sg1}=H_{sr}=H_s$ and $H_{sg2}>H_s$. The heights of the collet-ridges 222A and 222B and the depth of the collet-groove 234 are the same. That is, $H_{cr1}=H_{cr2}=H_{cr}$.

Referring to FIG. 63E, in these embodiments, $H_{cg}+H_{sg2}-H_{cr}-H_s>0$, $H_{sg2}-H_{cr}>0$, and $\varepsilon_2>0$, to allow the collet-profile 212 to be radially outwardly expandable when the collet-profile 212 engages the sleeve-profile 182.

In some embodiments where $H_{sg1}=H_{sr}=H_s$, $H_{sg2}>H_s$, $H_{cr1}=H_{cr2}=H_{cr}$, and the collet-groove 234 is at a location about the longitudinal center of the collet profile 212, the collet-groove 234 is the most expanded portion when the splines 218 are radially outwardly expanded (see FIG. 63E).

In these embodiments, $H_{cg}+H_{sg2}-H_{cr}-H_s>0$, $H_{sg2}-H_{cr}>0$, and $\varepsilon_2>0$. It is preferable that the gap between the collet-groove 232 and the sleeve-ridge 232 is greater than or equal to the gap between the sleeve-groove 184A/184B and the corresponding collet-ridge 222A/222B. In other words, $H_{cg}+H_{sg2}-H_{cr}-H_s\geq H_{sg2}-H_{cr}$. Therefore in these embodiments, $H_{sg2}>H_{cr}$, $H_{cg}\geq H_s$, and $\varepsilon_2>0$. In some embodiments, it is preferable that $H_{sg2}>H_{cr}$, $H_{cg}=H_s$, and $\varepsilon_2>0$ such that when the collet-profile 212 is radially outwardly expanded in the sleeve-profile 182, the collet-ridge 234 can fully engage the sleeve-ridge 232 and eliminate the gap therebetween.

Although embodiments have been described above with reference to the accompanying drawings, those of skill in the art will appreciate that variations and modifications may be made without departing from the scope of the invention.

For a complete definition of the invention and its intended scope, reference is to be made to the summary of the invention and the appended claims read together with and considered with the detailed description and drawings herein on a purposive interpretation thereof.

What is claimed is:

1. A downhole sliding-sleeve set having a plurality of interrelated sliding valves, each of the sliding valves comprising:

a valve body having a longitudinal bore therethrough and one or more fluid ports on an uphole portion of the sidewall thereof; and a sliding sleeve received in the longitudinal bore of the valve body and movable between an uphole closed position closing the one or more fluid ports and a downhole open position opening the one or more fluid ports, the sliding sleeve comprising a longitudinal bore;

wherein the sliding sleeve comprises a sleeve-profile formed at least by a first and a second sleeve-grooves and a sleeve-ridge therebetween, the first and second sleeve-grooves and the sleeve-ridge longitudinally distributed on an inner surface of the sliding sleeve about the longitudinal bore thereof; and wherein the longitudinal lengths $S_{g1}$, $S_{g2}$ and $S_r$ of the first and second sleeve-grooves and the sleeve-ridge, respectively, are determined by:

$$S_r=\delta L_a+nL_b,\ S_r>0,$$

$$S_{g1}=m_1L_b+(1-\delta)L_a,$$

$$S_{g2}=m_2L_b,$$

$$m_1+m_2=K,$$

where $L_a$, $L_b$ and $\delta$ are predetermined parameters with $L_a>0$, $L_b>0$ and $1\geq\delta\geq0$, n is an integer with $n\geq0$, K is a positive integer with $K>2$, $m_1$ and $m_2$ are integers with $m_1\geq1$, and $m_2>1$, $\delta>0$ when $n=0$, and $n>0$ when $\delta=0$;

wherein the longitudinal length $L_s$ of the sleeve-profile is at least:

$$L_s=L_a+(n+K)L_b;$$

wherein for any two of the plurality of the sliding valves, at least one of the n, K, and $m_1$ thereof is different; and wherein a downhole-most portion of said second sleeve-groove $S_{g2}$ is comprised of a radially-inwardly protruding portion of a stop-ring member independently formed from said sliding sleeve and forming a stop shoulder, wherein said stop-ring member is coupled to a downhole portion of said sliding sleeve.

2. The sliding-sleeve set of claim 1, wherein the stop shoulder is downhole to the sleeve profile, and wherein the stop shoulder forms an angled portion wherein a radially-inward portion thereof is uphole of a more-downhole radially-outward portion of said stop shoulder.

3. The sliding-sleeve set of claim 1, wherein the stop shoulder is in the sleeve-profile.

4. The sliding-sleeve set as claimed in claim 1, wherein $L_a=L_b$.

5. A sliding-sleeve system having a collet for mating one of the plurality of interrelated sliding valves of the sliding-sleeve set as claimed in claim 4, the collet of said sliding-sleeve system comprising:

a resiliently flexible collet-profile formed by at least a first uphole and a second downhole collet-ridges and a collet-groove therebetween, a downhole side of said second downhole collet ridge abutting said collet groove forming a radially-outwardly protruding stop shoulder;

where the first uphole collet ridge is shorter than the first sleeve-groove $S_{g1}$ of the mating one of the plurality of interrelated sliding valves by an amount $t_1L_b$, where $L_b \geq t_1L_b \geq 0$ is a design parameter comprising a tolerance and is expressed as a fraction of length $L_b$, and the second downhole collet ridge is shorter than the second sleeve-groove $S_{g2}$ of the mating one of the plurality of interrelated sliding valves by an amount $t_2L_b$, where $L_b \geq t_2L_b \geq 0$ is a second design parameter comprising another tolerance and is expressed as another fraction of length $L_b$.

6. The sliding-sleeve system as claimed in claim 5, wherein $t_1=t_2=t$.

7. The sliding-sleeve system as claimed in claim 6, wherein $1>t>0$.

8. The sliding-sleeve system as claimed in claim 7, wherein t is 0.5.

9. The sliding-sleeve system as claimed in claim 6, wherein $0.9>t\geq 0.1$.

10. The sliding-sleeve system as claimed in claim 6, wherein $0.8>t\geq 0.2$.

11. The sliding-sleeve system as claimed in claim 6, wherein $0.7>t\geq 0.3$.

12. The sliding-sleeve system as claimed in claim 6, wherein $0.6>t\geq 0.4$.

13. The sliding-sleeve system as claimed in claim 6, wherein $t=0$.

14. The sliding-sleeve system as claimed in claim 6, wherein $t=1$.

15. A plurality of collets for use downhole, each collet being movable through the bore of one or more first sliding sleeves and being receivable in a second sliding sleeve, each collet comprising:

a resiliently flexible collet-profile formed by at least a first uphole and a second downhole collet-ridges and a collet-groove therebetween, a downhole side of said second downhole collet ridge abutting said collet groove forming a radially-outwardly protruding stop shoulder, the first and second collet-ridges and the collet-groove respectively corresponding to the first and second sleeve-grooves and the sleeve-ridge;

wherein the lengths $C_{r1}$, $C_{r2}$, and $C_g$ of the first and second collet-ridges and the collet-groove, respectively, are determined by:

$$C_{r1}=(m_1-t_1)L_b+(1-\delta)L_a-\varepsilon_2,\ C_{r1}>0,$$

$$C_{r2}=(m_2-t_2)L_b,\ C_{r2}>0,$$

$$C_g=\delta L_a+(n+t_2)L_b+\varepsilon_2,\ C_g>0,$$

$$m_1+m_2=K,$$

where $L_a$, $L_b$ and $\delta$ are predetermined parameters with $L_a>0$, $L_b>0$ and $1\geq\delta\geq 0$, n is an integer with $n\geq 0$, K is a positive integer with $K>2$, $m_1$ and $m_2$ are integers with $m_1\geq 1$, and $m_2>1$, $t_1$, $t_2$, and $\varepsilon_2$ are predetermined parameters with $1\geq t_1\geq 0$, $1\geq t_2\geq 0$, and $(m_1-t_1)L_b+(1-\delta)L_a>\varepsilon_2\geq 0$; and wherein the longitudinal length $L_c$ of the collet-profile is at least:

$$L_c=L_a+(n+K-t_2)L_b;$$

and wherein for any two of the plurality of collets, at least one of the n, K, and $m_1$ thereof is different; and wherein the stop shoulder has an acute angle formed between an upper edge of the second downhole collet ridge and a radially-inwardly protruding surface on a downhole side edge thereof, adapted to lockingly engage a correspondingly-angled uphole side of a stop ring member.

16. The plurality of collets as claimed in claim 15, wherein $t_1=t_2=t$.

17. The plurality of collets as claimed in claim 15, wherein $1>t>0$.

18. The plurality of collets as claimed in claim 15, wherein t is 0.5.

19. The plurality of collets as claimed in claim 15, wherein $0.9>t>0.1$.

20. The plurality of collets as claimed in claim 15, wherein $0.8>t>0.2$.

21. The plurality of collets as claimed in claim 15, wherein $0.7>t>0.3$.

22. The plurality of collets as claimed in claim 15, wherein $0.6>t>0.4$.

23. The plurality of collets as claimed in claim 15, wherein $t=0$.

24. The plurality of collets as claimed in claim 15, wherein $t=1$.

25. A tubular string comprising:

a plurality of the sliding valves as claimed in claim 1;

wherein the sliding valves are arranged in the tubular string according to:

(a) for any two of the plurality of the sliding valves, at least one of the n, K, and $m_1$ thereof is different;

(b) the sliding valves with smaller (n+K) are uphole to those with larger (n+K);

(c) for sliding valves with a same (n+K), those with larger n are uphole to those with smaller n; and (d) sliding valves with a same n and a same K, but with different $m_1$ are arranged in any order.

26. A tubular string comprising:

a plurality of the sliding valves as claimed in claim 4;

wherein the sliding valves are arranged in the tubular string according to:

(a) for any two of the plurality of the sliding valves, at least one of the n, K, and $m_1$ thereof is different;

(b) the sliding valves with smaller (n+K) are uphole to those with larger (n+K);

(c) for sliding valves with a same (n+K), those with larger n are uphole to those with smaller n; and (d) sliding valves with a same n and a same K, but with different $m_1$ are arranged in any order.

27. A tubular string comprising:

the sliding-sleeve system as claimed in claim 14;

wherein the sliding valves are arranged in the tubular string according to:

(a) for any two of the plurality of the sliding valves, at least one of the n, K, and $m_1$ thereof is different;

(b) for any two of the plurality of the sliding valves with a same n and a same K, the difference between the $m_1$ thereof is greater than 1;

(c) the sliding valves with smaller (n+K) are uphole to those with larger (n+K);

(d) for sliding valves with a same (n+K), those with larger n are uphole to those with smaller n; and (e) sliding valves with a same n and a same K but with different $m_1$ are arranged in any order.

28. The tubular string as claimed in any one of claim 25, 26, or 27, wherein the tubular string is a casing string.

29. The tubular string as claimed in any one of claim 25, 26, or 27, wherein the tubular string is a tubing string for receiving in a wellbore.

30. A downhole system comprising:

a tubular string comprising a plurality of interrelated sliding valves; and a plurality of collets according to any one of claims 15 to 24;

wherein each of the sliding valves comprises:

a valve body having a longitudinal bore therethrough and one or more fluid ports on an uphole portion of the sidewall thereof; and a sliding sleeve received in the longitudinal bore of the valve body and movable between an uphole closed position closing the one or more fluid ports and a downhole open position opening the one or more fluid ports, the sliding sleeve comprising a longitudinal bore;

wherein the sliding sleeve comprises a sleeve-profile formed at least by a first and a second sleeve-grooves and a sleeve-ridge therebetween, the first and second sleeve-grooves and the sleeve-ridge longitudinally distributed on an inner surface of the sliding sleeve about the longitudinal bore thereof; and wherein the longitudinal lengths $S_{g1}$, $S_{g2}$ and $S_r$ of the first and second sleeve-grooves and the sleeve-ridge, respectively, are determined by:

$$S_r=\delta L_a+nL_b,\ S_r>0,$$

$$S_{g1}=m_1L_b+(1-\delta)L_a,$$

$$S_{g2}=m_2L_b,$$

$$m_1+m_2=K,$$

where $L_a$, $L_b$ and δ are predetermined parameters with $L_a>0$, $L_b>0$ and $1\geq\delta\geq0$, n is an integer with $n\geq0$, K is a positive integer with K>2, $m_1$ and $m_2$ are integers with $m_1\geq1$, and $m_2>1$, δ>0 when n=0, and n>0 when δ=0;

wherein the longitudinal length $L_s$ of the sleeve-profile is at least:

$$L_s=L_a+(n+K)L_b;$$

wherein for any two of the plurality of the sliding valves, at least one of the n, K, and $m_1$ thereof is different; and wherein a downhole-most portion of said second sleeve-groove $S_{g2}$ is comprised of a radially-inwardly protruding portion of a stop-ring member independently formed from said sliding sleeve and forming a stop shoulder, wherein said stop-ring member is coupled to a downhole portion of said sliding sleeve;

wherein the sliding valves are arranged in the tubular string according to:

(a) for any two of the plurality of the sliding valves, at least one of the n, K, and $m_1$ thereof is different;

(b) the sliding valves with smaller (n+K) are uphole to those with larger (n+K);

(c) for sliding valves with a same (n+K), those with larger n are uphole to those with smaller n; and (d) sliding valves with a same n and a same K, but with different $m_1$ are arranged in any order.

31. A downhole system comprising:

a tubular string comprising a plurality of interrelated sliding valves; and a plurality of collets according to any one of claims 15 to 24;

wherein each of the sliding valves comprises:

a valve body having a longitudinal bore therethrough and one or more fluid ports on an uphole portion of the sidewall thereof; and a sliding sleeve received in the longitudinal bore of the valve body and movable between an uphole closed position closing the one or more fluid ports and a downhole open position opening the one or more fluid ports, the sliding sleeve comprising a longitudinal bore;

wherein the sliding sleeve comprises a sleeve-profile formed at least by a first and a second sleeve-grooves and a sleeve-ridge therebetween, the first and second sleeve-grooves and the sleeve-ridge longitudinally distributed on an inner surface of the sliding sleeve about the longitudinal bore thereof; and wherein the longitudinal lengths $S_{g1}$, $S_{g2}$ and $S_r$ of the first and second sleeve-grooves and the sleeve-ridge, respectively, are determined by:

$$S_r=\delta L_a+nL_b,\ S_r>0,$$

$$S_{g1}=m_1L_b+(1-\delta)L_a,$$

$$S_{g2}=m_2L_b,$$

$$m_1+m_2=K,$$

where $L_a$, $L_b$ and δ are predetermined parameters with $L_a>0$, $L_b>0$ and $1\geq\delta\geq0$, n is an integer with $n\geq0$, K is a positive integer with K>2, $m_1$ and $m_2$ are integers with $m_1\geq1$, and $m_2>1$, δ>0 when n=0, and n>0 when δ=0;

wherein the longitudinal length $L_s$ of the sleeve-profile is at least:

$$L_s=L_a+(n+K)L_b;$$

wherein for any two of the plurality of the sliding valves, at least one of the n, K, and $m_1$ thereof is different; and wherein a downhole-most portion of said second sleeve-groove $S_{g2}$ is comprised of a radially-inwardly protruding portion of a stop-ring member independently formed from said sliding sleeve and forming a stop shoulder, wherein said stop-ring member is coupled to a downhole portion of said sliding sleeve;

wherein $L_a=L_b$; and wherein the sliding valves are arranged in the tubular string according to:

(a) for any two of the plurality of the sliding valves, at least one of the n, K, and $m_1$ thereof is different;

(b) the sliding valves with smaller (n+K) are uphole to those with larger (n+K);

(c) for sliding valves with a same (n+K), those with larger n are uphole to those with smaller n; and (d) sliding valves with a same n and a same K, but with different mi are arranged in any order.

32. A downhole system comprising:

a tubular string comprising a sliding-sleeve system having a collet for mating one of a plurality of interrelated sliding valves; and a plurality of collets according to any one of claims 15 to 24;

wherein each of the sliding valves comprises:

a valve body having a longitudinal bore therethrough and one or more fluid ports on an uphole portion of the sidewall thereof; and a sliding sleeve received in the longitudinal bore of the valve body and movable between an uphole closed position closing the one or more fluid ports and a downhole open position opening the one or more fluid ports, the sliding sleeve comprising a longitudinal bore;

wherein the sliding sleeve comprises a sleeve-profile formed at least by a first and a second sleeve-grooves and a sleeve-ridge therebetween, the first and second sleeve-grooves and the sleeve-ridge longitudinally distributed on an inner surface of the sliding sleeve about the longitudinal bore thereof; and wherein the longitudinal lengths $S_{g1}$, $S_{g2}$ and $S_r$ of the first and second sleeve-grooves and the sleeve-ridge, respectively, are determined by:

$$S_r=\delta L_a+nL_b, S_r>0,$$

$$S_{g1}=m_1L_b+(1-\delta)L_a,$$

$$S_{g2}=m_2L_b,$$

$$m_1+m_2=K,$$

where $L_a$, $L_b$ and $\delta$ are predetermined parameters with $L_a>0$, $L_b>0$ and $1\geq\delta\geq0$, n is an integer with $n\geq0$, K is a positive integer with $K>2$, $m_1$ and $m_2$ are integers with $m_1\geq1$, and $m_2>1$, $\delta>0$ when $n=0$, and $n>0$ when $\delta=0$;

wherein the longitudinal length $L_s$ of the sleeve-profile is at least:

$$L_s=L_a+(n+K)L_b;$$

wherein for any two of the plurality of the sliding valves, at least one of the n, K, and $m_1$ thereof is different; and wherein a downhole-most portion of said second sleeve-groove $S_{g2}$ is comprised of a radially-inwardly protruding portion of a stop-ring member independently formed from said sliding sleeve and forming a stop shoulder, wherein said stop-ring member is coupled to a downhole portion of said sliding sleeve;

wherein $L_a=L_b$; and wherein the collet of said sliding-sleeve system comprises:

a resiliently flexible collet-profile formed by at least a first uphole and a second downhole collet-ridges and a collet-groove therebetween, a downhole side of said second downhole collet ridge abutting said collet groove forming a radially-outwardly protruding stop shoulder, where the first uphole collet ridge is shorter than the first sleeve-groove $S_{g1}$ of the mating one of the plurality of interrelated sliding valves by an amount $t_1L_b$, where $L_b\geq t_1L_b\geq0$ is a design parameter comprising a tolerance and is expressed as a fraction of length $L_b$, and the second downhole collet ridge is shorter than the second sleeve-groove $S_{g2}$ of the mating one of the plurality of interrelated sliding valves by an amount $t_2L_b$, where $L_b\geq t_2L_b>0$ is a second design parameter comprising another tolerance and is expressed as another fraction of length $L_b$;

wherein $t_1=t_2=1$; and wherein the sliding valves are arranged in the tubular string according to:

(a) for any two of the plurality of the sliding valves, at least one of the n, K, and $m_1$ thereof is different;

(b) for any two of the plurality of the sliding valves with a same n and a same K, the difference between the $m_1$ thereof is greater than 1;

(c) the sliding valves with smaller (n+K) are uphole to those with larger (n+K);

(d) for sliding valves with a same (n+K), those with larger n are uphole to those with smaller n; and (e) sliding valves with a same n and a same K but with different $m_1$ are arranged in any order.

* * * * *